US007899375B2

(12) United States Patent
Kato et al.

(10) Patent No.: US 7,899,375 B2
(45) Date of Patent: Mar. 1, 2011

(54) DEVELOPING APPARATUS, IMAGE FORMING APPARATUS, IMAGE FORMING SYSTEM AND IMAGE FORMING METHOD

(75) Inventors: Hiroshi Kato, Okaya (JP); Takatomo Fukumoto, Shiojiri (JP); Osamu Kobayashi, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 273 days.

(21) Appl. No.: 12/059,803

(22) Filed: Mar. 31, 2008

(65) Prior Publication Data

US 2009/0003888 A1 Jan. 1, 2009

(30) Foreign Application Priority Data

| | | |
|---|---|---|
| Apr. 2, 2007 | (JP) | 2007-096603 |
| May 21, 2007 | (JP) | 2007-134101 |
| Jul. 26, 2007 | (JP) | 2007-195001 |
| Jul. 26, 2007 | (JP) | 2007-195002 |
| Jul. 26, 2007 | (JP) | 2007-195003 |

(51) Int. Cl.
*G03G 15/08* (2006.01)

(52) U.S. Cl. ..... 399/279; 399/274; 399/265; 399/284; 399/286; 492/48; 492/53; 492/56

(58) Field of Classification Search ..... 399/279, 399/265, 284, 286, 274; 492/48, 53, 56
See application file for complete search history.

(56) References Cited

U.S. PATENT DOCUMENTS

2005/0069348 A1* 3/2005 Fujita et al. ..... 399/237
2005/0078985 A1* 4/2005 Okamura ..... 399/284

FOREIGN PATENT DOCUMENTS

| | | |
|---|---|---|
| JP | 2005-128311 | 5/2005 |
| JP | 2006-259384 | 9/2006 |
| JP | 2006259384 A * | 9/2006 |

OTHER PUBLICATIONS

Mott et al. Acoustic and dynamic mechanical properties of a polyurethane rubber, Journal of the Acoustical Society of America, vol. 111, No. 4 (Apr. 2002), pp. 1782-1790.*

Block An instant bond: silicone reactive hot melt for plastics [online], Sep. 2006 [retrieved on Feb. 24, 2010]. Retrieved from the Internet:< URL: http://www.ascouncil.org/news/endusermaterials/presentations/DowCorning-ATE06.pdf>.*

* cited by examiner

*Primary Examiner*—David P Porta
*Assistant Examiner*—Shun Lee
(74) *Attorney, Agent, or Firm*—DLA Piper LLP (US)

(57) ABSTRACT

A developer carrier has concave portions regularly arranged on the surface thereof and being rotatable with a developer thereon. A contact member is made of an elastic rubber material, is in contact with the surface of the developer carrier, and vibrates with the rotation of the developer carrier. A value obtained by dividing a movement speed of the surface at the time of rotation of the developer carrier by a pitch of the concave portions in a peripheral direction of the developer carrier is smaller than a peak vibrational frequency of the contact member when a loss tangent obtained by dividing a loss elastic modulus of the contact member by a storage elastic modulus is the greatest.

30 Claims, 26 Drawing Sheets

FIG. 22

| | MOVEMENT SPEED V (mm/s) | PITCH L1 (μM) | V/L1 (Hz) | COMPARISON OF G' AND G" | VOLUME (dB) |
|---|---|---|---|---|---|
| COMPARATIVE EXAMPLE 2 | 50 | 141 | 442 | G′ > G″ | 69 |
| EXAMPLE 5 | 100 | 85 | 1176 | G′ < G″ | 31 |
| EXAMPLE 4 | 320 | 113 | 2831 | G′ < G″ | 27 |

FIG. 24

| | MOVEMENT SPEED V (mm/s) | PITCH L1 (μM) | V/L1 (Hz) | COMPARISON OF G' AND G" | TEMPERATURE OF RUBBER PORTION (°C) | FILMING |
|---|---|---|---|---|---|---|
| EXAMPLE 6 | 50 | 141 | 442 | G′ > G″ | 43.2 | NONE |
| COMPARATIVE EXAMPLE 3 | 160 | 141 | 1135 | G′ < G″ | 50.3 | EXIST |
| COMPARATIVE EXAMPLE 4 | 320 | 113 | 2831 | G′ < G″ | 54.7 | EXIST |

| | MOVEMENT SPEED V (mm/s) | PITCH L1 (μM) | V/L1 (Hz) | COMPARISON OF G' AND G" | TEMPERATURE OF RUBBER PORTION (°C) | FILMING |
|---|---|---|---|---|---|---|
| EXAMPLE 7 | 50 | 141 | 442 | G′>G″ | 42.4 | NONE |
| EXAMPLE 8 | 160 | 141 | 1135 | G′>G″ | 40.5 | NONE |
| EXAMPLE 9 | 320 | 113 | 2830 | G′>G″ | 42.6 | NONE |

DEVELOPING APPARATUS, IMAGE FORMING APPARATUS, IMAGE FORMING SYSTEM AND IMAGE FORMING METHOD

The disclosures of Japanese Patent Application No. 2007-096603 which is filed Apr. 2, 2007, Japanese Patent Application No. 2007-134101 which is filed on May 21, 2007, and Japanese Patent Application No. 2007-195001, Japanese Patent Application No. 2007-195002, and Japanese Patent Application No. 2007-195003 which are filed on Jul. 26, 2007, including specifications, drawings and claims are incorporated herein by reference in its entireties.

BACKGROUND

The present invention relates to a developing apparatus, an image forming apparatus, an image forming system, and an image forming method.

An image forming apparatus such as a laser beam printer is known well. Such an image forming apparatus includes an image carrier holding a latent image and a developing apparatus developing the latent image held by the image carrier by the use of a developer. When an image signal, etc. is transmitted from an external apparatus such as a computer, the image forming apparatus forms a developer image and then transfers the developer image onto a medium, thereby finally forming an image on the medium.

The developing apparatus includes a developer carrier rotating with a developer held thereon and the developer carrier develops the latent image held by the image carrier by the use of the developer. Concave portions regularly arranged might be formed on the surface of the developer carrier so as to hold a sufficient amount of developer. The developing apparatus might be provided with a contact member being made of a rubber elastic body and coming in contact with the surface of the developer carrier. An example of the contact member is a layer thickness regulating member regulating the layer thickness of the developer held by the developer carrier.

Patent Document 1: Japanese Patent Publication No. 2006-259384A

It is known that the contact member made of a rubber elastic body exhibits a rubber-like characteristic or a glass-like characteristic depending on the temperature of the contact member. At the temperature at which the contact member usually operates, the contact member exhibits the rubber-like characteristic. Accordingly, even when the contact member is disposed in the developing apparatus, it is required that the contact member should be used with the rubber-like characteristic.

It is also known that the contact member may vibrate and the contact member exhibits the rubber-like characteristic or the glass-like characteristic depending on the magnitude of the vibration frequency. That is, it is assumed that a value obtained by dividing the loss elastic modulus of the contact member by the storage elastic modulus is a loss tangent (tan δ). Then, when the frequency of the contact member is greater than the frequency at which the loss tangent (tan δ) is the greatest (hereinafter, also referred to as "greatest loss tangent frequency"), the contact member exhibits the glass-like characteristic. On the other hand, when the frequency of the contact member is smaller than the greatest loss tangent frequency, the contact member exhibits the rubber-like characteristic.

As described above, the contact member is in contact with the surface (which includes the concave portions) of the developer carrier and the developer carrier frictionally slides on the contact member at the time of rotation thereof, thereby causing the contact member to vibrate. When the number of vibrations of the contact member vibrating with the rotation of the developer carrier is greater than the greatest loss tangent frequency, the contact member exhibits the glass-like characteristic and thus the above-mentioned requirement cannot be satisfied.

It is known that the contact member may vibrate with the rotation of the developer carrier and the contact member exhibits the rubber-like characteristic or the glass-like characteristic depending on the number of vibrations. Accordingly, in order to satisfy the above-mentioned requirement, it is preferable that the frequency of the contact member at the time of the rotation of the developer carrier is controlled so as for the contact member to exhibit the rubber-like characteristic.

On the other hand, when the contact member is used with the rubber-like characteristic, abnormal noises may be generated with the vibration of the contact member. Here, the contact member made of the rubber elastic body exhibits dynamic viscoelasticity (an elastic behavior and a viscous behavior). When the elastic behavior of the two behaviors is superior, the amplitude of the vibration of the contact member increases and thus the abnormal noises are easily generated.

It is known that the contact member may vibrate with the rotation of the developer carrier and the contact member exhibits the rubber-like characteristic or the glass-like characteristic depending on the magnitude of the number of vibrations. Accordingly, in order to satisfy the above-mentioned requirements it is preferable that the frequency of the contact member is controlled so as for the contact member to exhibit the rubber-like characteristic.

On the other hand, when the contact member is used with the rubber-like characteristic, the temperature of the contact member may rise with the vibration of the contact member. Here, the contact member made of the rubber elastic body exhibits dynamic viscoelasticity (an elastic behavior and a viscous behavior). When the viscous behavior of the two behaviors is superior, the molecular chains constituting the contact member easily vibrates and thus heat may be easily generated. As a result, the temperature of the contact member easily rises.

As described above, the contact member is in contact with the surface of the developer carrier and the surface of the developer carrier is provided with concave portions regularly arranged. Accordingly, when the developer carrier rotates, the developer carrier slides on the contact member and thus the contact vibrates.

When the number of vibrations of the contact member (the value obtained by dividing the movement speed of the surface with the rotation of the developer carrier by the pitch of the concave portions in the peripheral direction of the developer carrier corresponds to the number of vibrations) is too great, it is known that the contact member made of the rubber elastic body exhibits the glass-like characteristic, not the rubber-like characteristic. Accordingly, at the time of development, it is necessary to allow the developer carrier to rotate at a rotation speed at which the frequency is too great (that is, the contact member does not exhibit the glass-like characteristic).

However, when the development is made in a state where the contact member exhibits the rubber-like characteristic, a filming is generated in the contact member due to tackiness of the contact member based on the rubber-like characteristic. When the filming becomes remarkable, the quality of an image developed and finally formed on the medium is deteriorated.

SUMMARY

An object of the invention is to provide a developing apparatus, an image forming apparatus, and an image forming system in which the contact member is properly used with the rubber-like characteristic at the time of rotation of the developer carrier.

Another object of the invention is to properly use the contact member with the rubber-like characteristic at the time of rotation of the developer carrier and to suppress abnormal noises from being generated with the vibration of the contact member.

Another object of the invention is to properly use the contact member with the rubber-like characteristic at the time of rotation of the developer carrier and to suppress the temperature from rising.

Another object of the invention is to properly prevent the image quality from being deteriorated.

In order to accomplish the above-mentioned objects, according to a first aspect of the invention, there is provided a developing apparatus including: a developer carrier having concave portions regularly arranged on the surface thereof and being rotatable with a developer thereon; and a contact member being made of an elastic rubber material, being in contact with the surface of the developer carrier, and vibrating with the rotation of the developer carrier, wherein a value obtained by dividing a movement speed of the surface at the time of rotation of the developer carrier by a pitch of the concave portions in a peripheral direction of the developer carrier is smaller than the number of vibrations of the contact member when a loss tangent obtained by dividing a loss elastic modulus of the contact member by a storage elastic modulus is the greatest.

In the developing apparatus, it is preferable that the contact member is a layer thickness regulating member coming in contact with the surface to regulate the layer thickness of the developer held in the developer carrier. In this case, the layer thickness regulating member is used with a glass-like characteristic, thereby preventing the layer thickness of the developer from being improperly regulated.

In the developing apparatus, it is preferable that the contact member is in contact with the surface so that the longitudinal direction thereof is parallel to the axial direction of the developer carrier and an end in the width direction faces the upstream in the rotation direction of the developer carrier and that a contact portion of the contact member is apart from the end in the width direction.

In the developing apparatus, it is preferable that the concave portions are two types of spiral grooves having different tilt angles about the peripheral direction, the two types of spiral grooves intersect each other to form a lattice shape, the developer carrier has square-like top faces surrounded with the two types of spiral grooves, and one of two diagonals of each square-like top face is parallel to the peripheral direction. In this case, the regular concave portions can be easily formed on the surface of the developer carrier.

In the developing apparatus, it is preferable that the developing apparatus can be mounted on and demounted from an image forming apparatus body of an image forming apparatus, an operating temperature range is set in the image forming apparatus, the number of vibrations of the contact member when the loss tangent is the greatest varies depending on the magnitude of a temperature, and the value obtained by dividing the movement speed of the surface at the time of rotation of the developer carrier by the pitch of the concave portions in the peripheral direction of the developer carrier is smaller than the number of vibrations of the contact member when the loss tangent is the greatest at all the temperatures in the operating temperature range. In this case, the contact member is necessarily used with a rubber-like characteristic when the image forming apparatus forms an image.

In the developing apparatus, it is preferable that the contact member is made of thermoplastic elastomer.

In the developing apparatus, it is preferable that the value obtained by dividing the movement speed of the surface at the time of rotation of the developer carrier by the pitch of the concave portions in the peripheral direction of the developer carrier is smaller than the number of vibrations of the contact member when the loss tangent is the greatest and is smaller than the number of vibrations at which the loss tangent at the number of vibrations is a half of the greatest value. In this case, the contact member is more properly used with the rubber-like characteristic.

Similarly, according to the first aspect of the invention, there is provided an image forming apparatus including: (a) an image carrier holding a latent image; and (b) a developing apparatus developing the latent image held by the image carrier with a developer, (c) wherein the developing apparatus includes: a developer carrier having concave portions regularly arranged on the surface thereof and being rotatable with the developer thereon; and a contact member being made of an elastic rubber material, being in contact with the surface of the developer carrier, and vibrating with the rotation of the developer carrier, wherein a value obtained by dividing a movement speed of the surface at the time of rotation of the developer carrier by a pitch of the concave portions in a peripheral direction of the developer carrier is smaller than the number of vibrations of the contact member when a loss tangent obtained by dividing a loss elastic modulus of the contact member by a storage elastic modulus is the greatest. According to the image forming apparatus, the contact member can be used with the rubber-like characteristic at the time of rotation of the developer carrier.

Similarly, according to the first aspect of the invention, there is provided an image forming system including: (A) a computer; and (B) an image forming apparatus connectable to the computer, (C) wherein the image forming apparatus includes: (a) an image carrier holding a latent image; and (b) a developing apparatus developing the latent image held by the image carrier with a developer, (c) wherein the developing apparatus includes: a developer carrier having concave portions regularly arranged on the surface thereof and being rotatable with the developer thereon; and a contact member being made of an elastic rubber material, being in contact with the surface of the developer carrier, and vibrating with the rotation of the developer carrier, wherein a value obtained by dividing a movement speed of the surface at the time of rotation of the developer carrier by a pitch of the concave portions in a peripheral direction of the developer carrier is smaller than the number of vibrations of the contact member when a loss tangent obtained by dividing a loss elastic modulus of the contact member by a storage elastic modulus is the greatest. According to the image forming system, the contact member can be used with the rubber-like characteristic at the time of rotation of the developer carrier.

In order to accomplish the above-mentioned object, according to a second aspect of the invention, there is provided a developing apparatus including: a developer carrier having concave portions regularly arranged on the surface thereof and being rotatable with a developer thereon; and a contact member being made of an elastic rubber material, being in contact with the surface of the developer carrier, and vibrating with the rotation of the developer carrier, wherein a value obtained by dividing a movement speed of the surface at the time of rotation of the developer carrier by a pitch of the concave portions in a peripheral direction of the developer carrier has the same magnitude of the number of vibrations at which the storage elastic modulus is smaller than the loss elastic modulus among the numbers of vibrations smaller than the number of vibrations of the contact member when a loss tangent obtained by dividing a loss elastic modulus of the contact member by a storage elastic modulus is the greatest. According to the developing apparatus, it is possible to properly use the contact member with the rubber-like characteristic at the time of rotation of the developer carrier and to suppress the generation of an abnormal noise resulting from the vibration of the contact member.

In the developing apparatus, it is preferable that the contact member is a layer thickness regulating member coming in contact with the surface to regulate the layer thickness of the developer held in the developer carrier. In this case, the layer thickness regulating member can be used with the rubber-like characteristic, thereby properly regulating the layer thickness of the developer.

In the developing apparatus, it is preferable that the concave portions are two types of spiral grooves having different tilt angles about the peripheral direction, the two types of spiral grooves intersect each other to form a lattice shape, the developer carrier has square-like top faces surrounded with the two types of spiral grooves, and one of two diagonals of each square-like top face is parallel to the peripheral direction. In this case, the regular concave portions can be easily formed on the surface.

Similarly, according to the second aspect of the invention, there is provided an image forming apparatus including: (a) an image carrier holding a latent image; and (b) a developing apparatus developing the latent image held by the image carrier with a developer, (c) wherein the developing apparatus includes: a developer carrier having concave portions regularly arranged on the surface thereof and being rotatable with a developer thereon; and a contact member being made of an elastic rubber material, being in contact with the surface of the developer carrier, and vibrating with the rotation of the developer carrier, wherein a value obtained by dividing a movement speed of the surface at the time of rotation of the developer carrier by a pitch of the concave portions in a peripheral direction of the developer carrier has the same magnitude of the number of vibrations at which the storage elastic modulus is smaller than the loss elastic modulus among the numbers of vibrations smaller than the number of vibrations of the contact member when a loss tangent obtained by dividing a loss elastic modulus of the contact member by a storage elastic modulus is the greatest. According to the image forming apparatus, it is possible to properly use the contact member with the rubber-like characteristic at the time of rotation of the developer carrier and to suppress the generation of an abnormal noise resulting from the vibration of the contact member.

Similarly, according to the second aspect of the invention, there is provided an image forming system including: (A) a computer; and (B) an image forming apparatus connectable to the computer, (C) wherein the image forming apparatus includes: (a) an image carrier holding a latent image; and (b) a developing apparatus developing the latent image held by the image carrier with a developer, (c) wherein the developing apparatus includes: a developer carrier having concave portions regularly arranged on the surface thereof and being rotatable with a developer thereon; and a contact member being made of an elastic rubber material, being in contact with the surface of the developer carrier, and vibrating with the rotation of the developer carrier, wherein a value obtained by dividing a movement speed of the surface at the time of rotation of the developer carrier by a pitch of the concave portions in a peripheral direction of the developer carrier has the same magnitude of the number of vibrations at which the storage elastic modulus is smaller than the loss elastic modulus among the numbers of vibrations smaller than the number of vibrations of the contact member when a loss tangent obtained by dividing a loss elastic modulus of the contact member by a storage elastic modulus is the greatest. According to the image forming system, it is possible to properly use the contact member with the rubber-like characteristic at the time of rotation of the developer carrier and to suppress the generation of an abnormal noise resulting from the vibration of the contact member.

In order to accomplish the above-mentioned object, according to a third aspect of the invention, there is provided a developing apparatus including: a developer carrier having concave portions regularly arranged on the surface thereof and being rotatable with a developer thereon; and a contact member being made of an elastic rubber material, being in contact with the surface of the developer carrier, and vibrating with the rotation of the developer carrier, wherein a value obtained by dividing a movement speed of the surface at the time of rotation of the developer carrier by a pitch of the concave portions in a peripheral direction of the developer carrier has the same magnitude of the number of vibrations at which the loss elastic modulus is smaller than the storage elastic modulus among the numbers of vibrations smaller than the number of vibrations of the contact member when a loss tangent obtained by dividing a loss elastic modulus of the contact member by a storage elastic modulus is the greatest. According to the developing apparatus, it is possible to properly use the contact member with the rubber-like characteristic at the time of rotation of the developer carrier and to suppress the increase in temperature of the contact member.

In the developing apparatus, it is preferable that the contact member is a layer thickness regulating member coming in contact with the surface to regulate the layer thickness of the developer held in the developer carrier. In this case, the layer thickness regulating member can be properly used with the rubber-like characteristic, thereby properly regulating the layer thickness of the developer.

In the developing apparatus, it is preferable that the layer thickness regulating member is in contact with the surface so that the longitudinal direction thereof is parallel to the axial direction of the developer carrier and an end in the width direction faces the upstream in the rotation direction of the developer carrier, and a contact portion of the layer thickness regulating member is apart from the end in the width direction. In this case, the generation of the filming between the contact portion and an end is suppressed.

In the developing apparatus, it is preferable that the concave portions are two types of spiral grooves having different tilt angles about the peripheral direction, the two types of spiral grooves intersect each other to form a lattice shape, the developer carrier has square-like top faces surrounded with the two types of spiral grooves, and one of two diagonals of each square-like top face is parallel to the peripheral direction. In this case, the regular concave portions can be easily formed on the surface.

Similarly, according to the third aspect of the invention, there is provided an image forming apparatus including: (a) an image carrier holding a latent image; and (b) a developing apparatus developing the latent image held by the image carrier with a developer, (c) wherein the developing apparatus includes: a developer carrier having concave portions regularly arranged on the surface thereof and being rotatable with a developer thereon; and a contact member being made of an elastic rubber material, being in contact with the surface of the developer carrier, and vibrating with the rotation of the developer carrier, wherein a value obtained by dividing a movement speed of the surface at the time of rotation of the developer carrier by a pitch of the concave portions in a peripheral direction of the developer carrier has the same magnitude of the number of vibrations at which the loss elastic modulus is smaller than the storage elastic modulus among the numbers of vibrations smaller than the number of vibrations of the contact member when a loss tangent obtained by dividing a loss elastic modulus of the contact member by a storage elastic modulus is the greatest. According to the image forming apparatus, it is possible to properly use the contact member with the rubber-like characteristic at the time of rotation of the developer carrier and to suppress the increase in temperature of the contact member.

Similarly, according to the third aspect of the invention, there is also provided an image forming system including: (A) a computer; and (B) an image forming apparatus connectable to the computer, (C) wherein the image forming apparatus includes: (a) an image carrier holding a latent image; and (b) a developing apparatus developing the latent image held by the image carrier with a developer, (c) wherein the developing apparatus includes: a developer carrier having concave portions regularly arranged on the surface thereof and being rotatable with a developer thereon; and a contact member being made of an elastic rubber material, being in contact with the surface of the developer carrier, and vibrating with the rotation of the developer carrier, wherein a value obtained by dividing a movement speed of the surface at the time of rotation of the developer carrier by a pitch of the concave portions in a peripheral direction of the developer carrier has the same magnitude of the number of vibrations at which the loss elastic modulus is smaller than the storage elastic modulus among the numbers of vibrations smaller than the number of vibrations of the contact member when a loss tangent obtained by dividing a loss elastic modulus of the contact member by a storage elastic modulus is the greatest. According to the image forming system, it is possible to properly use the contact member with the rubber-like characteristic at the time of rotation of the developer carrier and to suppress the increase in temperature of the contact member.

In order to accomplish the above-mentioned object, according to a fourth aspect of the invention, there is provided an image forming apparatus including: (A) an image carrier holding a latent image; (B) a developer carrier having concave portions regularly arranged on a surface thereof, being rotatable with a developer held thereon, and developing the latent image with the developer held thereon; (C) a contact member made of an elastic rubber material being in contact with the surface of the developer carrier and vibrating with the rotation of the developer carrier; and (CD) a controller starting the rotation of the developer carrier, then raising a rotation speed of the developer carrier to a first rotation speed at which a movement speed of the surface at the time of rotation of the developer carrier is greater than a product of a pitch of the concave portions in a peripheral direction of the developer carrier and the number of vibrations of the contact member when a loss tangent obtained by dividing a loss elastic modulus of the contact member by a storage elastic modulus is the greatest, lowering the rotation speed of the developer carrier to a second rotation speed at which the movement speed is smaller than the product after the rotation speed of the developer carrier becomes the first rotation speed, and allowing the developer carrier rotating at the second rotation speed to develop the latent image. According to the image forming apparatus, it is possible to properly prevent the deterioration in image quality.

The image forming apparatus may further include a developing bias application section applying a developing bias for developing the latent image to the developer carrier, and the controller may lower the rotation speed of the developer carrier from the first rotation speed to the second rotation speed via a third rotation speed at which the movement speed is equal to the product after the rotation speed of the developer carrier becomes the first rotation speed and starts the application of the developing bias from the developing bias application section after the rotation speed of the developer carrier becomes the third rotation speed.

In this case, the filming can be properly collected.

The controller may start the application of the developing bias from the developing bias application section after a time point in a time period, when a portion, on the surface of the developer carrier, in contact with the contact member when the rotation speed of the developer carrier becomes the third rotation speed moves to a position opposed to the image carrier with an additional rotation of the developer carrier, after the rotation speed of the developer carrier becomes the third rotation speed.

In this case, the filming can be more properly collected.

In order to accomplish the above-mentioned object, according to a fifth aspect of the invention, there is provided an image forming apparatus including: (A) an image carrier holding a latent image; (B) a developer carrier having concave portions regularly arranged on a surface thereof being rotatable with a developer held thereon, and developing the latent image with the developer held thereon; (C) a contact member made of an elastic rubber material being in contact with the surface of the developer carrier and vibrating with the rotation of the developer carrier; and (D) a controller allowing the developer carrier which rotates at a fifth rotation speed at which a movement speed of the surface at the time of rotation of the developer carrier is smaller than a product of a pitch of the concave portions in a peripheral direction of the developer carrier and the number of vibrations of the contact member when a loss tangent obtained by dividing a loss elastic modulus of the contact member by a storage elastic modulus is the greatest, to develop the latent image, raising the rotation speed of the developer carrier to a fourth rotation speed at which the movement speed is greater than the product after the developing of the latent image is ended, and stopping the rotation of the developer carrier after the rotation speed of the developer carrier becomes the fourth rotation speed.

According to the image forming apparatus, it is possible to properly prevent the deterioration in image quality.

The image forming apparatus may further include a developing bias application section applying a developing bias for developing the latent image to the developer carrier, and the controller may raise the rotation speed of the developer carrier from the fifth rotation speed to the fourth rotation speed via a third rotation speed at which the movement speed is equal to the product after ending the developing of the latent image, and may stop the application of the developing bias from the developing bias application section before a time point in a time period, when a portion, on the surface of the developer carrier, in contact with the contact member when the rotation speed of the developer carrier becomes the third rotation speed moves to a position opposed to the image carrier with an additional rotation of the developer carrier, after the rotation speed of the developer carrier becomes the third rotation speed.

In this case, the filming can be properly collected.

The controller may stop the application of the developing bias from the developing bias application section before the rotation speed of the developer carrier becomes the third rotation speed.

In this case, the filming can be more properly collected.

The image forming apparatus may further include a rake-out member coming in contact with the surface of the developer carrier to rake out the developer from the developer carrier. Here, the controller may stop the rotation after a time point in a time period, when a portion, on the surface of the developer carrier, in contact with the contact member when the rotation speed of the developer carrier becomes the third rotation speed moves to a position opposed to the image carrier with an additional rotation of the developer carrier, after the rotation speed of the developer carrier becomes the third rotation speed, at the time of stopping the rotation of the developer carrier after the rotation speed of the developer carrier becomes the fourth rotation speed.

In this case, the filming can be properly raked out by the rake-out member before the developer carrier is stopped.

Similarly, according to the fourth aspect of the invention, there is provided an image forming system including: a computer; and an image forming apparatus being connectable to the computer, wherein the image forming apparatus includes: an image carrier holding a latent image; a developer carrier having concave portions regularly arranged on a surface thereof, being rotatable with a developer held thereon, and developing the latent image with the developer held thereon; a contact member made of an elastic rubber material being in contact with the surface of the developer carrier and vibrating with the rotation of the developer carrier; and a controller starting the rotation of the developer carrier, then raising a rotation speed of the developer carrier to a first rotation speed at which a movement speed of the surface at the time of rotation of the developer carrier is greater than a product of a pitch of the concave portions in a peripheral direction of the developer carrier and the number of vibrations of the contact member when a loss tangent obtained by dividing a loss elastic modulus of the contact member by a storage elastic modulus is the greatest, lowering the rotation speed of the developer carrier to a second rotation speed at which the movement speed is smaller than the product after the rotation speed of the developer carrier becomes the first rotation speed, and allowing the developer carrier rotating at the second rotation speed to develop the latent image.

According to the image forming system, it is possible to properly prevent the deterioration in image quality.

Similarly, according to the fifth aspect of the invention, there is provided an image forming system including: a computer; and an image forming apparatus being connectable to the computer, wherein the image forming apparatus includes: an image carrier holding a latent image; a developer carrier having concave portions regularly arranged on a surface thereof, being rotatable with a developer held thereon, and developing the latent image with the developer held thereon; a contact member made of an elastic rubber material being in contact with the surface of the developer carrier and vibrating with the rotation of the developer carrier; and a controller allowing the developer carrier which rotates at a fifth rotation speed at which a movement speed of the surface at the time of rotation of the developer carrier is smaller than a product of a pitch of the concave portions in a peripheral direction of the developer carrier and the number of vibrations of the contact member when a loss tangent obtained by dividing a loss elastic modulus of the contact member by a storage elastic modulus is the greatest, to develop the latent image, raising the rotation speed of the developer carrier to a fourth rotation speed at which the movement speed is greater than the product after the developing of the latent image is ended, and stopping the rotation of the developer carrier after the rotation speed of the developer carrier becomes the fourth rotation speed.

According to the image forming system, it is possible to properly prevent the deterioration in image quality.

Similarly, according to the fourth aspect of the invention, there is provided an image forming method including: a step of raising a rotation speed of a developer carrier to a first rotation speed at which a movement speed of a surface of the developer carrier at the time of rotation of the developer carrier is greater than a product of a pitch of concave portions in a peripheral direction of the developer carrier and the number of vibrations of a contact member when a loss tangent obtained by dividing a loss elastic modulus of the contact member by a storage elastic modulus thereof is the greatest after starting the rotation of the developer carrier, the developer carrier having the concave portions regularly arranged on the surface, being rotatable with a developer held thereon, and developing the latent image with the developer held thereon, the contact member being made of an elastic rubber material being in contact with the surface of the developer carrier and vibrating with the rotation of the developer carrier; a step of lowering the rotation speed of the developer carrier to a second rotation speed at which the movement speed is smaller than the product after the rotation speed of the developer carrier becomes the first rotation speed; and a step of allowing the developer carrier rotating at the second rotation speed to develop the latent image.

According to the image forming system, it is possible to properly prevent the deterioration in image quality.

Similarly, according to the second aspect of the invention, there is provided an image forming method including: a step of allowing a developer carrier to develop a latent image, the developer carrier rotating at a fifth rotation speed at which a movement speed of a surface of the developer carrier at the time of rotation of the developer carrier is smaller than a product of a pitch of concave portions in a peripheral direction of the developer carrier and the number of vibrations of a contact member when a loss tangent obtained by dividing a loss elastic modulus of the contact member by a storage elastic modulus thereof is the greatest, the developer carrier having the concave portions regularly arranged on the surface, being rotatable with a developer held thereon, and developing the latent image with the developer held thereon, the contact member being made of an elastic rubber material being in contact with the surface of the developer carrier and vibrating with the rotation of the developer carrier; a step of raising the rotation speed of the developer carrier to a fourth rotation speed at which the movement speed is greater than the product after the rotation speed of the developer carrier becomes the first rotation speed after ending the developing of the latent image; and a step of stopping the rotation of the developer carrier after the rotation speed of the developer carrier becomes the fourth rotation speed.

According to the image forming system, it is possible to properly prevent the deterioration in image quality.

Other features of the invention will be apparently understood from the following description and the accompanying drawings.

BRIEF DESCRIPTION OF THE DRAWINGS

The above objects and advantages of the present invention will become more apparent by describing in detail exemplary embodiments thereof with reference to the accompanying drawings, wherein:

FIG. 22 is a table illustrating measurement results;

FIG. 24 is a table illustrating test results;

DETAILED DESCRIPTION OF THE EMBODIMENTS

Hereinafter, a developing apparatus, an image forming apparatus, an image forming system, and an image forming method according to embodiments of the invention will be described with reference to the accompanying drawings.

Entire Configuration of Image Forming Apparatus

Figure 1:
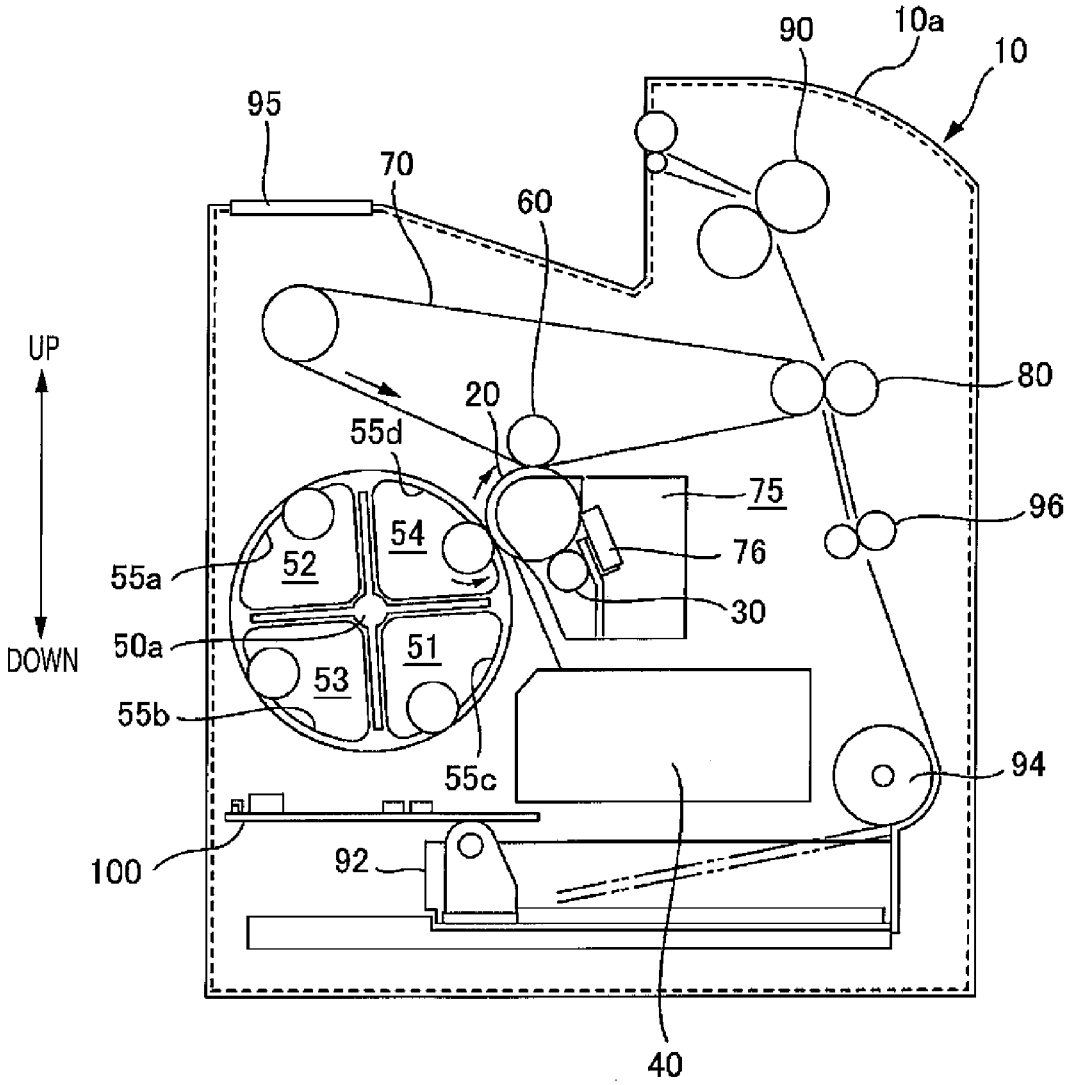
FIG. 1 is a diagram illustrating main elements of a printer 10.
Figure 2:
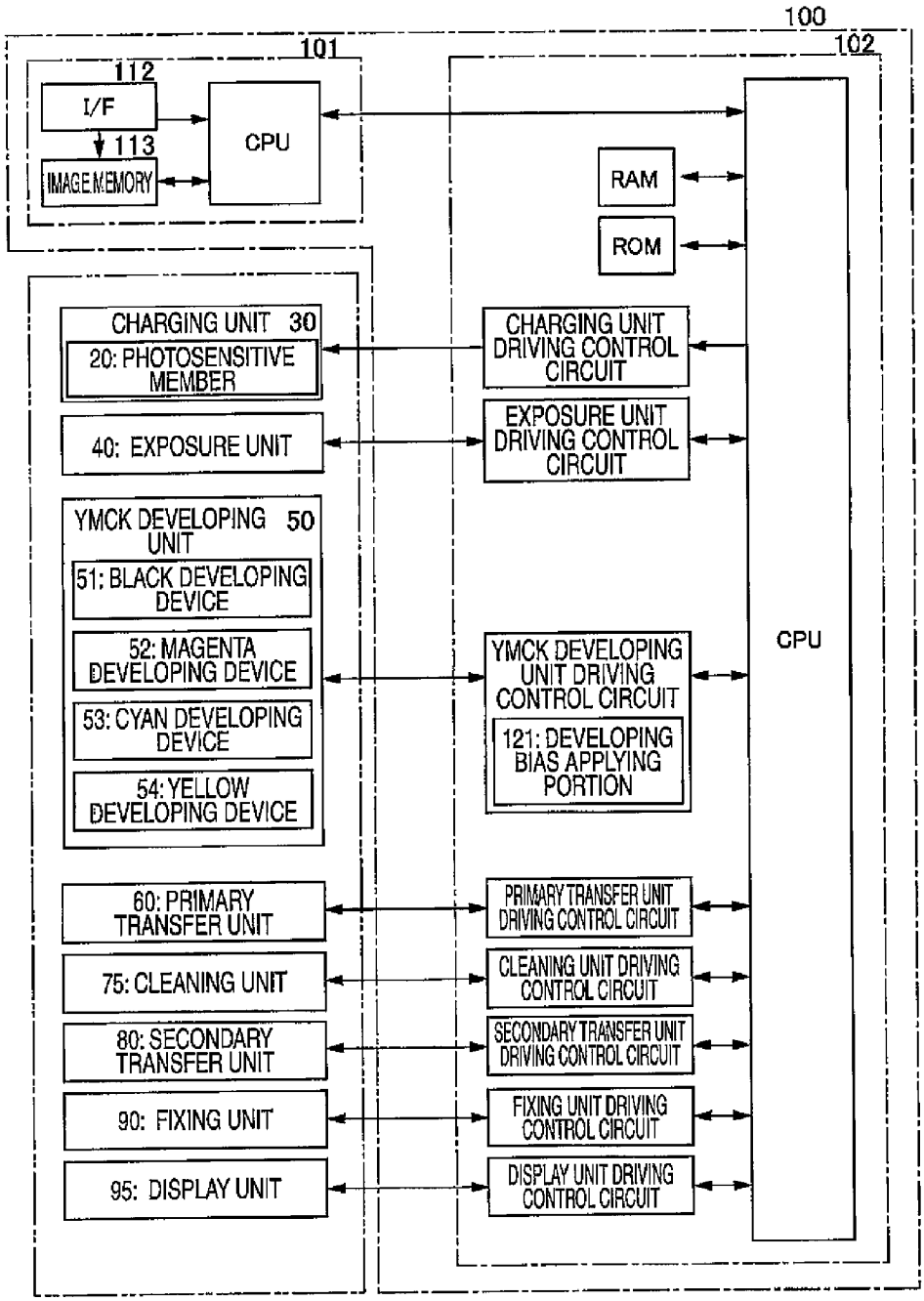
FIG. 2 is a block diagram illustrating a control unit of the printer 10 shown in FIG. 1.

A laser beam printer 10 (hereinafter, also referred to as a printer) as an image forming apparatus will be roughly described with reference to FIGS. 1 and 2. FIG. 1 is a diagram illustrating main elements of the printer 10. FIG. 2 is a block diagram illustrating a control unit of the printer 10 shown in FIG. 1. In FIG. 1, the vertical direction is indicated by an arrow. For example, a sheet feed tray 92 is disposed in a lower portion of the printer 10 and a fixing unit 90 is disposed in an upper portion of the printer 10.

Configuration of Printer 10

As shown in FIG. 1, the printer 10 according to this embodiment includes a charging unit 30, an exposure unit 40, a YMCK developing unit 50, a primary transfer unit 60, an intermediate transfer member 70, and a cleaning unit 75 in the rotation direction of a photosensitive member 20 as an example of an image carrier holding a latent image, and further includes a secondary transfer unit 80, a fixing unit 90, a display unit 95 serving as notification means for a user and including a liquid crystal panel, and a control unit 100 controlling the units to operate as a printer.

The photosensitive member 20 includes a cylindrical conductive base and a photosensitive layer formed on the periphery thereof, rotates about the center axis thereof. In this embodiment, the photosensitive member rotates clockwise as indicated by an arrow in FIG. 1.

The charging unit 30 serves to charge the photosensitive member 20. The Exposure unit 40 serves to form a latent image on the charged photosensitive member 20 by applying a laser beam thereto. The exposure unit 40 includes a semiconductor laser, a polygon mirror, and an F-θ lens and applies a modulated laser beam to the charge photosensitive member 20 on the basis of an image signal input from a host computer not shown such as a personal computer and a word processor.

The YMCK developing unit 50 serves to develop the latent image formed on the photosensitive member 20 by the use of a toner as an example of a developer contained in the developing apparatus, that is, a black (K) toner contained in a black developing apparatus 51, a magenta (M) toner contained in a magenta developing apparatus 52, a cyan (C) toner contained in a cyan developing apparatus 53, and a yellow (Y) toner contained in a yellow developing apparatus 54.

The YMCK developing unit 50 allows the positions of the four developing apparatus 51, 52, 53, and 54 to move by rotating with the four developing apparatus 51, 52, 53, and 54 mounted thereon. That is, the YMCK developing unit 50 holds the four developing apparatus 51, 52, 53, and 54 in four holding sections 55*a*, 55*b*, 55*c*, and 55*d*. The four developing apparatus 51, 52, 53, and 54 can rotate about the center axis 50*a* with the relative positions maintained. Every when the formation of an image corresponding to 1 page ends, the developing apparatus are selectively opposed to the photosensitive member 20 to sequentially develop the latent image formed on the photosensitive member 20 with the toner received in the four developing apparatus 51, 52, 53, and 54. The four developing apparatus 51, 52, 53, and 54 each can be attached to and detached from a printer body 10*a* (specifically, the holding sections of the YMCK developing unit 50) as an example of an image forming apparatus body. Details of the developing apparatus are described later.

The primary transfer unit 60 serves to transfer a monochromatic toner images formed on the photosensitive member 20 to the intermediate transfer member 70. When four color toners are sequentially transferred in an overlapping manner, a full color toner image is formed on the intermediate transfer member 70. The intermediate transfer member 70 is an endless belt in which a tin deposited layer is formed on the surface of a PET film and semi-conductive paint is formed and stacked on the surface thereof, and rotates substantially at the same peripheral speed as the photosensitive member 20. The secondary transfer unit 80 serves to transfer the monochromatic toner image or the full color toner image formed on the intermediate transfer member 70 to a medium such as paper, film, and cloth. The fixing unit 90 serves to fix the monochromatic toner image or the full color toner image transferred to the medium to form a permanent image.

The cleaning unit 75 is disposed between the primary transfer unit 60 and the charging unit 30, includes a rubber cleaning blade 76 in contact with the surface of the photosensitive member 20, and serves to rake out and remove the toner remaining on the photosensitive member 20 by the use of the cleaning blade 76 after the toner image is transferred to the intermediate transfer member 70 by the primary transfer unit 60.

As shown in FIG. 2, the control unit 100 includes a main controller 101 and a unit controller 102. The main controller 101 includes an image memory 113 that is electrically connected to the host computer through an interface 112 and that stores the image signal input from the host computer. The unit controller 102 is electrically connected to the units and controls the units to form an image on the basis of signals input from the main controller 101 while detecting the states of the units, by receiving signals from sensors thereof.

<Operation of Printer 10>

An operation of the printer 10 having the above-mentioned configuration is described now.

First, when an image signal and a control signal from the host computer not shown are input to the main controller 101 of the printer 10 through the interface (I/F) 112, the photosensitive member 20 and the intermediate transfer member 70 rotate under the control of the unit controller 102 based on an instruction from the main controller 101.

The photosensitive member 20 is sequentially charged at a charging position by the charging unit 30 while rotating. The charged region of the photosensitive member 20 reaches an exposure position with the rotation of the photosensitive member 20 and a latent image based on image information of a first color, for example, yellow Y, is formed in the region by the exposure unit 40. In the YMCK developing unit 50, the yellow developing apparatus 54 containing the yellow (Y) toner is located at a developing position facing the photosensitive member 20. The latent image formed on the photosensitive member 20 reaches the developing position with the rotation of the photosensitive member 20 and is developed with the yellow toner by the yellow developing apparatus 54. Accordingly, a yellow toner image is formed on the photosensitive member 20. The yellow toner image formed on the photosensitive member 20 reaches a primary transfer position with the rotation of the photosensitive member 20 and is transferred to the intermediate transfer member 70 by the primary transfer unit 60. At this time, a primary transfer voltage having a polarity opposite to the charged polarity of the toner T (negative polarity in this embodiment) is applied to the primary transfer unit 60. In the meantime, the photosensitive member 20 is in contact with the intermediate transfer member 70 and the secondary transfer unit 80 is separated from the intermediate transfer member 70.

By repeatedly performing the above-mentioned process on the developing apparatus of the second color, the third color, and the fourth color, four color toner images corresponding to the image signals are transferred to the intermediate transfer member 70 in an overlapping manner. Accordingly, a full color toner image is formed on the intermediate transfer member 70.

The full color toner image formed on the intermediate transfer member 70 reaches a secondary transfer position with the rotation of the intermediate transfer member 70 and is transferred to a medium by the secondary transfer unit 80. The medium is transported from the sheet feed tray 92 to the secondary transfer unit 80 through a feed roller 94 and a register roller 96. At the time of performing the transfer operation, the secondary transfer unit 80 is pressed against the intermediate transfer member 70 and is supplied with a secondary transfer voltage.

The full color toner image transferred to the medium is heated and pressurized by the fixing unit 90 and is fixed to the medium. On the other hand, after the photosensitive member 20 passes through the primary transfer position, the toner T attached to the surface thereof is raked out by the cleaning blade 76 supported by the cleaning unit 75 and the charging operation for forming a next latent image is prepared. The raked-out toner T is collected in a remaining toner recovering section of the cleaning unit 75.

Control Unit

A configuration of the control unit 100 is described now with reference to FIG. 2. The main controller 101 of the control unit 100 includes an image memory 113 that is electrically connected to the host computer through the interface 112 and that stores the image signals input from the host computer. The unit controller 102 is electrically connected to the units (the charging unit 30, the exposure unit 40, the YMCK developing unit 50, the primary transfer unit 60, the cleaning unit 75, the secondary transfer unit 80, the fixing unit 90, and the display unit 95) of the apparatus body and controls the units on the basis of the signals input from the main controller 101 while detecting the states of the units, by receiving the signals from sensors of the units.

Developing Apparatus

Figure 3:
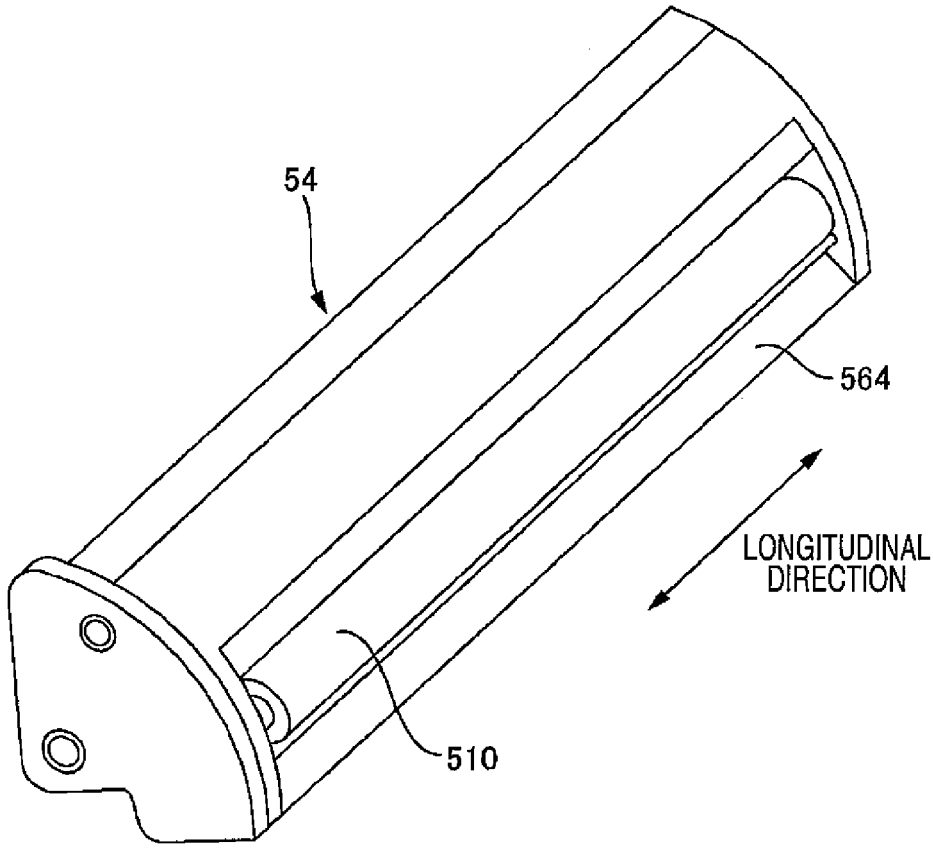
FIG. 3 is a conceptual diagram of a developing apparatus.
Figure 4:
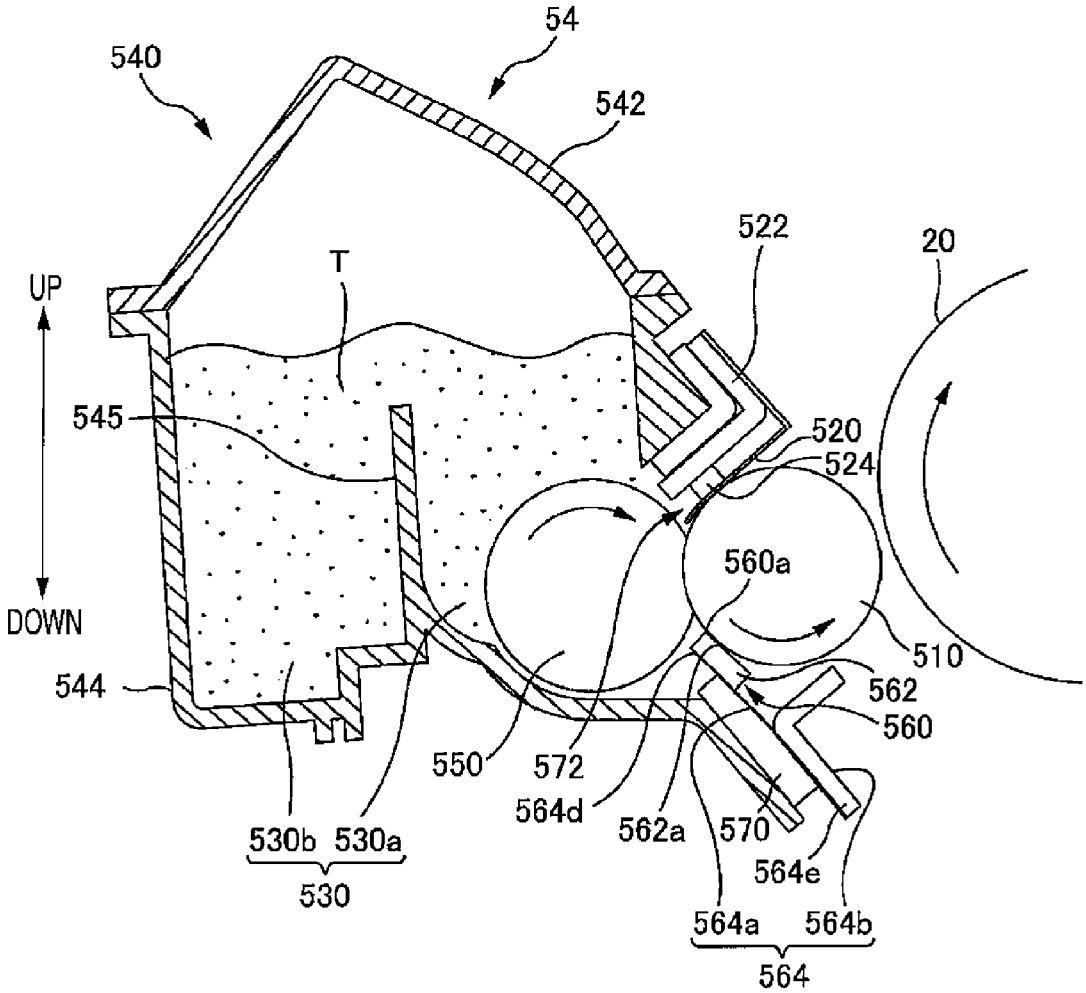
FIG. 4 is a sectional view illustrating main elements of the developing apparatus.
Figure 5:
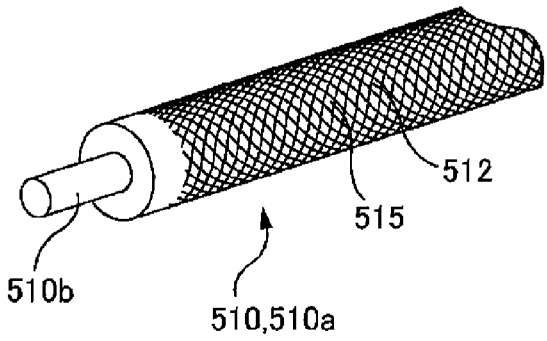
FIG. 5 is a perspective view schematically illustrating a developing roller 510.
Figure 6:
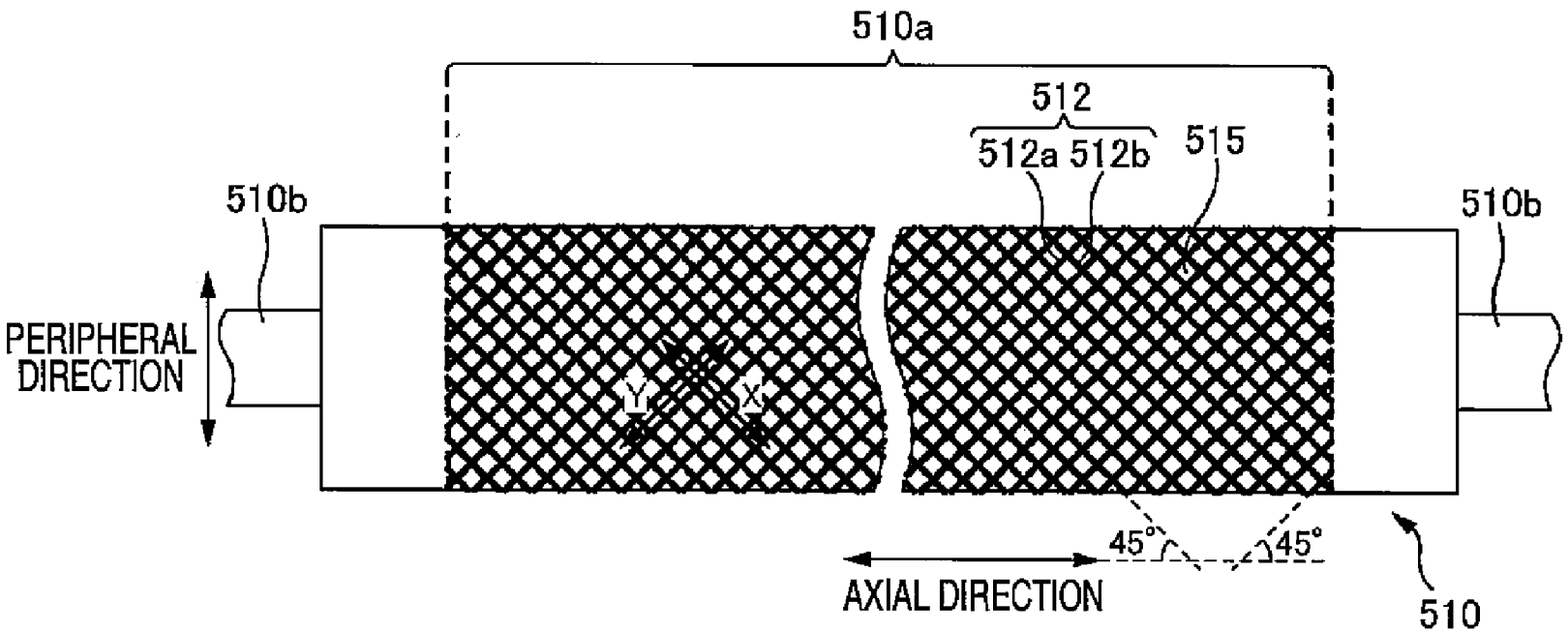
FIG. 6 is a front view schematically illustrating the developing roller 510.
Figure 7:
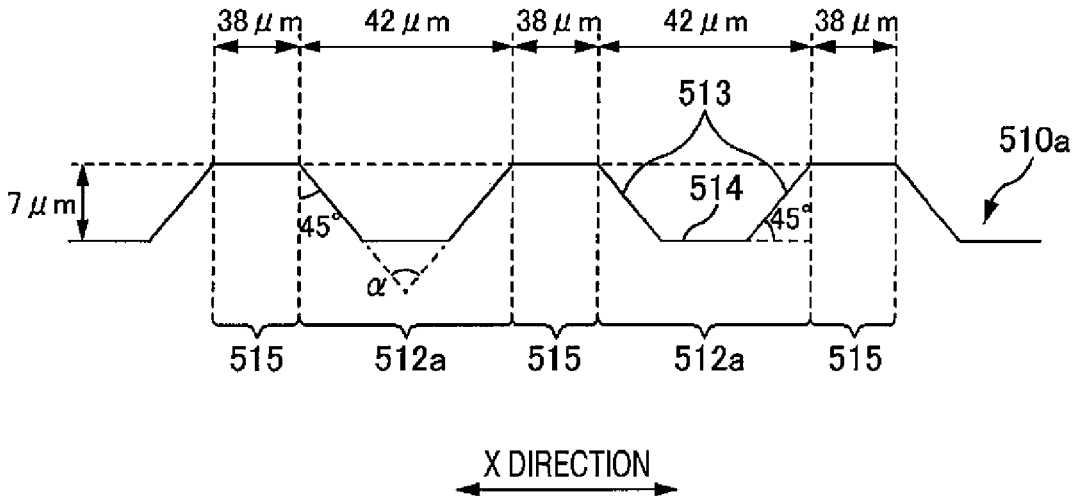
FIG. 7 is a diagram schematically illustrating a sectional shape of grooves 512.
Figure 7:
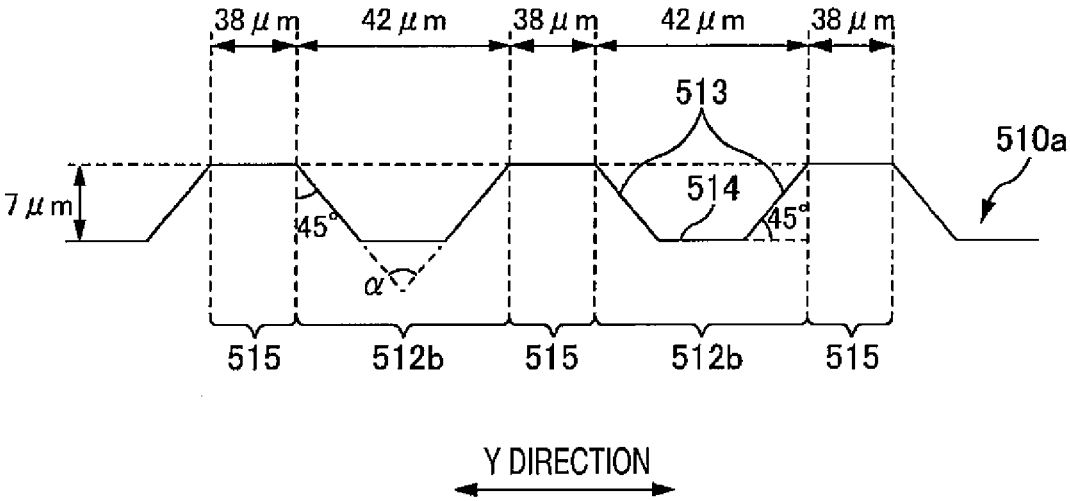
Figure 8:
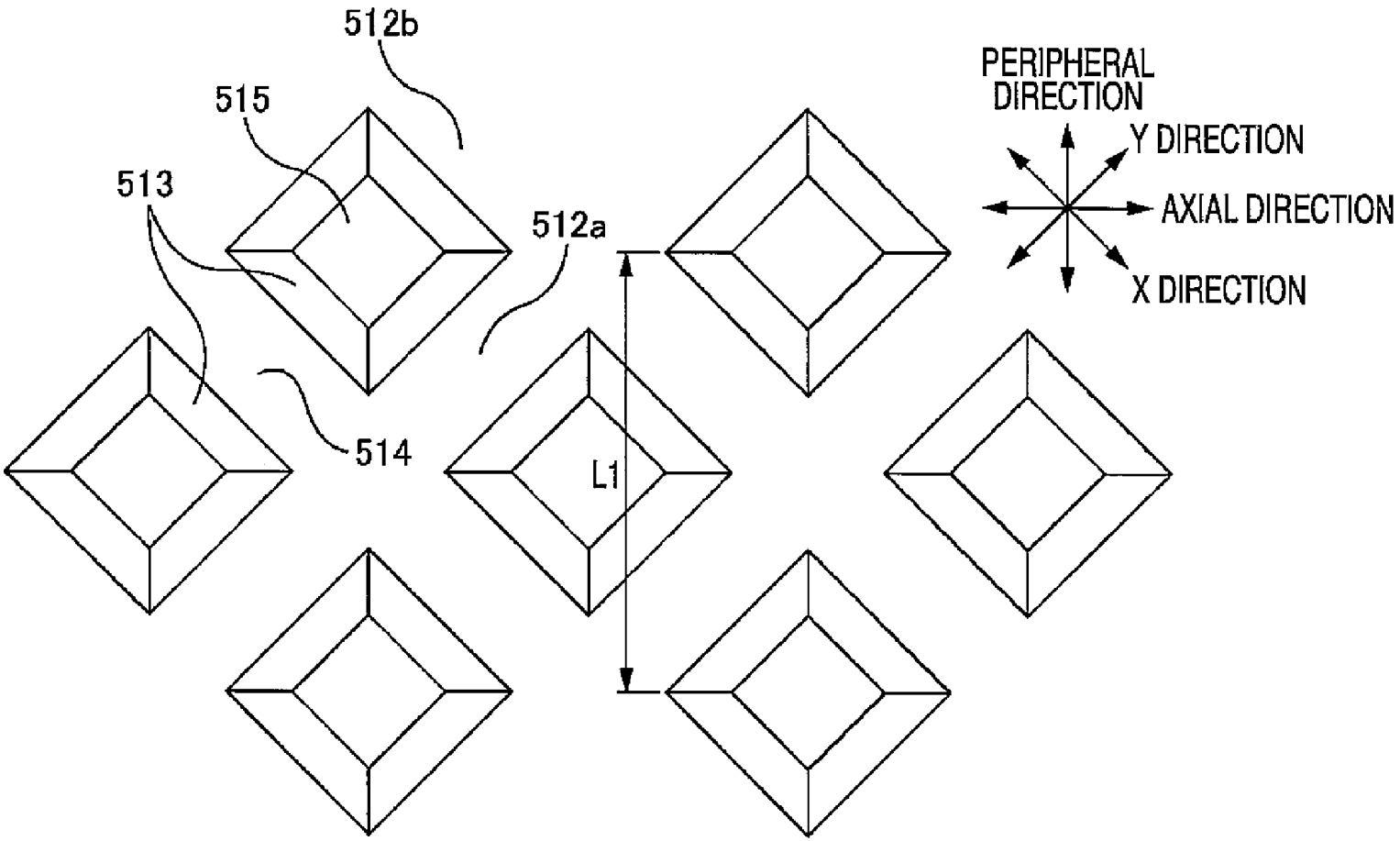
FIG. 8 is an enlarged schematic view of FIG. 6.

A configuration and an operation of the developing apparatus are described now with reference to FIGS. 3 to 8. FIG. 3 is a conceptual diagram of the developing apparatus. FIG. 4 is a sectional view illustrating main elements of the developing apparatus. FIG. 5 is a schematic perspective view of a developing roller 510. FIG. 6 is a schematic front view of the developing roller 510. FIG. 7 is a schematic diagram illustrating a sectional shape of grooves 512. FIG. 8 is a schematic enlarged diagram of FIG. 6, where the grooves 512 and top faces 515 are shown. The sectional view shown in FIG. 4 illustrates a section obtained by cutting the developing apparatus in a plane perpendicular to the longitudinal direction shown in FIG. 3. In FIG. 4, similarly to FIG. 1, the vertical direction is indicated by an arrow and the center axis 510*b* of the developing roller 510 is located below the center axis of the photosensitive member 20. In FIG. 4, the yellow developing apparatus 54 is located at the developing position opposed to the photosensitive member 20. In FIGS. 5 to 8, the scales of the grooves 512 are different from real ones for the purpose of easy understanding of the drawing.

The YMCK developing unit 50 includes the black developing apparatus 51 containing the black (K) toner, the magenta developing apparatus 52 containing the magenta (M) toner, the cyan developing apparatus 53 containing the cyan (C) toner, and the yellow developing apparatus 54 containing the yellow (Y) toner. Configurations of the developing apparatus are equal to each other and thus the yellow developing apparatus 54 is representatively described now.

<Configuration of Developing Apparatus>

The yellow developing apparatus 54 includes a developing roller 510 as an example of the developer carrier, an upper seal 520, a toner container 530, a housing 540, a toner supply roller 550 as an example of the removing member, and a regulating blade 560 as an example of the contact member.

The developing roller 510 transports the toner T to the opposed position (developing position) opposed to the photosensitive member 20 by rotating with the toner T held therein. The latent image held by the photosensitive member 20 is developed with the toner T (the toner T held by the developing roller 510). The developing roller 510 is made of aluminum ally or steel alloy.

As shown in FIGS. 5 and 6, the developing roller 510 includes grooves 512 as an example of the concave portions on the surface of a central portion 510*a* so as to properly hold the toner T. In this embodiment, two kinds of spiral grooves 512 different from each other in the winding direction, that is, first grooves 512*a* and second grooves 512*b*, are disposed as the grooves 512. As shown in FIG. 6, the tilt angles of the first grooves 512*a* and the second grooves 512*b* about the peripheral direction of the developing roller 510 are different from each other and the magnitude of an acute angle formed by the longitudinal direction of the first grooves 512*a* and the axial direction of the developing roller 510 and the magnitude of an acute angle formed by the longitudinal direction of the second grooves 512*b* and the axial direction are both about 45 degrees. As shown in FIG. 7, the width of the first grooves 512*a* in the X direction and the width of the second grooves 512*b* in the Y direction are about 42 μm, the depth of the grooves 512 is about 7 μm, and the groove angle (an angle indicated by reference sign a in FIG. 7) is about 90 degrees.

Each groove 512 includes a bottom surface 514 and a side surface 513 and the slope angle of the side surface 513 is about 45 degree (see FIG. 7).

As shown in FIGS. 5, 6, and 8, two types of spiral grooves 512 having the above-mentioned configuration are regularly arranged on the surface of the central portion 510*a* of the developing roller 510 and intersect each other to form a lattice shape. Plural top faces 515 having a diamond shape (square shape) surrounded with the grooves 512 are formed in a mesh shape in the central portion 510*a*.

As described above, in this embodiment, since the magnitude of the acute angle formed by the longitudinal direction of the first grooves 512*a* and the axial direction of the developing roller 510 and the magnitude of the acute angle formed by the longitudinal direction of the second grooves 512*b* and the axial direction are both about 45 degrees, the top face 515 has a square plane shape and one (the other) of two diagonals of the top face 515 is parallel to the peripheral direction (axial direction) of the developing roller 510. The length of one side of the square top face 515 is about 38 μm as shown in FIG. 7. The pitch (width LT in FIG. 8) of the grooves 512 in the peripheral direction is about 113 μm.

The developing roller 510 is rotatable about the center axis and as shown in FIG. 4, rotates in the opposite direction an the counterclockwise direction in FIG. 4) of the rotation direction (clockwise direction in FIG. 4) of the photosensitive member 20. In this embodiment, the movement speed V (that is, the linear speed of the developing roller 510 on the surface of the developing roller 510) of the surface of the developing roller 510 when the developing roller 510 rotates at the time of developing the latent image is about 320 mm/s. The movement speed V (that is, the linear speed of the photosensitive member 20 on the surface of the photosensitive member 20) of the surface of the photosensitive member 20 when the photosensitive member 20 rotates at the time of developing the latent image is about 200 mm/s. The peripheral speed ratio of the developing roller 510 to the photosensitive member 20 is about 1.6.

In the state where the yellow developing apparatus 54 is opposed to the photosensitive member 20, a gap is disposed between the developing roller 510 and the photosensitive member 20. That is, the yellow developing apparatus 54 develops the latent image formed on the photosensitive member 20 in a non-contact manner. In the printer 10 according to this embodiment, a jumping developing method is employed and an alternating electric field is formed between the developing roller 510 and the photosensitive member 20 at the time of developing the latent image formed on the photosensitive member 20. The printer 10 includes a developing bias applying portion 121 (FIG. 2) for applying a developing bias (a developing voltage in which a DC voltage overlaps with an AC voltage in this embodiment) to the developing roller 510 to develop the latent image. By applying the developing bias to the developing roller 510, the alternating electric field is formed in the gap. The toner T on the developing roller 510 moves to the photosensitive member 20 by means of the alternating electric field and thus the latent image on the photosensitive member 20 is developed.

The housing 540 is formed by welding plural resin housing portions incorporated in a body, that is, an upper housing portion 542 and a lower housing portion 544, and a toner container 530 containing the toner T is formed therein. The toner container 530 is divided into two toner containing portions, that is, a first toner containing portion 530*a* and a second toner containing portion 530*b*, by a partition wall 545 protruding inward (in the vertical direction in FIG. 4) from an inner wall to partition the toner T. As shown in FIG. 4, the housing 540 (that is, the first toner containing portion 530*a*) has an opening 572 in a lower side thereof and the developing roller 510 is disposed to face the opening 572.

A toner supply roller 550 is disposed in the'first toner containing portion 530*a*, and serves to supply the toner T contained in the first toner containing portion 530*a* to the developing roller 510 and to rake out the toner T remaining in the developing roller 510 from the developing roller 510 after the developing. The toner supply roller 550 is made of polyurethane foam or the like and is in contact with the developing roller in an elastically deformed state (in contact with the surface of the developing roller 510). The toner supply roller 550 is disposed below the first toner containing portion 530*a* and the toner T contained in the first toner containing portion 530*a* is supplied to the developing roller 510 on the lower side of the first toner containing portion 530*a* by the toner supply roller 550. The toner supply roller 550 is rotatable about the center axis thereof and the center axis is disposed below the rotation center axis 510*b* of the developing roller 510. The toner supply roller 550 rotates in the opposite direction (clockwise direction in FIG. 4) of the rotation direction (counterclockwise direction in FIG. 4) of the developing roller 510.

The upper seal 520 comes in contact with the developing roller 510 in the axial direction thereof so as to allow the movement of the toner T remaining on the developing roller 510 after passing through the developing position into the housing 540 and to regulate the movement of the toner T in the housing 540 from the housing 540. The upper seal 520 is a seal made of a polyethylene film or the like. The upper seal 520 is supported by an upper seal supporting metal plate 522. An upper seal urging member 524 made of an elastic body such as MOLTOPREN (Registered Trademark) is disposed in a compressed state on the other side of the developing roller 510 about the upper seal 520. The upper seal urging member 524 pressed the upper seal 520 on the developing roller 510 by urging the upper seal 520 to the developing roller 510 with the urging force thereof. The contact position where the upper seal 520 comes in contact with the developing roller 510 is higher than the center axis 510*b* of the developing roller 510.

The regulating blade 560 comes in contact with the surface of the developing roller 510 from one end in the axial direction of the developing roller 510 to the other end to regulate the layer thickness of the toner T held on the developing roller 510 and to give charges to the toner T held on the developing roller 510. The regulating blade 560 includes a rubber portion 562 as an example of the contact member and a rubber supporting portion 564 as shown in FIG. 4.

The rubber portion 562 is a layer thickness regulating member coming in contact with the surface of the developing member 510 to regulate the layer thickness of the toner T held on the developing roller 510. The rubber portion 562 is disposed so that the longitudinal direction thereof is parallel to the axial direction (FIG. 6) of the developing roller 510 and one end in the width direction thereof (an end 560*a* of the regulating blade 560) faces the upstream side in the rotation direction of the developing roller 510 (see FIG. 4). That is, the rubber portion 562 comes in counter contact with the developing roller. The end (the end 560*a* of the regulating blade 560) of the rubber portion 562 is not in contact with the developing roller 510, and the contact portion 562*a* of the rubber portion 562 coming in contact with the surface of the developing roller 510 is apart from the end 560*a* in the width direction. That is, the rubber portion 562 is not in contact with the developing roller 510 at the edge, but is in contact with the developing roller at the center. By allowing the plane of the rubber portion 562 to come in contact with the developing roller 510, the layer thickness is regulated. The contact position where the rubber portion 562 comes in contact with the developing roller 510 is below the center axis 510*b* of the developing roller 510 and below the center axis of the toner supply roller 550. The rubber portion 562 performs a function of preventing the toner T from leaking from the toner container 530 by coming in contact with the developing roller 510 in the axis direction.

The rubber portion 562 is made of an elastic rubber material. Here, the elastic rubber material is defined as an elastic material having rubber elasticity. The elastic rubber material is classified in a rubber and a thermoplastic elastomer, where the rubber is an elastic material (that is, an elastic material exhibiting a thermosetting characteristic) hardened from a fluidized state by heating and the thermoplastic elastomer is an elastic material (that is, an elastic material exhibiting a thermoplastic characteristic) fluidized from a solidified state by heating. An example used for the rubber portion 562 is urethane rubber. The rubber portion 562 in this embodiment is made of the thermoplastic elastomer in view of easy processing due to the thermoplastic characteristic.

The rubber supporting portion 564 includes a thin plate 564*a* and a thin plate supporting portion 564*b* and supports the rubber portion 562 by the use of an end 564*d* (that is, an end close to the thin plate 564*a*) in the width direction thereof. The thin plate 564*a* is made of phosphor bronze or stainless and has elasticity. The thin plate 564*a* supports the rubber portion 562 and pressed the rubber portion 562 to the developing roller 510 with the urging force thereof. The thin plate supporting portion 564*b* is a metal plate disposed at the other end 564*e* in the width direction of the rubber supporting portion 564. The thin plate supporting portion 564*b* is attached to the housing 540 while supporting an end of the thin plate 564*a* opposite to the side supporting the rubber portion 562. A blade back member 570 made of MOLTOPREN (Registered Trademark) is disposed on the opposite side of the developing roller 510 about the thin plate supporting portion 564*b*.

<Operation of Developing Apparatus>

In the yellow developing apparatus 54 having the above-mentioned configuration, the toner supply roller 550 supplies the toner T contained in the toner container 530 to the developing roller 510. The toner T supplied to the developing roller 510 reaches the contact position of the regulating blade 560 with the rotation of the developing roller 510, the layer thickness is regulated and the toner is provided with negative charges (negatively charged) at the time of passing through the contact position. The toner T on the developing roller 510 having been regulated in layer thickness and supplied with the negative charges is trans ported to the opposed position (developing position) opposed to the photosensitive member 20 with the addition rotation of the developing roller 510 and is provided to the development of the latent image formed on the photosensitive member 20 at the opposed position. The toner T on the developing roller 510 passing through the developing position with the rotation of the developing roller 510 passes through the upper seal 520 and is collected in the developing apparatus without being raked out by the upper seal 520. The toner T remaining on the developing roller 510 can be raked out by the toner supply roller 550.

Relation Between Physical Properties of Rubber Portion 562 and Temperature

The storage elastic modulus and the loss elastic modulus are known as indicating dynamic viscoelasticity of a material of the rubber portion 562 made of an elastic rubber material. The storage elastic modulus indicates an elastic behavior of a material and the loss elastic modulus indicates a viscous behavior of the material. The magnitudes of the storage elastic modulus and the loss elastic modulus vary depending on the temperature of the material. The material exhibits the rubber-like characteristic (physical property) or the glass-like characteristic depending on the variation in magnitude of the storage elastic modulus (loss elastic modulus). Specifically, when the storage elastic modulus or the loss elastic modulus is great, the material exhibits the glass-like characteristic. When the storage elastic modulus or the loss elastic modulus is small, the material exhibits the rubber-like characteristic.

Figure 9:
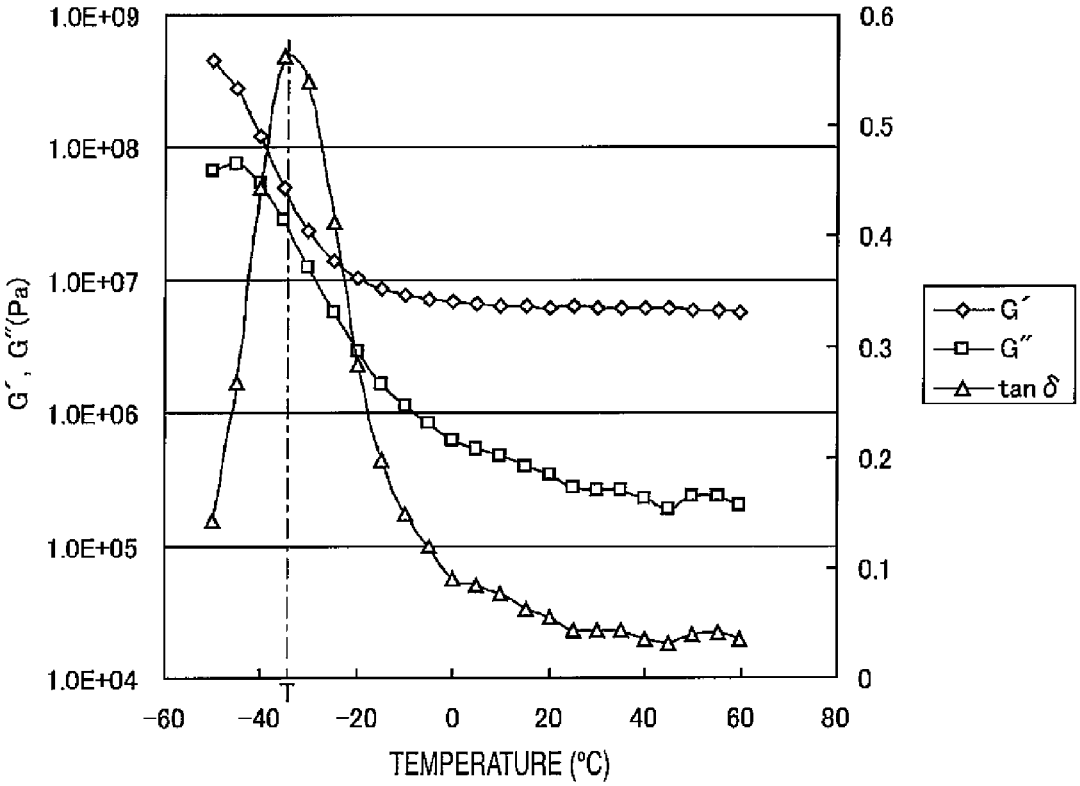
FIG. 9 is a graph illustrating a storage elastic modulus and the like relative to a temperature of a rubber portion 562.

Details thereof are described with reference to FIG. 9. FIG. 9 is a graph illustrating a relation of the storage elastic modulus relative to the temperature of the rubber portion 562. FIG. 9 shows the storage elastic modulus (G' in FIG. 9) and the loss elastic modulus (G" in FIG. 9) of the rubber portion 562 according to this embodiment. As shown in the graph, the magnitudes of the storage elastic modulus and the loss elastic modulus exhibit a great value when the temperature of the rubber portion 562 is low, and exhibit a small value when the temperature of the rubber portion 562 is high. As described above, when the storage elastic modulus (loss elastic modulus) is great, the glass-like characteristic is exhibited. Accordingly, when the temperature of the rubber portion 562 is low C (or example, −40° C.), the rubber portion 562 exhibits the glass-like characteristic. On the other hand, when the storage elastic modulus (loss elastic modulus) is small, the rubber-like characteristic is exhibited. Accordingly, when the temperature of the rubber portion 562 is high (for example, 40° C.), the rubber portion 562 exhibits the rubber-like characteristic.

The loss tangent (tan δ in FIG. 9) obtained by dividing the loss elastic modulus G" by the storage elastic modulus G' is shown in FIG. 9. The characteristic of the rubber portion 562 is changed at the peak temperature T (in the vicinity of −35° C. in FIG. 9) as the boundary at which the loss tangent is the greatest. That is, the rubber portion 562 exhibits the glass-like characteristic at a temperature lower than the peak temperature T. The rubber portion 562 exhibits the rubber-like characteristic at a temperature higher than the peak temperature T. The peak temperature T is also called a glass transition temperature.

The graph shown in FIG. 9 can be obtained by the following measurement. ARES made by TA instruments is used as a measurer for the measurement and a torsion type jig is used as a jig for the measurement. A temperature dependence measuring mode is selected as a measuring mode and the temperature range for the measurement is −50° C. to 60° C. (FIG. 9). The temperature rising rate from −50° C. to 60° C. is 5° C./min. The storage elastic modulus G', the loss elastic modulus G", and the loss tangent (tan δ) of the rubber portion 562 are obtained by the measurement under the measuring condition.

In the printer 10 according to this embodiment, the operating temperature range is set and specifically, the operating temperature range is 10° C. to 35° C. The temperatures of the rubber portion 562 of the developing apparatus 51, 52, 53, and 54 mounted on the printer body 10*a* are slightly (by about 10° C.) higher than the operating temperature range. Accordingly, the rubber portion 562 is used at a temperature higher than the peak temperature T (about −35° C.), the rubber-like characteristic is exhibited in relation to the temperature.

As can be seen from the fact that the rubber portion 562 exhibits rubber-like characteristic in relation to the temperature, it is required that the rubber portion 562 is used with the rubber-like characteristic when the rubber portion 562 is usually used.

Relation between Physical Characteristic of Rubber Portion 562 and Number of Vibrations (Frequency)

As described above, since the rubber portion 562 is in contact with the surface of the developing roller 510, the developing roller 510 frictionally slides on the rubber portion 562 at the time of rotation thereof. Accordingly, the rubber portion 562 vibrates with the rotation of the developing roller 510. Particularly, since the grooves 512 are formed on the surface of the developing roller 510, the rubber portion 562 easily vibrates with the rotation of the developing roller 510. It is known that the characteristic of the rubber portion 562 is changed depending on the magnitude of the number of vibrations of the rubber portion 562. That is, it is known that the rubber portion 562 exhibits the rubber-like characteristic or the glass-like characteristic depending on the magnitude of the number of vibrations. This point is described now.

Figure 10:
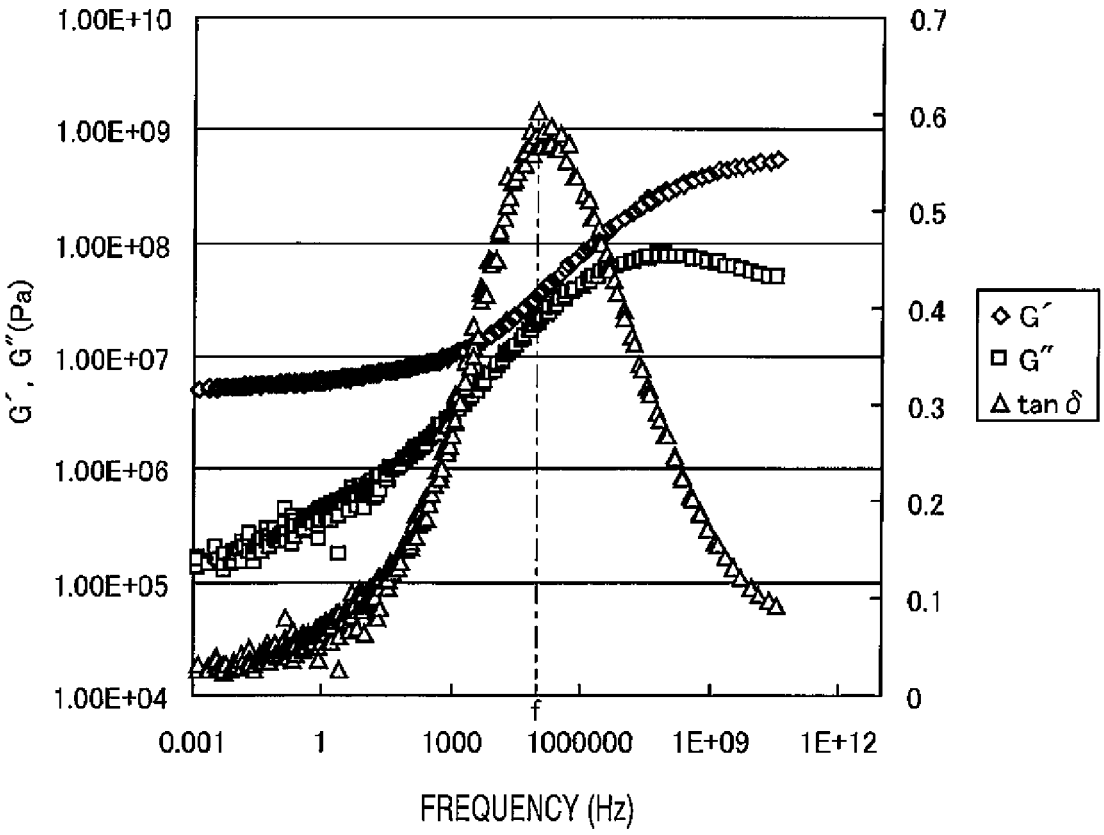
FIG. 10 is a graph illustrating the storage elastic modulus relative to a frequency of the rubber portion 562.

FIG. 10 is a graph illustrating the storage elastic modulus relative to the number of vibrations (frequency) of the rubber portion 562. Hereinafter, for the purpose of convenience, the number of vibrations is used instead of the number of vibrations. The scales of the horizontal axis in the graph shown in FIG. 10 are marked by logarithm (the same is true in FIGS. 11 and 12). The storage elastic modulus (G' in FIG. 10) and the loss elastic modulus (G" in FIG. 10) of the rubber portion 562 are shown in FIG. 10, similarly to FIG. 9. As shown in the graph, the magnitudes of the storage elastic modulus and the loss elastic modulus are small when the frequency of the rubber portion 562 is small and are great when the frequency of the rubber portion 562 is great. Accordingly, the rubber portion 562 exhibits the rubber-like characteristic at a small frequency of the rubber portion 562 and the rubber portion 562 exhibits the glass-like characteristic at a great frequency of the rubber portion 562.

The loss tangent (tan δ in FIG. 10) obtained by dividing the loss elastic modulus G" by the storage elastic modulus G' is shown in FIG. 10, similarly to FIG. 9. The characteristic of the rubber portion 562 is changed at the peak frequency f (about 100000 Hz in FIG. 10) as the boundary at which the loss tangent is the greatest. That is, the rubber portion 562 exhibits the glass-like characteristic at a frequency f higher than the peak frequency f. The rubber portion 562 exhibits the rubber-like characteristic at a frequency lower than the peak frequency.

Accordingly, in order to satisfy the above-mentioned requirement, that is, the requirement for using the rubber portion 562 vibrating with the rotation of the developing roller 510 with the rubber-like characteristic, it is necessary to allow the number of vibrations (frequency) of the rubber portion 562 to be lower than the peaks frequency f.

The graph shown in FIG. 10 can be obtained by the same measurement as the graph shown in FIG. 9. That is, the ARES is used as the measurer and the frequency dependence measuring mode is selected as the measuring mode. The range of frequency applied to the rubber portion 562 as the measurement target is 10-4 to 1014 (FIG. 10) and the application strain of the frequency is 0.1% (constant). The temperature of the rubber portion 562 at the time of measurement is kept at 20° C. The graphs shown in FIGS. 11 and 12 can be obtained by the same measurement.

<Effectiveness of Developing Apparatus 51, 52, 53, and 54 According to this Embodiment>

In the developing apparatus 51, 52, 53, and 54 according to this embodiment, the value obtained by dividing the movement speed of the surface of the developing roller 510 at the time of rotation of the developing roller 510 by the pitch of the grooves 512 in the peripheral direction of the developing roller 510 is smaller than the number of vibrations of the rubber portion 562 when the loss tangent of the rubber portion 562 obtained by dividing the loss elastic modulus by the storage elastic modulus is the greatest (V/L1<f). Accordingly, the rubber portion 562 vibrating with the rotation of the developing roller 510 can be properly used with the rubber-like characteristic.

The details are described in detail with reference to FIG. 8, etc. As described above, two types of spiral grooves 512 having different tilt angles about the peripheral direction are formed on the surface of the developing roller 510 according to this embodiment and the two types of spiral grooves 512 intersect each other to form a lattice shape. The developing roller 510 has square-shaped top faces 515 surrounded with the two types of spiral grooves 512 and one of two diagonals of each square-shaped top face is parallel to the peripheral direction (FIG. 8). In the developing roller 510, the pitch (width L1 in FIG. 8) of the grooves 512 in the peripheral direction is about 113 μm.

As described above, the movement speed V of the surface of the developing roller 510 at the time of rotation of the developing roller 510 is 320 mm/s. Accordingly, the value V/L1 obtained by dividing the movement speed of the surface of the developing roller 510 at the time of rotation of the developing roller 510 by the pitch of the grooves 512 in the peripheral direction of the developing roller 510 is about 2831

Hz. As shown in FIG. 10, since the peak frequency f of the rubber portion 562 when the loss tangent (tan δ) of the rubber portion 562 obtained by dividing the loss elastic modulus by the storage elastic modulus is the greatest is about 100000 Hz in the example shown in FIG. 10, the relation of V/L1<f is satisfied in this embodiment.

When the relation of V/L1<f is satisfied, why the rubber portion 562 can be used with the rubber-like characteristic at the time of rotation of the developing roller 510 is described now. As described above, the rubber portion 562 is in contact with the surface of the developing roller 510 and the grooves 512 regularly arranged are formed on the surface. Accordingly, the grooves 512 frictionally slide on the rubber portion 562, whereby the rubber portion 562 vibrates at a constant number of vibrations. The magnitude of the number of vibrations of the rubber portion 562 is determined depending on the pitch L1 of the grooves 512 in the peripheral direction and the movement speed V of the surface of the developing roller 510. That is, the number of vibrations of the rubber portion 562 at the time of rotation of the developing roller 510 is V/L1. Accordingly, when V/L1 is smaller than the peak frequency f of the rubber portion 562 (V/L1<f, the rubber portion 562 is used with the rubber-like characteristic.

Accordingly, in the developing apparatus 51, 52, 53, and 54 according to this embodiment, since the relation of V/L1<f is satisfied, the number of vibrations of the rubber portion 562 vibrating with the rotation of the developing roller 510 is smaller than the peak frequency f (about 100000 Hz) of the rubber portion 562. Accordingly, the rubber portion 562 is used with the rubber-like characteristic at the time of rotation of the developing roller 510. As a result, the rubber portion 562 can properly perform the function of regulating the layer thickness of the toner held on the developing roller 510.

<Relation Between Peak Frequency f and Temperature of Rubber Portion 562>

As described above, the operating temperature range (that is, 10° C. to 35° C.) and the temperature of the rubber portion 562 varies depending on the operating temperature of the printer 10. The peak frequency f of the rubber portion 562 when the loss tangent (tan δ) of the rubber portion 562 is the greatest varies depending on the magnitude of the temperature of the rubber portion 562. This point is described now with reference to FIG. 11.

Figure 11:
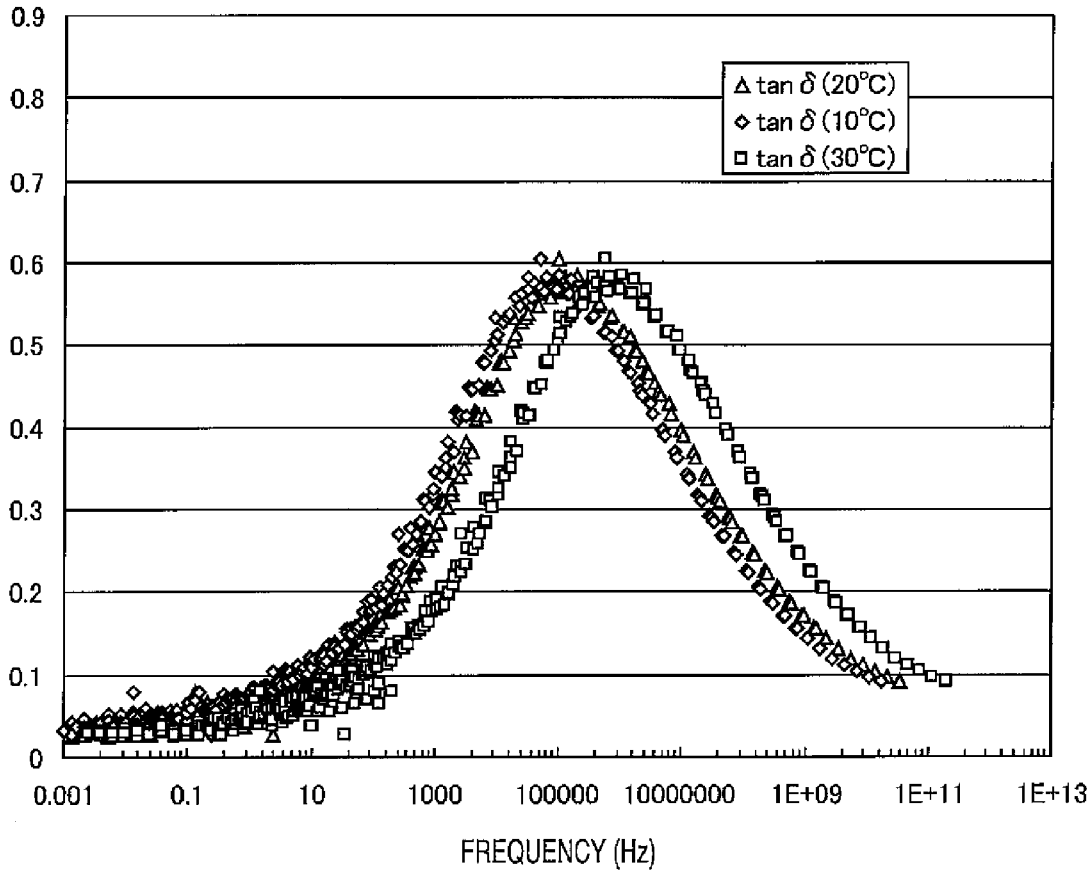
FIG. 11 is a graph illustrating a loss tangent (tan δ) relative to the number of vibrations of the rubber portion 562.

FIG. 11 is a graph illustrating the loss tangent (tan δ) relative to the number of vibrations (frequency) of the rubber portion 562. While the loss tangent (tan δ) of the rubber portion 562 when the temperature of the rubber portion 562 is 20° C. is shown in FIG. 10, the loss tangent (tan δ) of the rubber portion 562 when the temperature of the rubber portion 562 is 10° C., 20° C., and 30° C. is shown in FIG. 11. As can be seen from the graph shown in FIG. 11, the loss tangent (tan δ) increases with the increase in temperature of the rubber portion 562. Accordingly, the peak frequency f of the rubber portion 562 when the loss tangent (tan δ) of the rubber portion 562 is the greatest increases with the increase (rising) in temperature of rubber portion 562. Since the value V/L1 is about 2831 Hz, it is smaller than the peak frequencies at 10° C., 20° C., and 30° C.

Accordingly, in this embodiment, since the above-mentioned relation V/L1<f is satisfied at all the temperatures in the operating temperature range (10° C. to 35° C.) of the printer 10, the rubber portion 562 is necessarily used with the rubber-like characteristic at the time of rotation of the developing roller 510 with the image forming operation of the printer 10.

<Relation Between Peak Frequency f and Material of Rubber Portion 562>

The rubber portion 562 is made of T8175 (Example 1) made by DIC. However, a material other than T8125 may be used as the rubber portion 562 and for example, T7350 (Example 2) made by TOYO TIRE & RUBBER Co., LTD. or SS2 (Example 3) made by Bando GUM may be used. Three materials have the following characteristics. That is, T8175 of Example 1 is a thermoplastic elastomer and the hardness (shore A) thereof is 78. T7350 of Example 2 is a urethane rubber and the hardness thereof (JIS A) is 75. SS2 of Example 3 is a urethane rubber and the hardness thereof (JIS A) is 78.

Figure 12:
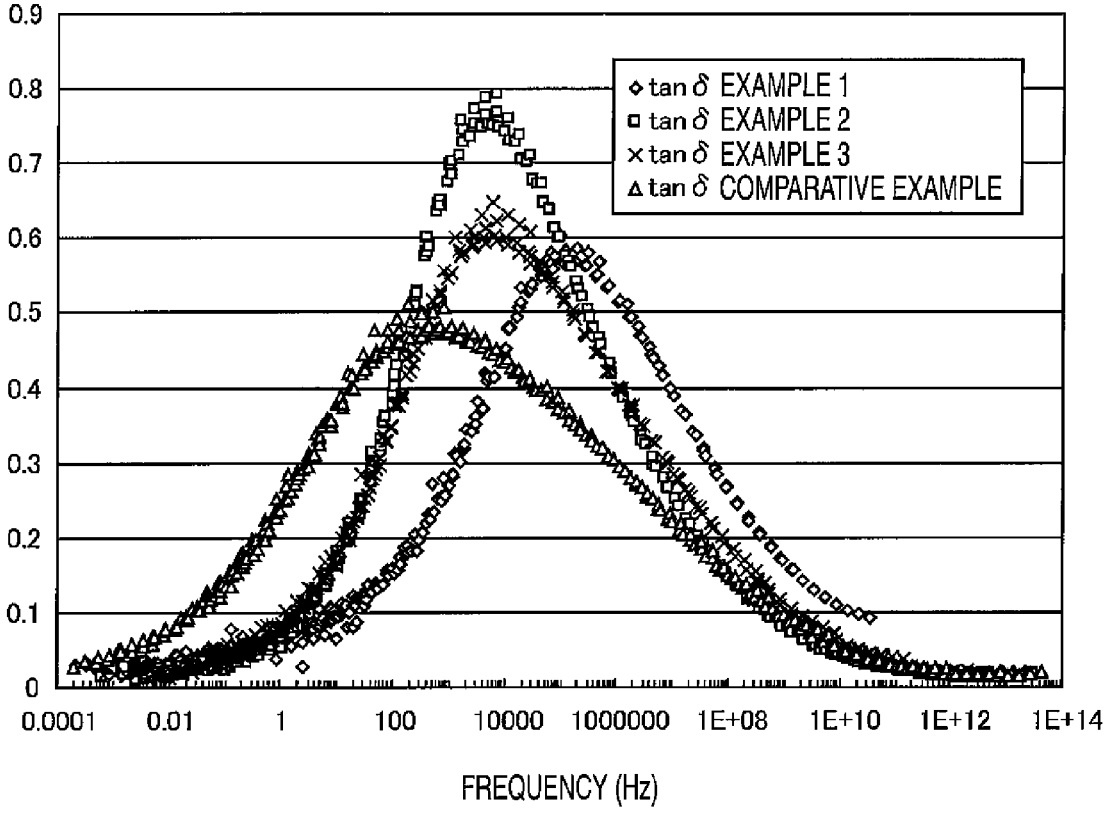
FIG. 12 is a graph illustrating loss tangents (tan δ) of materials.

FIG. 12 is a graph illustrating the loss tangents (tan δ) of the above-mentioned three materials. As can be seen from the graph shown in FIG. 12, the peak frequency f of T8175 of Example 1 is about 100000 Hz, the peak frequency f of T7350 of Example 2 is about 5000 Hz, and the peak frequency f of SS2 of Example 3 is about 4000 Hz. Accordingly, when the three materials are used as the rubber portion 562, the relation of V/L1<f is satisfied. Accordingly, the rubber portions 562 made of the three materials are used with the rubber-like characteristic at the time of rotation of the developing roller 510. In the above-mentioned embodiment, T8175 of Example 1 of which the peak frequency f is the greatest among the three materials is used as the rubber portion 562.

The loss tangent (tan δ) of 201759 made by Hokushin Industries Inc. and usable for the cleaning blade 76 is shown as Comparative Example 1 in FIG. 12. The peak frequency f of the material is about 300 Hz. When the material is used as the rubber portion 562, the relation of V/L1<f is not satisfied and the rubber portion 652 may be used with the glass-like characteristic at the time of rotation of the developing roller 510.

The graph of the loss tangent of T8175 of Example 1 shown in FIG. 12 is equivalent to the graph of the loss tangent shown in FIG. 10 and the temperature of T8175 at the time of measuring T8175 is 20° C. The temperatures of T7350 of Example 2, SS2 of Example 3, and 201759 of Comparative Example 1 at the time of measuring them are 20° C.

<Pitch L1 of Grooves 512 in Peripheral Direction and Movement Speed V of Developing Roller 510>

Although it has been described in the above-mentioned embodiment, the pitch L1 of the grooves 512 in the peripheral direction is about 113 μm and the movement speed of the surface of the developing roller 510 is 320 mm/s, the invention is not, limited to the embodiment. The pitch L1 and the movement speed V may have any value as long as they can satisfy the relation of V/L1<f. Here, it is preferable that the magnitude of the pitch L1 is in the range of about 85 μm to about 142 μm and the movement speed V is in the range of 1000 mm/s to 480 mm/s.

Countermeasure for Maintaining Relation of V/L1<f During Operation of Developing Apparatus As described above, the movement speed V of the developing roller 510 is 320 mm/s, the pitch L1 of the grooves 512 is about 113 μm and the value V/L1 (about 2831 Hz) obtained by dividing the movement speed V by the pitch L1 is smaller than the peak frequency f of the rubber portion 562.

The magnitude of the value V/L1 may vary during operation of the developing apparatus. For example, when an external disturbance acts on the developing apparatus 51, 52, 53, and 54 and the movement speed V of the developing roller 510 in rotation is greater than 320 mm/s, the value V/L1 also increases in other words, the number of vibrations (frequency) of the rubber portion 562 vibrating with the rotation of the developing roller 510 increases). When the peak frequency f of the rubber portion 562 is close to 2831 Hz (which is the frequency when the movement speed V/L1 is 320 mm/s), the magnitude of the value V/L1 may be greater than the peak frequency f at the time of variation (that is, the relation of V/L1<f may not be maintained during operation of the developing apparatus but the relation of V/L1>f may be satisfied). When the value V/L1 is greater than the peak frequency f, as described above, there is a problem in that the rubber portion 562 exhibits the glass-like characteristic.

In order to solve the above-mentioned problem, as a countermeasure for maintaining the relation of V/L1<f even when the movement speed V and the like vary in the course of operation of the developing apparatus, the value V/L1 obtained by dividing the movement speed V of the developing roller 510 by the pitch L1 of the grooves 512 is smaller than the peak frequency f when the loss tangent (tan δ) is the greatest and smaller than the frequency (hereinafter, also referred to as frequency f2) when the loss tangent at the frequency is the half of the greatest value (V/L1<f2).

Figure 13:
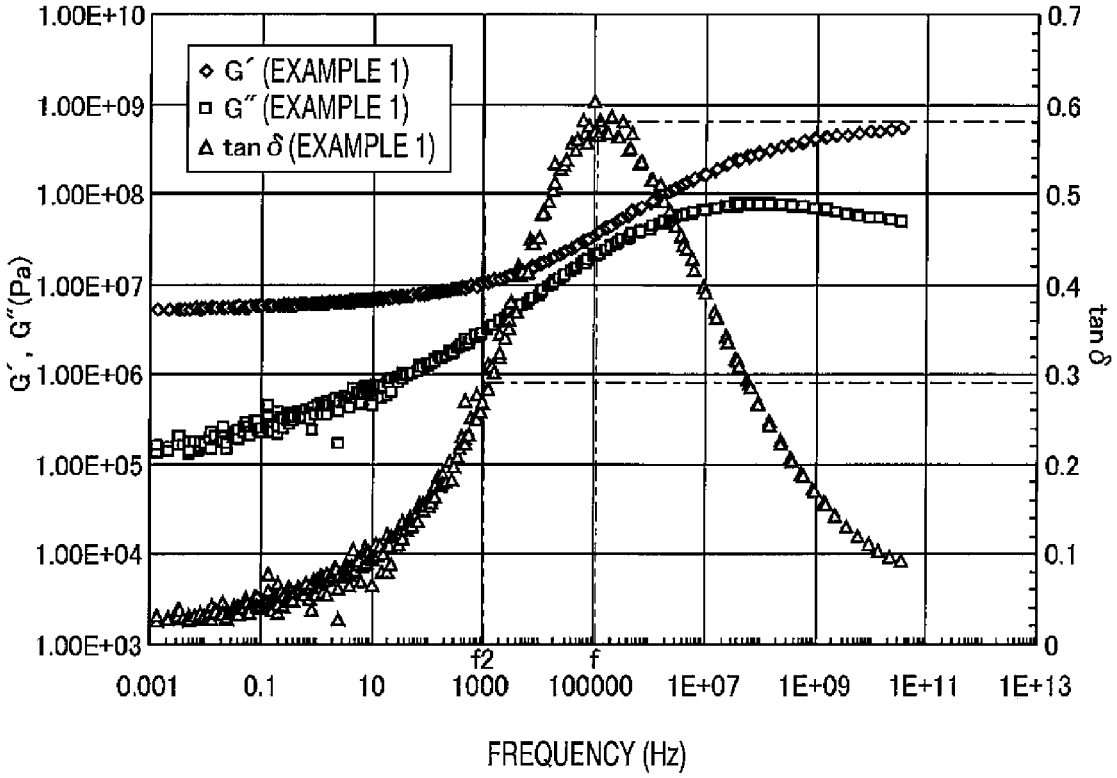
FIG. 13 is a diagram illustrating the loss tangent (tan δ) of the rubber portion 562 in Example 1.

The details are described with reference to FIG. 13. FIG. 13 is a diagram illustrating the loss tangent (tan δ) and the like of the rubber portion 562 (T8175) of Example 1, where the frequency f2 and the like are added to the graph shown in FIG. 10. As shown in FIG. 13, the greatest value of the loss tangent (tan δ) is about 0.58 and the frequency (peak frequency f) at this time is about 100000 Hz. Accordingly, the half of the greatest value is 0.29 and the frequency f2 at this time is about 1000 Hz. When the frequency f2 is about 1000 Hz, for example, the movement speed V is determined as 100 mm/s and the pitch L1 is determined 125 μm so as to satisfy the relation of V/L1<f2. In this case, the value V/L1 is 800 Hz and the relation of V/L1<f2 is established.

In this way, when the relation of V/L1<2 is established and the magnitude of the value V/L1 varies with the variation in magnitude of the movement speed V, the value V/L1 is hardly greater than the peak frequency f. This is because the frequency f2 (about 1000 Hz) is 1/100 of the peak frequency f (about 100000 Hz). As a result, the relation of V/L1<f is maintained during operation of the developing apparatus (during rotation of the developing roller 510) and the rubber portion 562 can be properly used with the rubber-like characteristic at the time of rotation of the developing roller 510.

Although it has been described that the value V/L1 is smaller than the frequency f2, the loss tangent may be smaller than the frequency which is a mean value (about 0.28) of the greatest value (about 0.58) and the least value (about 0.02 in FIG. 13) thereof. However, in this embodiment, since the least value is close to 0, the mean value (about 0.28) is almost equivalent to the half (0.29) of the greatest value. Accordingly, the frequency at the mean value and the frequency f2 are almost equivalent to each other (the same is true in the rubber portions 562 of Examples 2 and 3).

Figure 14:
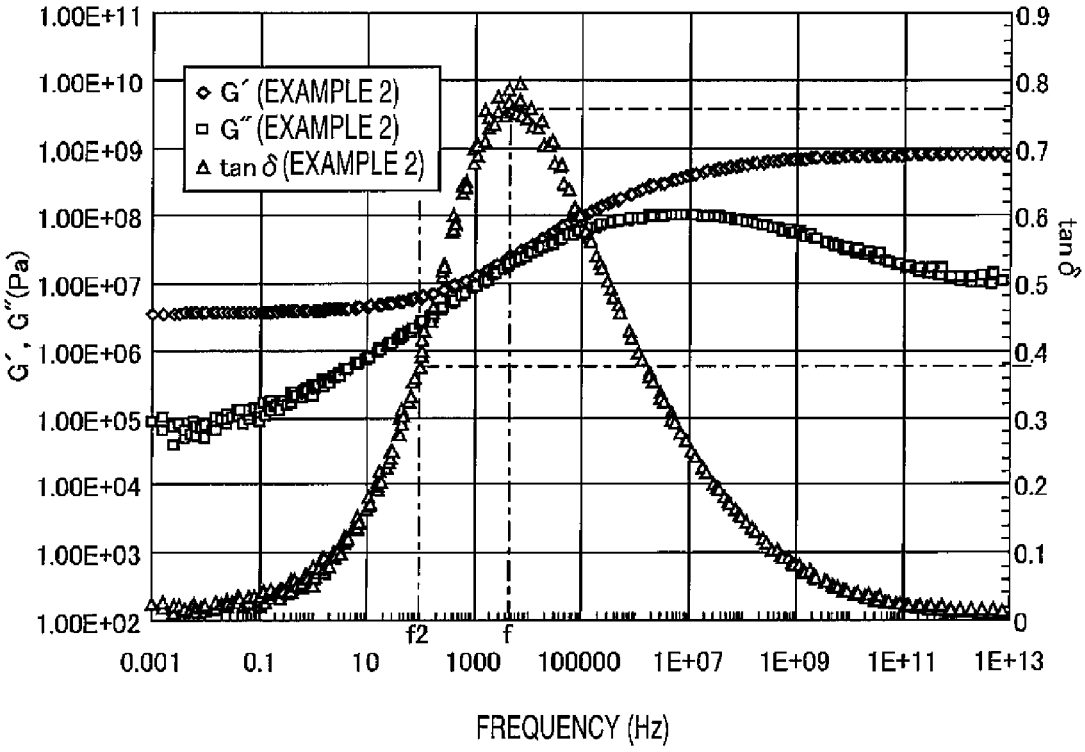
FIG. 14 is a diagram illustrating the loss tangent (tan δ) of the rubber portion 562 in Example 2.

The relation of V/L1<f2 in the rubber portion 562 (T7350) according to Example 2 and the rubber portion 562 (SS2) according to Example 3 will be described now with reference to FIGS. 14 and 15. FIG. 14 is a diagram illustrating the loss tangent (tan δ) and the like of the rubber portion 562 of Example 2 and FIG. 15 is a diagram illustrating the loss tangent (tan δ) of the rubber portion 562 and the like of Example 3.

In the rubber portion 562 of T7350 of Example 2, as shown in FIG. 14, the greatest value of the loss tangent (tan δ) is about 0.76 and the peak frequency f is about 5000 Hz. Accordingly, the half of the greatest value is 0.38 and the frequency f2 is about 100 Hz. Therefore, by determining the movement speed V and the pitch L1 so as to allow the value V/L1 to be smaller than 100 Hz in the rubber portion 562 of T7350, the rubber portion 562 is continuously used with the rubber-like characteristic during the operation of the developing apparatus.

Figure 15:
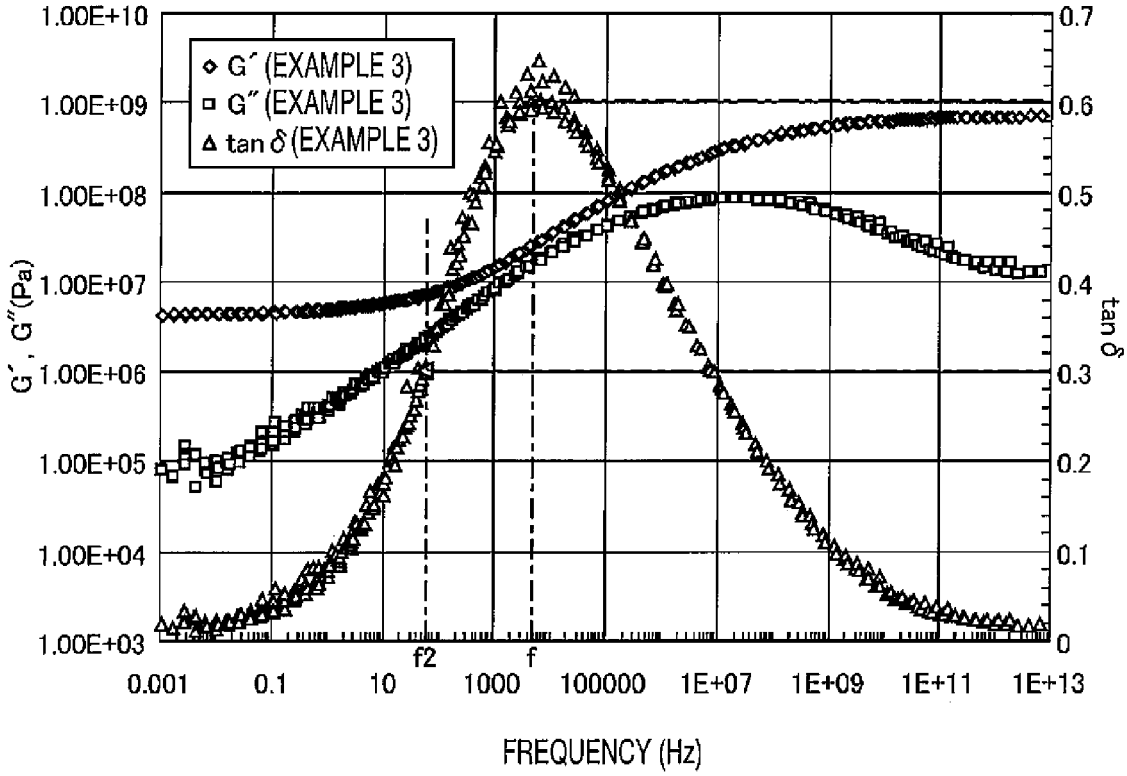
FIG. 15 is a diagram illustrating the loss tangent (tan δ) of the rubber portion 562 in Example 3.

In the rubber portion 562 of SS2 of Example 3, as shown in FIG. 15, the greatest value of the loss tangent (tan δ) is about 0.60 and the peak frequency f is about 4000 Hz. Accordingly, the half of the greatest value is 0.30 and the frequency 12 is about 60 Hz. Therefore, by determining the movement speed V and the pitch L1 so as to allow the value V/L1 to be smaller than 60 Hz in the rubber portion 562 of SS2, the rubber portion 562 is continuously used with the rubber-like characteristic during the operation of the developing apparatus.

As shown in FIGS. 13 to 15, at a frequency smaller than the frequency f2, the variation in storage elastic modulus G' of the rubber portion 562 is smaller than that at a frequency between the frequency f2 and the peak frequency f. Here, the storage elastic modulus G' indicates the elastic behavior of the material and it is known that the degree of vibration of the rubber portion 562 varies depending on the magnitude of the storage elastic modulus G. When the variation in storage elastic modulus G' of the rubber portion 562 is small, the degree of vibration of the rubber portion 562 is stabilized and thus the contact of the rubber portion 562 with the developing roller 510 is stabilized. As a result, the rubber portion 562 can property perform the function (function of giving charges to the toner) of regulating the layer thickness of the toner held on the developing roller 510.

Figure 21:
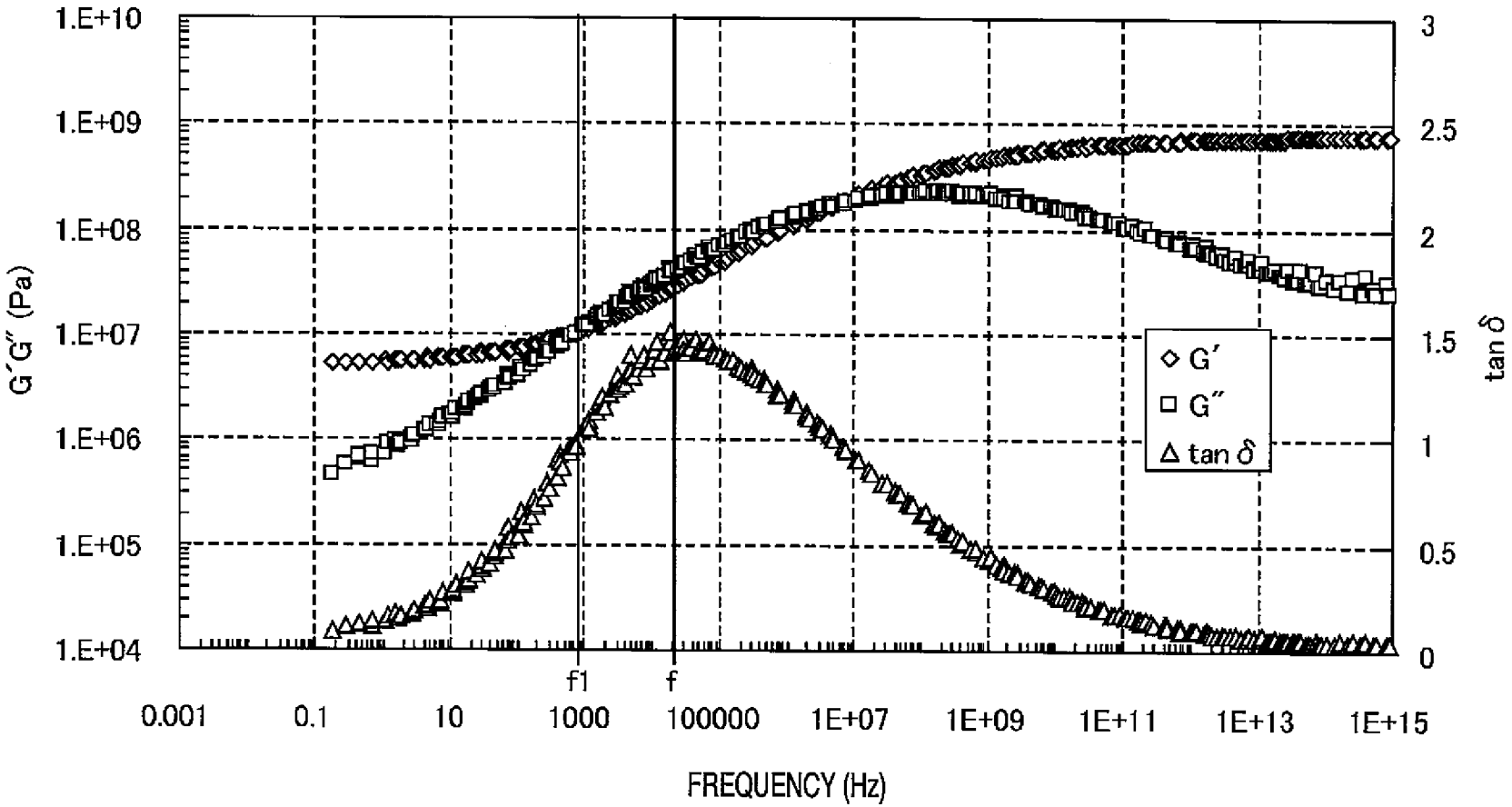
FIG. 21 is a graph illustrating the storage elastic modulus and the like relative to the (number of vibrations) frequency of the rubber portion 562.

The loss tangent (tan δ in FIG. 21) obtained by dividing the loss elastic modulus G" by the storage elastic modulus G' is shown in FIG. 21, similarly to FIG. 9. The characteristic of the rubber portion 562 is changed at the peak frequency f (about 20000 Hz in FIG. 21) as the boundary at which the loss tangent is the greatest. That is, the rubber portion 562 exhibits the glass-like characteristic at a frequency lower than 20000 Hz. The rubber portion 562 exhibits the rubber-like characteristic at a frequency higher than 20000 Hz.

Accordingly, in order to satisfy the above-mentioned requirement, that is, the requirement for using the rubber portion 562 vibrating with the rotation of the developing roller 510 with the rubber-like characteristic, it is necessary to make the number of vibrations (frequency) of the rubber portion 562 lower than the peak frequency f.

The graph shown in FIG. 21 can be obtained by the same measurement as the graph shown in FIG. 9. That is, the ARES is used as the measurer and the frequency dependence measuring mode is selected as the measuring mode. The range of frequency applied to the rubber portion 562 as the measurement target is 10-4 to 1014 (FIG. 21) and the application strain of the frequency is 0.1% (constant). The temperature of the rubber portion 562 at the time of measurement is maintained at 20° C.

<Countermeasure for Allowing Vibrating Rubber Portion 562 to be Used with Rubber-Like Characteristic>

A specific counter measure for allowing the rubber portion 562 vibrating with the rotation of the developing roller 510 to be used with the rubber-like characteristic is described now. As the countermeasure, in this embodiment, the value obtained by dividing the movement speed of the surface of the developing roller 510 at the time of rotation of the developing roller 510 by the pitch of the grooves 512 in the peripheral direction of the developing roller 510 is smaller than the number of vibrations of the rubber portion 562 when the loss tangent obtained by dividing the loss elastic modulus of the rubber portion 562 by the storage elastic modulus is the greatest.

The point is described in more detail with reference to FIG. 8, etc. As described above, two types of spiral grooves 512 having different tilt angles about the peripheral direction are formed on the surface of the developing roller 510 according to this embodiment and the two types of spiral grooves 512 intersect each other to form a lattice shape. The developing roller 510 has square-shaped top faces 515 surrounded with the two types of spiral grooves 512 and one of two diagonals of each square-shaped top face is parallel to the peripheral direction (FIG. 8). In the developing roller 510, the pitch (width L1 in FIG. 8) of the grooves 512 in the peripheral direction is about 113 μm.

As described above, the movement speed V of the surface of the developing roller 510 at the time of rotation of the developing roller 510 is 320 mm/s. Accordingly, the value V/L1 obtained by dividing the movement speed V of the surface of the developing roller 510 at the time of rotation of the developing roller 510 by the pitch L1 is about 2831 Hz. As shown in FIG. 21, since the peak frequency f of the rubber portion 562 when the loss tangent (tan δ) of the rubber portion 562 is the greatest is about 20000 Hz in the example shown in FIG. 21, the relation of V/L1<f is satisfied in this embodiment.

When the relation of V/L1<f is satisfied, why the rubber portion 562 can be used with the rubber-like characteristic at the time of rotation of the developing roller 510 is described now. As described above, the rubber portion 562 is in contact with the surface of the developing roller 510 and the grooves 512 regularly arranged are formed on the surface. Accordingly, the grooves 512 frictionally slide on the rubber portion 562, whereby the rubber portion 562 vibrates at a constant number of vibrations. The magnitude of the number of vibrations of the rubber portion 562 is determined depending on the pitch L1 of the grooves 512 in the peripheral direction and the movement speed V of the surface of the developing roller 510. That is, the number of vibrations of the rubber portion 562 at the time of rotation of the developing roller 510 is V/L1. Accordingly, when V/L1 is smaller than the peak frequency f of the rubber portion 562 (V/L1<), the rubber portion 562 is used with the rubber-like characteristic.

Accordingly, in the developing apparatus 51, 52, 53, and 54 according to this embodiment, since the relation of V/L1<f is satisfied, the number of vibrations (frequency) of the rubber portion 562 vibrating with the rotation of the developing roller 510 is smaller than the peak frequency f (about 20000 Hz) of the rubber portion 562. Accordingly, the rubber portion 562 is used with the rubber-like characteristic at the time of rotation of the developing roller 510. As a result, the rubber portion 562 can properly perform the function of regulating the layer thickness of the toner held on the developing roller 510.

Abnormal Noises Accompanied with Vibration of Rubber Portion 562

By satisfying the relation of V/L1<f, the rubber portion 562 is used with the rubber-like characteristic. However, when the rubber portion 562 is used with the rubber-like characteristic, the rubber portion 562 vibrates with the rotation of the developing roller 510, thereby causing the abnormal noises. The abnormal noises are specifically wind roar (sound resulting from the vibration of air) due to the rubber portion 562 vibrating with the rotation of the developing roller 510.

The abnormal noises have a predetermined relation with the dynamic viscoelasticity (the elastic behavior and the viscous behavior) of the rubber portion 562. That is, when the elastic behavior of two behaviors is superior an other words, when the storage elastic modulus G' is superior), the amplitude of the vibration of the rubber portion 562 increases, thereby easily causing the abnormal noises (wind roar). When the abnormal noises are generated, a user may misunderstand that a problem is caused with the printer 10.

<Countermeasure for Suppressing Generation of Abnormal Noise>>

A countermeasure for suppressing the generation of the abnormal noises is described now. As this countermeasure, the value V/L (this value V/L1 is the number of vibrations of the rubber portion 562 at the time of rotation of the developing roller 510) obtained by dividing the movement speed V of the developing roller 510 by the pitch L1 of the grooves 512 has the same magnitude as the frequency (number of vibrations) where the storage elastic modulus G' is smaller than the loss elastic modulus G".

The details are described now with reference FIG. 21. The value V/L1 is smaller than the peak frequency f (20000 Hz). As shown in FIG. 21, a frequency domain smaller than the peak frequency f includes a frequency domain in which the storage elastic modulus G' is greater than the loss elastic modulus G" and a frequency domain in which the storage elastic modulus G' is smaller than the loss elastic modulus G'. Specifically, the frequency f1 at which the graph of the storage elastic modulus G' and the graph of the loss elastic modulus G' intersect each other is about 760 Hz, the storage elastic modulus G' is smaller than the loss elastic modulus G" in the domain 760 Hz to 20000 Hz, and the storage elastic modulus G' is greater than the loss elastic modulus G" in the domain of 760 Hz or less. Since the value V/L1 (the number of vibrations of the rubber portion 562) is about 2831 Hz, the storage elastic modulus G' is smaller than the loss elastic modulus G7 at the time of vibration of the rubber portion 562.

In this way, when the storage elastic modulus G' is smaller than the loss elastic modulus G', the viscous behavior is superior to (more dominant than) the elastic behavior. Since the amplitude of the vibration of the rubber portion 562 is suppressed from increasing by suppressing the elastic behavior of the rubber portion 562, it is possible to suppress the generation of the abnormal noises (wind roar).

Specific advantages of this countermeasure are described with reference to the measurement result shown in FIG. 22. FIG. 22 is a table illustrating the measurement results, where the relation between the value V/L1 and the magnitude of the abnormal noise is shown. The measurement is performed by the following method. NA-28 (noise meter) made by RION CO., LTD. is used as the measurer. This measurer is set at a position apart by about 10 mm from the printer 10 (specifically, an exterior portion of the printer 10 dose to the developing unit 50) and the magnitude (volume) of the abnormal noise during the rotation of the developing roller 510 is measured. The volume is expressed by dB (decibel) and a large value of the volume means a large abnormal noise (feels "noisy"). In this measurement, the volume of the abnormal noise is measured in three cases (Example 4, Example 5, and Comparative Example 2) where the magnitudes of the movement speed V1 of the developing roller 510 and the pitch L1 of the grooves 512 are changed.

As in this embodiment, when the movement speed V is 320 mm/s and the pitch L1 is 113 μm, that is, when the value V/L1 (the number of vibrations of the rubber portion 562) is 2831 Hz (Example 4), the storage elastic modulus G' is smaller than the loss elastic modulus G" (see FIG. 21) and the volume of the abnormal noise is 27 dB. In Example 5, when the movement speed V is 100 mm/s and the pitch L1 is 85 μm (when the value V/L1 is 1176 Hz), the storage elastic modulus G' is smaller than the loss elastic modulus G" and the volume of the abnormal noise is 31 dB. On the other hand, in Comparative Example 2, when the movement speed V is 50 mm/s and the pitch L1 is 141 μm (when the value V/L1 is 442 Hz), the storage elastic modulus G' is greater than the loss elastic modulus G" and the volume of the abnormal noise is 69 dB.

As can be seen from the measurement result, when the storage elastic modulus G' is smaller than the loss elastic modulus G" at the time of vibration of the rubber portion 562 (Examples 4 and 5), the volume of the abnormal noise is the half or less of the volume of the abnormal noise when the storage elastic modulus G' is greater than the loss elastic modulus G" at the time of vibration of the rubber portion 562 (Comparative Example 2). Accordingly, when the number of vibrations of the rubber portion 562 is the number of vibrations at which the storage elastic modulus G' is smaller than the loss elastic modulus G", the generation of the abnormal noise in the rubber portion 562 is suppressed.

As described above, in the printer 10 according to this embodiment, since the value V/L1 has the same magnitude as the number of vibrations at which the storage elastic modulus G' is smaller than the loss elastic modulus G" among the frequencies smaller than the number of vibrations (peak frequency f) of the rubber portion 562 when the loss tangent (tan δ) of the rubber portion 562 is the greatest, it is possible to properly use the rubber portion 562 with the rubber-like characteristic at the time of rotation of the developing roller 510 and to suppress the generation of the abnormal noise accompanied with the vibration of the rubber portion 562.

Filming Generated with Increase in Temperature of Rubber Portion 562

By satisfying the relation of V/L1<f, the rubber portion 562 can be used with the rubber-like characteristic. However; when the rubber portion 562 is used with the rubber-like characteristic, the temperature of the rubber portion 562 may increase due to the frictional sliding of the developing roller 510 on the rubber portion 562 during the rotation. Particularly, when the developing roller 510 continuously performs the developing operation (the image forming operation), the developing roller 510 frictionally slides on the rubber portion 562 for a long time and thus the temperature of the rubber portion 562 can easily increase.

There is a predetermined relation between the increase in temperature of the rubber portion 562 and the dynamic viscoelasticity (the elastic behavior and the viscous behavior) of the rubber portion 562. That is, when the elastic behavior of two behaviors is superior an other words, when the loss elastic modulus G" is superior), the molecular chains of the rubber portion 562 can easily vibrate. Accordingly, heat can be easily generated and thus the temperature of the rubber portion 562 can easily increase.

In general, the rubber usually has tackiness (viscosity). Accordingly, when the rubber portion 562 is used with the rubber-like characteristic, the toner may be secured to the surface of the rubber portion 562. When the temperature of the rubber portion 562 increases (that is, when the loss elastic modulus G" is superior), the securing of the toner is promoted and the filming (lump of secured toner) may be generated on the surface of the rubber portion 562. When the filming is generated, the charting of the toner by the rubber portion 562 is not proper, thereby causing the deterioration in image quality.

<Generation of Filming Accompanied with Increase in Temperature of Rubber Portion 562>

Figure 23A:
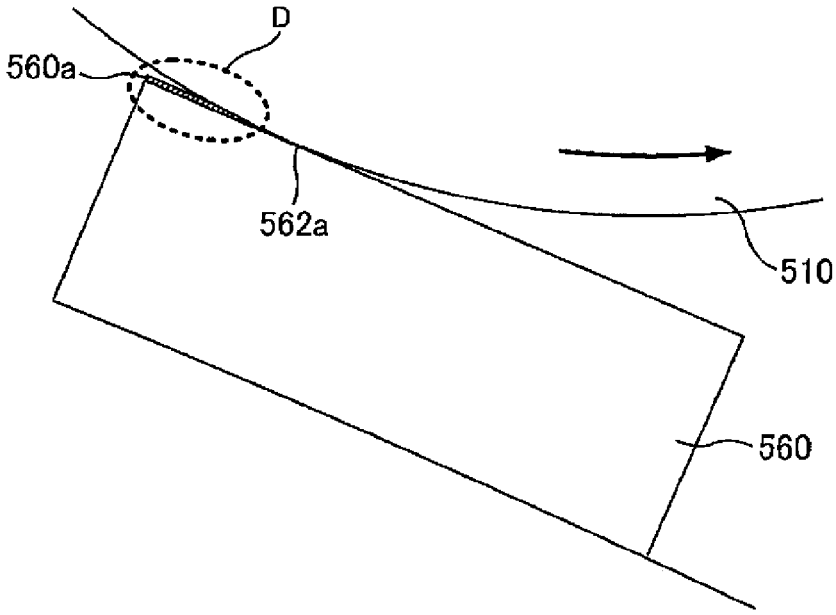
FIG. 23A is a diagram illustrating the rubber portion 562 and the periphery thereof and FIG. 23B is a diagram illustrating the rubber portion 562 in which the filming is generated.
Figure 23B:
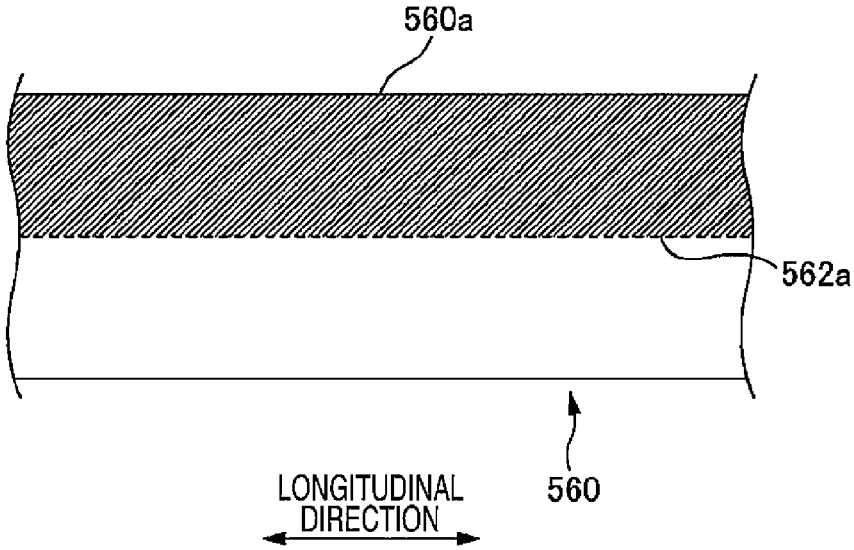

The generation of the filming is described with reference to FIGS. 23A and 23B. FIG. 23A is a diagram illustrating the rubber portion 562 and the peripheral portions thereof FIG. 23B is a diagram illustrating the rubber portion 562 in which the filming is generated on the surface thereof.

As described above, the rubber portion 562 according to this embodiment is in contact with the surface of the developing roller 510 so that the longitudinal direction thereof is parallel to the axial direction of the developing roller 510 and one end in the width direction thereof (that is, an end 560*a* of the regulating blade 560) faces the upstream side in the rotation direction of the developing roller 510. The contact portion 562*a* of the rubber portion 562 coming in contact with the surface of the developing roller 510 is apart from the end (end 560*a*) in the width direction. In this configuration, since the toner flows into the portion D (a portion between the rubber portion 562 and the developing roller 510) shown in FIG. 23A with the rotation of the developing roller 510, the toner can be easily secured to the surface (a portion between the contact portion 562*a* and the end) of the rubber portion 562.

When the temperature of the rubber portion 562 increases with the rotation of the developing roller 510, the securing of the toner is promoted. As a result, as shown in FIG. 23B, the filming (which is hatched in FIG. 23B) may be generated from the contact portion 562*a* (the contact portion 562*a* is indicated by a dotted line in FIG. 23B) to the end (the end 560*a*).

Countermeasure for Suppressing Increase in Temperature of Rubber 562

A countermeasure for suppressing an increase in temperature of the rubber portion 562 is described now. As this countermeasure, the value V/L1 (this value V/L1 is the number of vibrations of the rubber portion 562 at the time of rotation of the developing roller 510) obtained by dividing the movement speed V of the developing roller 510 by the pitch L1 of the grooves 512 has the same magnitude as the frequency (number of vibrations) where the loss elastic modulus G" is smaller than the storage elastic modulus G'.

The details are described now with reference FIG. 21. The value V/L1 is smaller than the peak frequency f (2000 Hz). As shown in FIG. 21, a frequency domain smaller than the peak frequency f includes a frequency domain (hereinafter, also referred to as frequency domain A1) in which the storage elastic modulus G' is greater than the loss elastic modulus G" and a frequency domain (hereinafter, also referred to as frequency domain A2) in which the storage elastic modulus G' is smaller than the loss elastic modulus G". Specifically, the frequency f1 at which the graph of the storage elastic modulus G' and the graph of the loss elastic modulus G" intersect each other is about 760 Hz, the storage elastic modulus G' is smaller than the loss elastic modulus G' in the domain (frequency domain M2) of 760 Hz to 20000 Hz, and the storage elastic modulus G' is greater than the loss elastic modulus G" in the domain (frequency domain A1) of 760 Hz or less. Since the value V/L1 (the number of vibrations of the rubber portion 562) is about 442 Hz, the loss elastic modulus G" is smaller than the storage elastic modulus G' at the time of vibration of the rubber portion 562.

In this way, when the loss elastic modulus G" is smaller than the storage elastic modulus G', the elastic behavior is superior to (more dominant than) the viscous behavior. Since the vibration of the molecular chains of the rubber portion 562 is suppressed by suppressing the viscous behavior of the rubber portion 562, it is possible to suppress the generation of heat and to suppress the increase in temperature of the rubber portion 562. Accordingly, it is possible to suppress the generation of the filming in the rubber portion 562.

Specific advantages of this countermeasure are described with reference to the measurement result shown in FIG. 24. FIG. 24 is a table illustrating the measurement results, where the relation between the magnitude of the value V/L1 and the temperature and generation of the filming in the rubber portion 562 is shown. The temperature of the rubber portion 562 shown in FIG. 24 is measured by the following method. That is, a thermoelectric couple is attached to the rubber portion 562 and the temperature of the rubber portion 562 is measured by the use of NR-1000 (temperature recorder) made by KEYENCE CORPORATION. The generation of the filming is determined by the following method. That is, after continuously performing a printing operation on 3000 sheets, it is determined with a naked eye whether the filming is generated on the surface of the rubber portion 562. In this measurement, the temperature of the rubber portion 562 and the generation of the filming are measured in three cases where the movement speed V of the developing roller 510 and the pitch L1 of the grooves 512 are changed (Example 6, Comparative Example 3, and Comparative Example 4).

As in this embodiment, when the movement speed V is 50 mm/s and the pitch L1 is 141 μm, that is, when the value V/L1 (the number of vibrations of the rubber portion 562) is 442 Hz (Example 6), the loss elastic modulus G" is smaller than the storage elastic modulus G' (see FIG. 21). The temperature of the rubber portion 562 is 43.2° C. and the filming is not generated on the surface of the rubber portion 562.

On the other hand, in Comparative Example 3, when the movement speed V is 160 mm/s and the pitch L1 is 141 μm (when the value V/L1 is 1135 Hz), the loss elastic modulus G" is greater than the storage elastic modulus G', the temperature of the rubber portion 562 is 50.3° C., and the filming is generated on the surface of the rubber portion 562. In Comparative Example 4, when the movement speed V is 320 mm/s and the pitch L1 is 113 μm (when the value V/L1 is 2831 Hz), the loss elastic modulus G" is greater than the storage elastic modulus G', the temperature of the rubber portion 562 is 54.7° C., and the filming is generated on the surface of the rubber portion 562.

In this way, when the loss elastic modulus G' is smaller than the storage elastic modulus G' at the time of vibration of the rubber portion 562 (Example 6), the temperature of the rubber portion 562 is lower than that when the loss elastic modulus G" is greater than the storage elastic modulus G' at the time of vibration of the rubber portion 562 (Comparative Examples 3 and 4), and the filming is not generated on the surface of the rubber portion 562. Accordingly, the effectiveness of this countermeasure is validated by the measurement.

As described above, in the printer 10 according to this embodiment, since the value V/L1 has the same magnitude as the number of vibrations at which the loss elastic modulus G" is smaller than the storage elastic modulus G' among the numbers of vibrations smaller than the number of vibrations (peak frequency of the rubber portion 562 when the loss tangent (tan δ) of the rubber portion 562 is the greatest, it is possible to properly use the rubber portion 562 with the rubber-like characteristic at the time of rotation of the developing roller 510 and to suppress the increase in temperature of the rubber portion 562 (as a result, it is possible to suppress the generation of the filming).

Rubber Portion 562 According to Examples 7 to 9

The rubber portion 562 according to Examples 7 to 9 different in material from the rubber portion 562 according to the above-mentioned embodiment (Example 6) is described now. The configurations of the developing roller 510 and the like are the same as Example 6.

Figure 25:
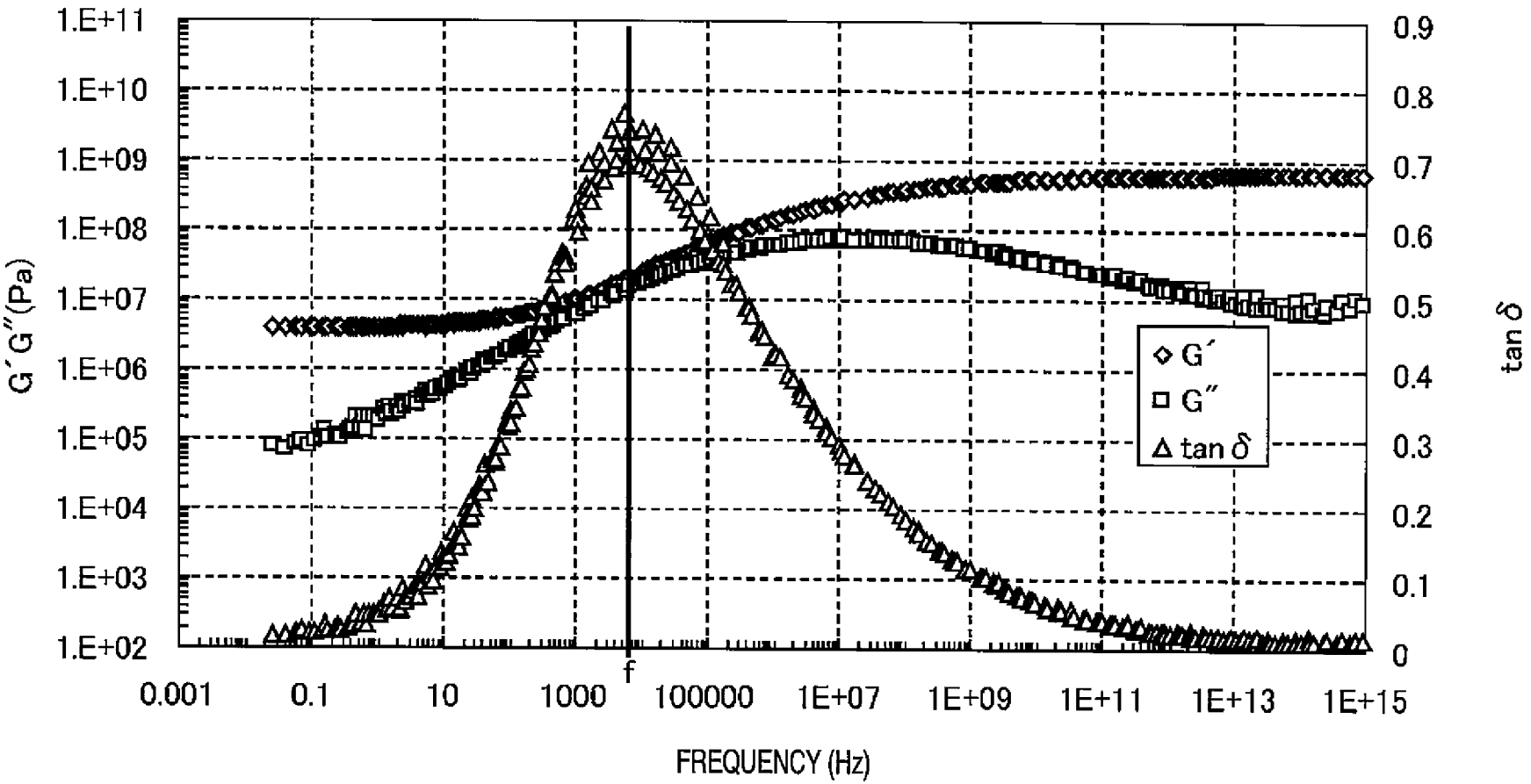
FIG. 25 is a graph illustrating the storage elastic modulus G' and the like relative to the (number of vibrations) frequency of the rubber portion 562 according to Examples 7 to 9.

FIG. 25 is a graph illustrating the storage elastic modulus G' relative to the number of vibrations (frequency) of the rubber portion 562 according to Example 7. The storage elastic modulus G', the loss elastic modulus G", and the loss tangent (tan δ) of the rubber portion 562 are shown in FIG. 25, similarly to FIG. 21. The scales of the horizontal axis are marked by logarithm.

The peak frequency f when the loss tangent (tan δ) of the rubber portion 562 according to Example 7 is the greatest is about 6700 Hz as shown in FIG. 25. As described above, since the movement speed V of the developing roller 510 is 50 mm/s and the pitch L1 of the grooves 512 is 141 μm, the value V/L1 (the number of vibrations of the rubber portion 562) is about 442 Hz. In this case, the relation of V/L1<f is established and the rubber portion 562 is used with the rubber-like characteristic at the time of rotation of the developing roller 510.

As shown in FIG. 25, the frequency domain smaller than the peak frequency f includes a frequency domain where the storage elastic modulus G' is greater than the loss elastic modulus G", but does not include the frequency domain where the storage elastic modulus G' is smaller than the loss elastic modulus G", unlike FIG. 21. Since the value V/L1 (the number of vibrations of the rubber portion 562) is about 442 Hz, the loss elastic modulus G' is smaller than the loss elastic modulus G" at the time of vibration of the rubber portion 562. Accordingly, in the rubber portion 562 according to Example 7, the elastic behavior is superior to the viscous behavior and the temperature of the rubber portion 562 is suppressed from increasing, thereby suppressing the generation of the filming.

Figures 26, 27:
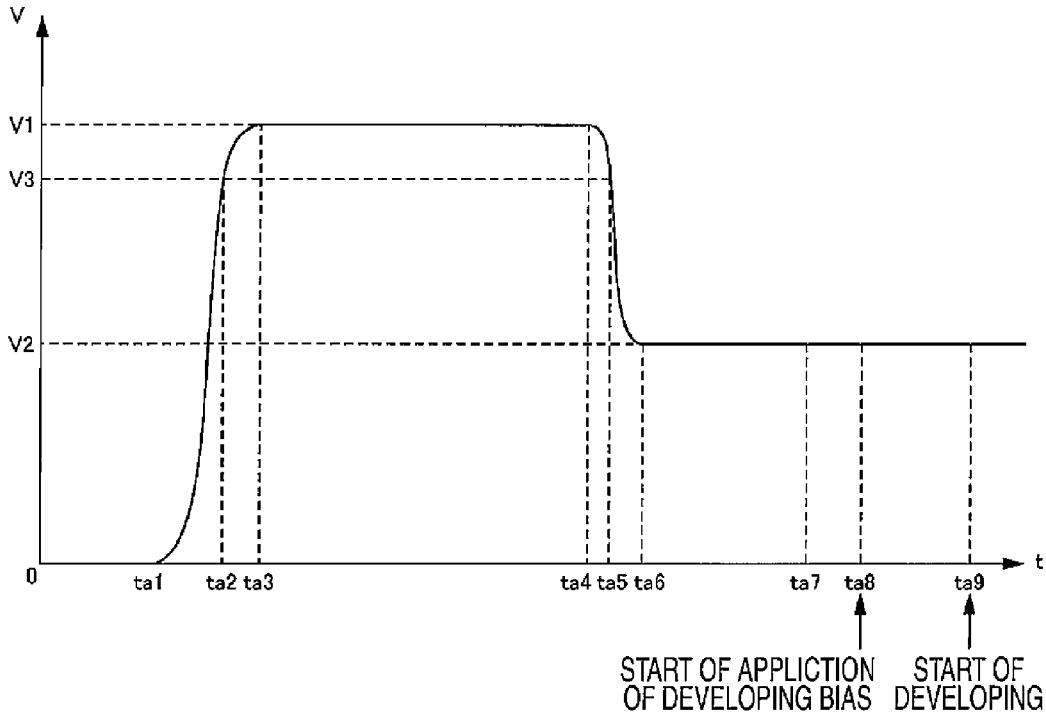
FIG. 26 is a table illustrating test results.
FIG. 27 is a diagram schematically illustrating a change of a rotation speed of the developing roller 510 when a driving control of the developing roller 510 is performed.

Here, the advantage of suppressing the increase in temperature of the rubber portion 562 according to Example 7 (of accordingly suppressing the generation of the filming) is specifically described with reference to the measurement results shown in FIG. 26. FIG. 26 is a table illustrating the measurement result, where the relation between the magnitude of the value V/L1 and the temperature and generation of the filming in the rubber portion 562 is shown. The temperature measuring method and the method of determining the generation of the filming shown in FIG. 26 are as describe a above.

When the movement speed V is 50 mm/s and the pitch L1 is 141 μm, that is, when the value V/L1 is 442 Hz (Example 7), the loss elastic modulus G" is smaller than the storage elastic modulus G'. The temperature of the rubber portion 562 is 42.4° C. and the filming is not generated on the surface of the rubber portion 562.

Similarly, when the movement speed V is, 160 mm/s and the pitch L1 is 141 μm in Example 8 (when the value V/L1 is 1135 Hz) or when the movement speed V is 320 mm/s and the pitch L1 is 113 μm in Example 9 (when the value V/L1 is 2830 Hz), the loss elastic modulus G" is smaller than the storage elastic modulus G'. The temperature of the rubber portion 562 in two cases is almost equal to the temperature of Example 7 and the filming is not generated on the surface of the rubber portion 562.

As described above, in Examples 7 to 9, since the value V/L1 has the same magnitude as the frequency at which the loss elastic modulus G' is smaller than the storage elastic modulus G' among the frequencies smaller than the number of vibrations (peak frequency C) of the rubber portion 562 when the loss tangent (tan δ) of the rubber portion 562 is the greatest, it is possible to properly use the rubber portion 562 with the rubber-like characteristic at the time of rotation of the developing roller 510 and to suppress the increase in temperature of the rubber portion 562 (as a result, it is possible to suppress the generation of the filming).

Driving Control and Stopping Control Developing Roller 510

As described above, the developing roller 510 transports the toner to the developing position by rotating and develops the latent image held on the photosensitive member 20 with the toner (the toner held on the developing roller 510). The developing roller 510 rotates at a constant rotation speed (hereinafter, referred to as a developing rotation speed) at the time of performing the developing operation (rotates at the rotation speed at which the movement speed of the surface of the developing roller 510 is 320 mm/s).

Accordingly, the control unit 100 needs to control the rotation of the developing roller 510 stopped at the time of starting the developing operation to raise the rotation speed of the developing roller 510 up to the developing rotation speed. The control unit 100 needs to control the rotation of the developing roller 510 rotating at the developing rotation speed to lower the rotation speed of the developing roller 510 at the time of ending the developing operation up to 0 (that is, it is necessary to stop the rotation of the developing roller 510).

Here, until the developing roller 510 rotates at the developing rotation speed from the stopped state, how the control unit 100 should control the rotation of the developing roller 510 (which is hereinafter referred to as a driving control of the developing roller 510 for the purpose of convenience) is described now. In addition, until the developing roller 510 is stopped from the state where it rotates at the developing rotation speed, how the control unit 100 should control the rotation of the developing roller 510 (which is hereinafter referred to as a stopping roller of the developing roller 510 for the purpose of convenience) is described now.

Basic Concept of Control

As described in the Problems that the Invention is to Solve, the contact member (the rubber portion 562 as the layer thickness regulating member in this embodiment) is in contact with the surface of the developing roller 510 and the grooves 512 regularly arranged are formed on the surface of the developing roller 510. Accordingly, when the developing roller 510 rotates, the rubber portion 562 vibrates with the sliding movement of the developing roller 510 on the rubber portion 562.

It is known that when the number of vibrations of the rubber portion 562 (the value obtained by dividing the movement speed of the surface at the time of rotation of the developing roller 510 by the pitch of the grooves 512 in the peripheral direction of the developing roller 510 correspond to the number of vibrations) is too great, the rubber portion 562 made of a elastic rubber material exhibits the glass-like characteristic, not the rubber-like characteristic. Accordingly, at the time of development, it is necessary to allow the developing roller 510 to rotate at a rotation speed at which the number of vibrations is not too great (at which the rubber portion 562 does not exhibit the glass-like characteristic), so as to allow the rubber portion 562 made of a elastic rubber material to properly perform its function.

This point is described in more details. The storage elastic modulus and the loss elastic modulus indicate dynamic viscoelasticity of a material of the rubber portion 562 made of an elastic rubber material. The storage elastic modulus indicates an elastic behavior of the material and the loss elastic modulus indicates a viscous behavior of the material. Both values vary with the variation in the number of vibrations of the material when the material vibrates. Since both values vary with the variation in the number of vibrations, the loss tangent (tan δ) obtained by dividing the loss elastic modulus G" by the storage elastic modulus G' varies with the variation in the number of vibrations. It is known that the characteristic of the material is changed at the number of vibrations (hereinafter, also referred to as boundary number of vibrations f)) as the boundary at which the loss tangent (tan δ) is the greatest. That is, the material exhibits the rubber-like characteristic when the number of vibrations of the material at the time of vibration of the material is lower than the boundary number of vibrations f. The material exhibits the glass-like characteristic when the number of vibrations is higher than the boundary number of vibrations f.

FIG. 25 is a graph illustrating a relation between the number of vibrations (hereinafter, also referred to as frequency for the purpose of convenience) of the material (that is, the rubber portion 562) according to this embodiment and the storage elastic modulus, loss elastic modulus, and loss tangent thereof. As shown in FIG. 25, in the rubber portion 562 according to this embodiment, the storage elastic modulus G', the loss elastic modulus G", and the loss tangent (tan δ) vary with the variation in frequency of the rubber portion 562. The boundary number of vibrations f of the rubber portion 562 is about 6700 Hz. Accordingly, when the number of vibrations of the rubber portion 562 at the time of vibration of the rubber portion 562 is smaller than about 6700 Hz, the rubber portion 562 exhibits the rubber-like characteristic. When the frequency is greater than about 6700 Hz, the rubber portion 562 exhibits the glass-like characteristic.

The graph shown in FIG. 25 is obtained by the following measurement. ARES made by TA instruments is used as a measurer for the measurement and a torsion type jig is used as a jig for the measurement. A temperature dependence measuring mode is selected as a measuring mode and the application strain of the frequency is 0.1% (constant). The temperature of the rubber portion 562 for the measurement is kept at 20° C.

In this way, when the number of vibrations of the rubber portion 562 is greater than the boundary number of vibrations f, the rubber portion 562 made of a rubber elastic material exhibits the glass-like characteristic, not the rubber-like characteristic. Accordingly, at the time of performing the developing operation, it is possible to control the frequency to allow the rubber portion 562 made of the elastic rubber material to perform its function, so that the number of vibrations is not greater than the boundary number of vibrations f (the frequency is smaller than the boundary number of vibrations f).

The control of the number of vibrations is accomplished by controlling the rotation speed of the developing roller 510. That is, as described above, since the number of vibrations of the rubber portion 562 is the value obtained by dividing the movement speed of the surface at the time of rotation of the developing roller 510 by the pitch of the grooves 512 in the peripheral direction of the developing roller 510, the frequency is proportional to the movement speed. Since the movement speed is proportional to the rotation speed of the developing roller 510, the number of vibrations is proportional to the rotation speed of the developing roller 510. That is, when the rotation speed of the developing roller 510 is enhanced, the number of vibrations increases. When the rotation speed is reduced, the number of vibrations decreases.

Accordingly, when the rotation speed (the developing rotation speed) of the developing roller 510 at the time of developing is made to be the rotation speed at which the number of vibrations (that is, the value obtained by dividing the movement speed by the pitch) is smaller than the boundary number of vibrations, that is, the rotation speed at which the movement speed is smaller than the product of the pitch and the boundary number of vibrations, it is possible to keep the rubber portion 562 made of the elastic rubber material in the rubber-like characteristic at the time of developing, thereby allowing the rubber portion 562 to properly perform its function.

In this embodiment, as described above, the movement speed, the pitch, and the boundary number of vibrations at the time of developing are about 320 mm/s, about 113 μm and about 6700 Hz, respectively and the product is 757.1 mm/s. Accordingly, the movement speed of the surface of the developing roller 510 when the developing roller 510 rotates at the developing rotation speed at the time of developing is smaller than the product. That is, in order to allow the rubber portion 562 to properly perform its function, the control unit 100 according to this embodiment controls the rotation of the developing roller 510 so that the developing rotation speed of the developing roller 510 is made to be the rotation speed at which the movement speed is smaller than the product of the pitch and the boundary number of vibrations.

However, as described in the BACKGROUND, etc., when the developing operation is performed in a state where the rubber portion 562 exhibits the rubber-like characteristic, the filming is generated in the rubber portion 562 due to the tackiness of the rubber portion 562 based on the rubber-like characteristic.

FIG. 23A is a schematic diagram illustrating a state where the filming is generated in the rubber portion 562. As described above, the rubber portion 562 according to this embodiment is in contact with the surface of the developing roller 510 so that the longitudinal direction thereof is parallel to the axial direction of the developing roller 510 and one end in the width direction thereof (that is, an end 560*a* of the regulating blade 560) faces the upstream side in the rotation direction of the developing roller 510. The contact portion 562*a* of the rubber portion 562 coming in contact with the surface of the developing roller 510 is apart from the end (end 560*a*) in the width direction. In this configuration, since the toner flows into the portion D (a portion between the rubber portion 562 and the developing roller 510) shown in FIG. 23A with the rotation of the developing roller 510, the filming is generated in the portion of the rubber portion 562 hatched in FIG. 23A.

When the filming is remarkable, the quality of an image developed and finally formed on the medium is deteriorated.

Accordingly, the control unit 100 according to this embodiment makes a control of shaking and removing the filming from the rubber portion 562 temporarily in the course of the driving control and the stopping control.

Here, the control of shaking and removing the filming from the rubber portion 562 is described now. As described above, the rubber portion 562 exhibits the rubber-like characteristic or the glass-like characteristic depending on the number of vibrations of the rubber portion 562. When the vibrating rubber portion 562 exhibits the glass-like characteristic, the tackiness of the rubber portion 562 based on the rubber-like characteristic is weakened to make it easy to remove the filming from the rubber portion 562. When the rubber portion 562 exhibits the glass-like characteristic, the rubber portion 562 is harder than when the rubber portion exhibits the rubber-like characteristic. Accordingly, the vibration generated in the contact portion 562*a* when the developing roller 510 slides on the rubber portion 562 at the contact portion 562*a* is easily transmitted to the portion in which the filming exists and which is hatched in FIG. 23A (on the contrary, when the rubber portion 562 exhibits the rubber-like characteristic, the vibration generated in the contact portion 562*a* is absorbed by the rubber portion 562 in the course of transmitting the vibration to the filming portion and thus is hardly transmitted to the portion) for this reason, when the vibrating rubber portion 562 exhibits the glass-like characteristic, the vibration is effectively transmitted to the filming portion which can be easily removed, whereby the filming is properly shaken and removed from the rubber portion 562.

On the other hand, as described above, when the rotation speed of the developing roller 510 is made to be the rotation speed at which the number of vibrations (that is, the value obtained by dividing the movement speed by the pitch) is smaller than the boundary number of vibrations, that is, the rotation speed at which the movement speed is smaller than the product of the pitch and the boundary number of vibrations, the vibrating rubber portion 562 exhibits the rubber-like characteristic. On the contrary, when the rotation speed of the developing roller 510 is made to be the rotation speed at which the number of vibrations (that is, the value obtained by dividing the movement speed by the pitch) is greater than the boundary number of vibrations, that is, the rotation speed at which the movement speed is greater than the product of the pitch and the boundary number of vibrations, the vibrating rubber portion 562 exhibits the glass-like characteristic. Accordingly, by controlling the rotation of the developing roller 510 so that the rotation speed of the developing speed 510 is made to be the rotation speed at which the movement speed is greater than the product of the pitch and the boundary number of vibrations, it is possible to properly shake and remove the filming from the rubber portion 562.

Accordingly, in this embodiment, in order to shake and remove the filming from the rubber portion 562, the control unit 100 controls the rotation of the developing roller 510 so that the rotation speed of the developing roller 510 is temporarily made to be the rotation speed at which the movement speed is greater than the product of the pitch and the boundary number of vibrations during the driving control and the stopping control.

More specifically, in the driving control, the control unit 100 starts the rotation of the developing roller 510 and then raises the rotation speed of the developing roller 510 up to the rotation speed (hereinafter, also referred to as first rotation speed V1) at which the movement speed is greater than the product of the pitch and the boundary number of vibrations so as to shake and remove the filming from the rubber portion 562. Thereafter (that is, after the rotation speed of the developing roller 510 becomes the first rotation speed V1), the control unit 100 lowers the rotation speed of the developing roller 510 up to the rotation speed (hereinafter, also referred to as second rotation speed V2) at which the movement speed is smaller than the product of the pitch and the boundary number of vibrations so as to allow the developing roller rotating at the second rotation speed V2 to develop the latent image. That is, the control unit 100 shakes and removes the filming from the rubber portion 562 by raising the rotation speed of the developing roller 510 up to the first rotation speed V1 before performing the developing operation, when it is not necessary to allow the rubbing portion 562 made of the elastic rubber material to perform its function. Thereafter, in the state where the filming is properly removed, the developing roller 510 develops the latent image.

The control unit 100 allows the developing roller 510 rotating at the rotation speed (hereinafter, also referred to as fifth rotation speed V5; the fifth rotation speed V5 is equal to the second rotation speed V2 in this embodiment) at which the movement speed is smaller than the product of the pitch and the boundary number of vibrations to develop the latent image, finishes the developing of the latent image by the developing roller, raising the rotation speed of the developing roller 510 up to the rotation speed (hereinafter, also referred to as fourth rotation speed V4; the fourth rotation speed V4 is equal to the first rotation speed V1 in this embodiment) at which the movement speed is greater than the product of the pitch and the boundary number of vibrations in the stopping control, and thereafter (that is, after the rotation speed of the developing roller 510 becomes the fourth rotation speed V4) stops the rotation of the developing roller 510. That is, the control unit 100 raises the rotation speed of the developing roller 510 up to the fourth rotation speed V4 so as to shake and remove the filming generated at the time of developing from the rubber portion 562 after performing the developing operation, when it is not necessary to allow the rubber portion 562 made of the elastic rubber material to perform its function.

Although it has been described that the second rotation speed V2 and the fifth rotation speed V5 are the rotation speeds at which the movement speed of the surface of the developing roller 510 is about 320 mm/s, the first rotation speed V1 and the fourth rotation speed V4 in this embodiment are the rotation speeds (2.5 times the second rotation speed V2 and the fifth rotation speed V5) at which the movement speed of the surface of the developing roller 510 is about 800 mm/s. As described above, since the product of the pitch and the boundary number of vibrations is 757.1 mm/s. Accordingly, by setting the first rotation speed V1 and the fourth rotation speed V4 to the above-mentioned rotation speed, it is possible to shake and remove the filming from the rubber portion 562. However, the value of the rotation speed is not limited to the above-mentioned numerical values, but may be properly determined depending on the values of the pitch or the boundary number of vibrations.

<Specific Example of Driving Control of Developing Roller 510>

A specific example of the driving control of the developing roller 510 is described now with reference to FIG. 27. FIG. 27 is a schematic diagram illustrating the change of the rotation speed of the developing roller 510 when the driving control of the developing roller 510 is performed, where the horizontal axis represents time and the vertical axis represents the rotation speed of the developing roller 510. In this section, developing start timing for starting developing the latent image and application start timing for starting applying the developing bias for developing the latent image are mentioned.

When the time in the horizontal axis is 0 in FIG. 27, the developing roller 510 is stopped. In order to shake and remove the filming from the rubber portion 562, the control unit 100 gives to the developing roller 510 an instruction for allowing the developing roller 510 to rotate at the first rotation speed V1 at time ta1 so as to start the rotation of the developing roller 510 and raises the rotation speed of the developing roller 510 to the first rotation speed V1. The rotations speed of the developing roller 510 slowly increases from 0, passes through the rotation speed (hereinafter, also referred to as third rotation speed V3) at which the movement speed is equal to the product of the pitch and the boundary number of vibrations at time ta2, and becomes the first rotation speed V1 at time ta3.

In order to allow the rubber portion 562 to properly perform its function at the time of developing, at ta4, the control unit 100 instructs the developing roller 510 to allow the developing roller 510 to rotate at the second rotation speed V2 (that is, the developing rotation speed) and lowers the rotation speed of the developing roller 510 to the second rotation speed. The rotation speed of the developing roller 510 slowly decreases from the first rotation speed V1, passes through the third rotation speed V3 at time ta5, and becomes the second rotation speed V2 at time ta6. In this embodiment, ta4 is set so that the time from time ta3 to time ta4, that is, the time when the developing roller 510 is rotating at the first rotation speed V1 is greater than the time (about 70 msec in this embodiment) when the developing roller 510 rotates once.

After the rotation speed of the developing roller 510 becomes the third rotation speed V3 at time ta5, more specifically, after a time point (which is represented by time ta7 in FIG. 27) in a time, when a portion, on the surface of the developing roller 510, in contact with the rubber portion 562 when the rotation speed of the developing roller 510 becomes the third rotation speed V3 moves to the position opposed to the photosensitive member 20 with the additional rotation of the developing roller 510, after the rotation speed of the developing roller 510 becomes the third rotation speed V3, the control unit 100 allows the developing bias application section 121 to start the application of the developing bias at time ta8.

The reason for defining the application start timing of the developing bias as described above is described. As described above, in order to shake and remove the filming from the rubber portion 562, the control unit 100 allows the developing roller 510 to rotate at the first rotation speed V1 from time ta3 to time ta4. Specifically, since the time period when the rubber portion 562 exhibits the glass-like characteristic is from time ta2 to time ta5, the filming is shaken and removed from the rubber portion 562 in the meantime. When the filming is shaken and removed from the rubber portion 562, the filming falls in the gravity direction and is collected by the toner container 530, but some of the filming moves to the developing roller 510 and is attached to the surface of the developing roller 510. The filming attached to the surface moves from the contact position in contact with the rubber portion 562 with the rotation of the developing roller 510, finally reaches the contact position in contact with the toner supply roller 550, is raked out at the contact position by the toner supply roller 550, and is properly collected into the toner container 530. However, when the filming attached to the surface of the developing roller 510 moves from the contact position with the rotation of the developing roller 510 to the position opposed to the photosensitive member 20 and the developing bias is applied thereto, the filming may move to the photosensitive member 20. When the filming moves to the photosensitive member 20, the proper collection of the filming into the toner container 530 is hindered.

Accordingly, in order to avoid such a problem, the control unit 100 according to this embodiment allows the developing bias application section 121 to start the application of the developing bias at time ta8 after the time point (time ta7) in a time (that is, a time until the filming finally attached to the surface moves to the position opposed to the photosensitive member 20 with the rotation of the developing roller 510), when a portion, on the surface of the developing roller 510, in contact with the rubber portion 562 when the rotation speed of the developing roller 510 becomes the third rotation speed V3 (time ta5) moves to the position opposed to the photosensitive member 20 with the additional rotation of the developing roller 510, after the rotation speed of the developing roller 510 becomes the third rotation speed V3 at time ta5 (that is, after the filming is finally attached to the surface of the developing roller 510).

In a time when the developing bias is sufficiently stabilized after the application of the developing bias is started at time ta8, the control unit 100 allows the developing roller 510 rotating at the second rotation speed V2 to develop the latent image at time ta9. That is, at time ta9, the latent image on the photosensitive member 20 is opposed to the developing roller 510 and the developing of the latent image is started.

<Specific Example of Stopping Control of Developing Roller 510>

Figure 28:
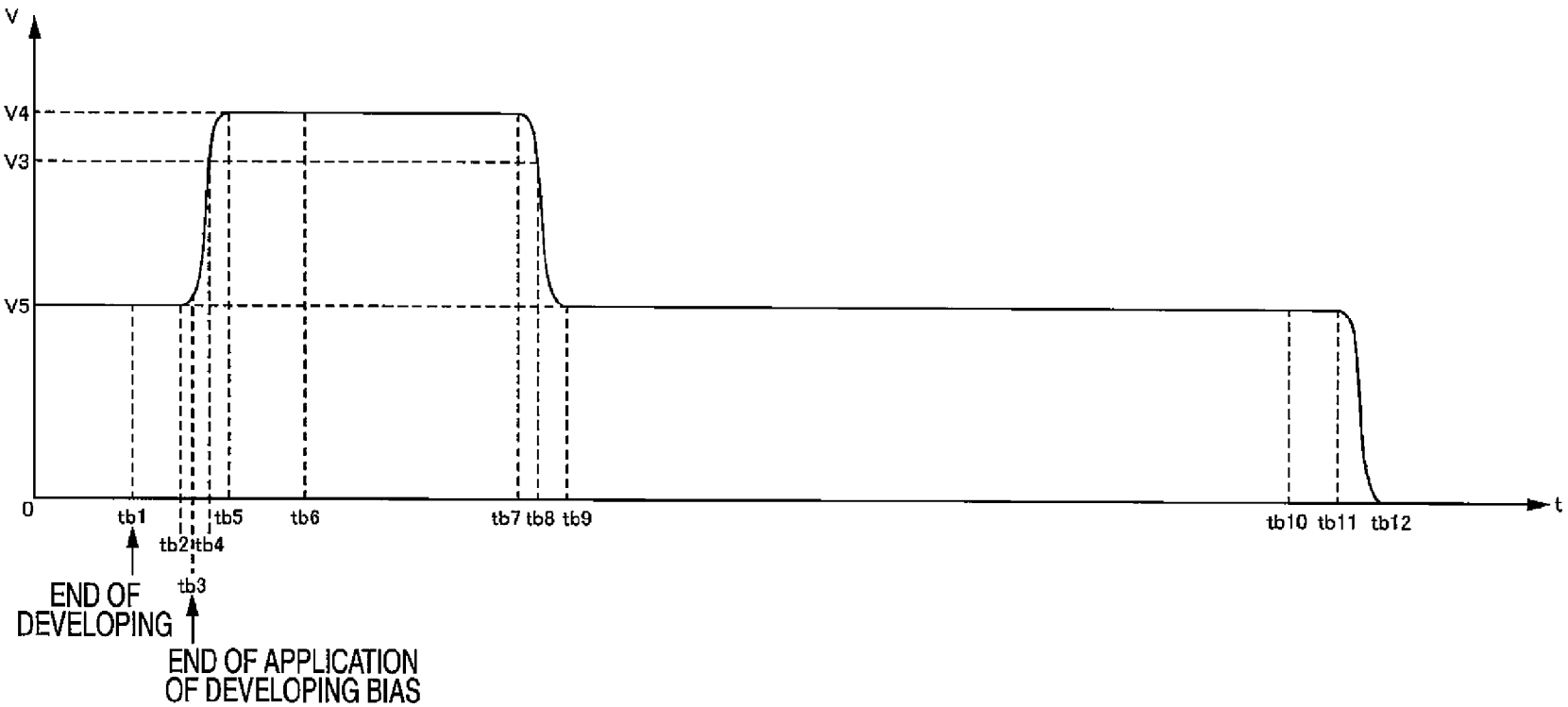
FIG. 28 is a diagram schematically illustrating a change of a rotation speed of the developing roller 510 when a stopping control of the developing roller 510 is performed.

A specific example of the stopping control of the developing roller 510 is described now with reference to FIG. 28. FIG. 28 is a schematic diagram illustrating the change of the rotation speed of the developing roller 510 when the stopping control of the developing roller 510 is performed, where the horizontal axis represents time and the vertical axis represents the rotation speed of the developing roller 510. In this section, developing end timing for ending developing the latent image and application end timing for ending applying the developing bias for developing the latent image are mentioned.

When the time in the horizontal axis is 0 in FIG. 28, the developing roller 510 is rotating at the fifth rotation speed V5 and the developing of the latent image is performed. That is, the control unit 100 allows the developing roller 510, which rotates at the fifth rotation speed V5 at which the rubber portion 562 can properly perform its function at the time of developing, to develop the latent image.

The control unit 100 ends the developing of the latent image at time tb1, gives the developing roller 510 an instruction for allowing the developing roller 510 to rotate at the fourth rotation speed V4 at time tb2 so as to shake and remove the filming from the rubber portion 562, and raises the rotation speed of the developing roller 510 to the fourth rotation speed V4. The rotation speed of the developing roller 510 slowly increases from the fifth rotation speed V5, passes through the third rotation speed V3 at which the movement speed is equal to the product of the pitch and the boundary number of vibrations at time tb4, and becomes the fourth rotation speed V4 at time tb5.

The application end timing for ending the application of the developing bias is described. In this embodiment, in consideration of the possibility that the application end timing is earlier than the developing end timing due to an error of the timing control, the application end timing is not equal to the developing end timing, but the application end timing is made to be later than the developing end timing. That is, the control unit 100 ends the application of the developing bias from the developing bias application section 121 after ending the developing of the latent image at time tb1. The control unit 100 ends the application of the developing bias at time tb3 before the rotation speed of the developing roller 510 becomes the third rotation speed V3 at time tb4. More specifically, before the time point (which is represented by time tb6 in FIG. 28) in a time, when a portion, on the surface of the developing roller 510, in contact with the rubber portion 562 when the rotation speed of the developing roller 510 becomes the third rotation speed V3 moves to the position opposed to the photosensitive member 20 with the additional rotation of the developing roller 510, after the rotation speed of the developing roller 510 becomes the third rotation speed V3.

That is, in order to avoid the above-mentioned problem, that is, a problem in that the filming moves to the photosensitive member 20 when the filming attached to the surface of the developing roller 510 moves from the contact position with the rotation of the developing roller 510 and reaches the position opposed to the photosensitive member 20 and the developing bias is applied thereto, the control unit 100 ends the application of the developing bias at time tb3 before the time point (time tb6) in a time (that is, a time when the filming first attached to the surface moves from the contact position with the rotation of the developing roller 510 and reaches the position opposed to the photosensitive member 20), when a portion, on the surface of the developing roller 510, in contact with the rubber portion 562 when the rotation speed of the developing roller 510 becomes the third rotation speed V3 (time tb4) moves to the position opposed to the photosensitive member 20 with the additional rotation of the developing roller 510, after the rotation speed of the developing roller 510 becomes the third rotation speed V3 at time tb4 (that is, after the filming is first attached to the surface of the developing roller 510).

After the rotation speed of the developing roller 510 becomes the fourth rotation speed V4 at time tb5, the control unit 100 lowers the rotation speed of the developing roller 510 to start stopping the rotation of the developing roller 510 at time tb7. Here, the control unit 100 according to this embodiment stops the rotation at time tb12 after the time point (which is represented by time tb10 in FIG. 28) in a time period, when the portion, on the surface of the developing roller 510 in contact with the rubber portion 562 when the rotation speed of the developing roller 510 becomes the third rotation speed V3 moves to the contact position in contact with the toner supply roller 550 with the additional rotation of the developing roller 510, after the rotation speed of the developing roller 510 becomes the third rotation speed V3 at time tb8, at the time of stopping the rotation of the developing roller 510.

The reason for defining the stop timing of the developing roller 510 as described above is described now. As described above, in order to shake and remove the filming from the rubber portion 562, the control unit 100 allows the developing roller 510 to rotate at the fourth rotation speed V4 from time tb5 to time tb7. Specifically, since the time period when the rubber portion 562 exhibits the glass-like characteristic is from time tb4 to time tb8, the filming is shaken and removed from the rubber portion 562 in the meantime. As described above, when the filming is shaken and removed from the rubber portion 562, some of the filming moves to the developing roller 510 and is attached to the surface of the developing roller 510. The filming attached to the surface moves from the contact position in contact with the rubber portion 562 with the rotation of the developing roller 510, finally reaches the contact position in contact with the toner supply roller 550, is raked out at the contact position by the toner supply roller 550, and is properly collected into the toner container 530. It is preferable that the filming shaken and removed and attached to the surface from time tb4 to time tb8 is preferably raked out at the contact position by the toner supply roller 550 before the developing roller 510 is stopped at time tb12.

Accordingly, in consideration of the above-mentioned point, the control unit 100 according to this embodiment stops the rotation at time tb12 after the time point (time tb10) in a time period (that is, a time period when the filming finally attached to the surface moves from the contact position with the rotation of the developing roller 510 and reaches the contact position), when the portion, on the surface of the developing roller 510, in contact with the rubber portion 562 when the rotation speed of the developing roller 510 becomes the third rotation speed V3 (time tb8) moves to the contact position in contact with the toner supply roller 550 with the additional rotation of the developing roller 510, after the rotation speed of the developing roller 510 becomes the third rotation speed V3 at time tb8 (that is, after the filming is finally attached to the surface of the developing roller 510), at the time of stopping the rotation of the developing roller 510.

After starting stopping the rotation of the developing roller 510 at time tb7, the control unit 100 stops the developing roller 510 for a sufficient time period so as to embody the above-mentioned point. More specifically, the control unit 100 gives the developing roller 510 an instruction for allowing the developing roller 510 to rotate at the fifth rotation speed V5 (that is, the developing rotation speed) at time tb7, and lowers the rotation speed of the developing roller 510 to the second rotation speed V2. The rotation speed of the developing roller 510 slowly decreases from the fourth rotation speed V4, passes through the third rotation speed V3 at time tb8, and reaches the fifth rotation speed V5 at time tb9. After allowing the developing roller 510 at the fifth rotation speed V5 for a moment, the control unit gives the developing roller 510 an instruction for stopping the developing roller 510 at time tb11, and lowers the rotation speed of the developing roller 510 to 0. The rotation speed of the developing roller 510 slowly decreases from the fifth rotation speed V5 and becomes 0 at time tb12 (the developing roller 510 is stopped). In this embodiment, time tb7 is set so that the time period from time tb5 to time tb7, that is, the time period when the developing roller 510 rotates at the fourth rotation speed V4 is greater than the time period (about 70 msec in this embodiment) when the developing roller 510 rotates once.

Effectiveness of Printer 10 According to Embodiment

As described above, in the printer 10 according to this embodiment, the control unit 100 starts the rotation of the developing roller 510, then raises the rotation speed of the developing roller 510 up to the first rotation speed V1 at which the movement speed is greater than the product of the pitch and the boundary number of vibrations, lowers the rotation speed of the developing roller 510 up to the second rotation speed V2 at which the movement speed is smaller than the product of the pitch and the boundary number of vibrations after the rotation speed of the developing roller 510 becomes the first rotation speed V1, and allows the developing roller 510 rotating at the second rotation speed V2 to develop the latent image. Accordingly, the filming is properly shaken and removed from the rubber portion 562 before the filming is remarkable. As a result, the deterioration in image quality of an image developed and finally formed on the medium can be properly prevented.

In the printer 10 according to this embodiment, the control unit 100 lowers the rotation speed of the developing roller 510 from the first rotation speed V1 to the second rotation speed V2 via the third rotation speed V3 at which the movement speed is equal to the product after the rotation speed of the developing roller 5 to becomes the first rotation speed V1, and starts the application of the developing bias by the developing bias application section 121 after the rotation speed of the developing roller 510 becomes the third rotation speed V3. More specifically, the control unit starts the application of the developing bias after the time point in a time period, when the portion, on the surface of the developing roller 510, in contact with the rubber portion 562 when the rotation speed of the developing roller 510 becomes the third rotation speed V3 moves to the position opposed to the photosensitive member 20 with the additional rotation of the developing roller 510, after the rotation speed of the developing roller 510 becomes the third rotation speed V3. Accordingly, the filming hardly moves to the photosensitive member 20 and is properly collected by the toner container 530. By starting the application of the developing bias from the developing bias application section 121 after the rotation speed of the developing roller 510 becomes the third rotation speed V3, the above-mentioned advantage (that is, the advantage of allowing the toner container 530 to properly collect the filming) is obtained even when the application of the developing bias is started before the above-mentioned time point. For the purpose of obtaining the complete advantage, it is preferable that the application of the developing bias is started after the above-mentioned time point.

In the printer 10 according to this embodiment, the control unit 100 allows the developing roller 510, which rotates at the fifth rotation speed V5 at which the movement speed is smaller than the product of the pitch and the boundary number of vibrations, to develop the latent image, raises the rotation speed of the developing roller 510 to the fourth rotation speed V4 at which the movement speed is greater than the product after ending the developing of the latent image, and stops the rotation of the developing roller 510 after the rotation speed of the developing roller 510 becomes the fourth rotation speed V4. Accordingly, the filming is properly shaken and removed from the rubber portion 562 before the filming is remarkable. Accordingly, the deterioration in image quality of the image developed and finally formed on the medium is properly prevented.

In the printer 10 according to this embodiment, the control unit 100 raises the rotation speed of the developing roller 510 from the fifth rotation speed V5 to the fourth rotation speed V4 via the third rotation speed V3 at which the movement speed is equal to the product after ending the developing of the latent image, and stops the application of the developing bias from the developing bias application section 121 before the rotation speed of the developing roller 510 becomes the third rotation speed V3. More specifically, the control unit stops the application of the developing bias before the time point in the time period, when the portion, on the surface of the developing roller 510, in contact with the rubber portion 562 when the rotation speed of the developing roller 510 becomes the third rotation speed V3 moves to the position opposed to the photosensitive member 20 with the additional rotation of the developing roller 510, after the rotation speed of the developing roller 510 becomes the third rotation speed V3. Accordingly, the filming hardly moves to the photosensitive member 20 and is properly collected in the toner container 530. By stopping the application of the developing bias before the above-mentioned time point, the above-mentioned advantage (that is, the advantage of allowing the toner container 530 to properly collect the filming) is obtained. For the purpose of obtaining the complete advantage with a margin, it is preferable that the application of the developing bias is stopped before the rotation speed of the developing roller 510 becomes the third rotation speed V3.

In the printer 10 according to this embodiment, at the time of stopping the rotation of the developing roller 510 after the rotation speed of the developing roller 510 becomes the fourth rotation speed V4, the control unit 100 stops the rotation after the time point in the time period, when the portion, on the surface of the developing roller 510, in contact with the rubber portion 562 when the rotation speed of the developing roller 510 becomes the third rotation speed V3 moves to the position in contact with the toner supply roller 550 with the additional rotation of the developing roller 510, after the rotation speed of the developing roller 510 becomes the third rotation speed V3. Accordingly, the filming is properly removed by the toner supply roller 550 before the rotation of the developing roller 510 is stopped.

Method of Manufacturing Developing Roller 510

Figure 16A:
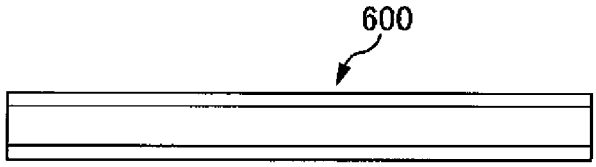
FIGS. 16A to 16E are schematic diagrams illustrating a change of the developing roller 510 in a process of manufacturing the developing roller 510.
Figure 16B:
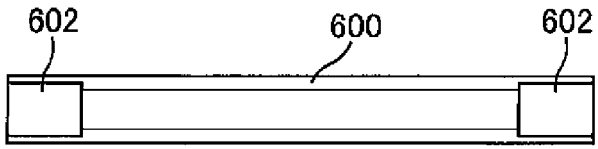
Figure 16C:
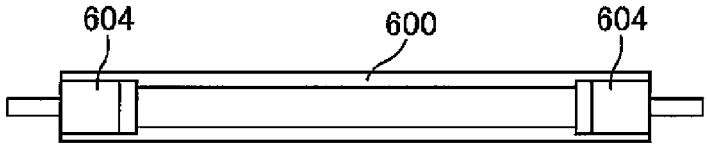
Figure 16D:
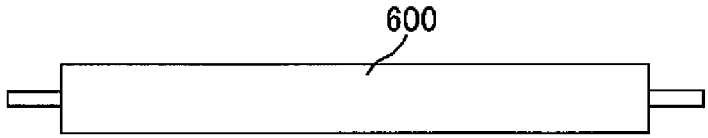
Figure 16E:
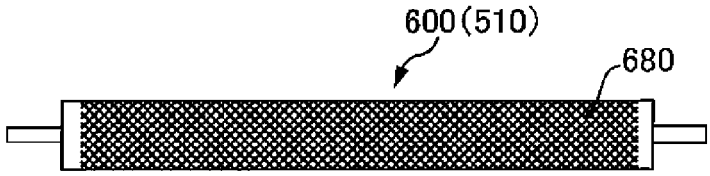
Figure 17:
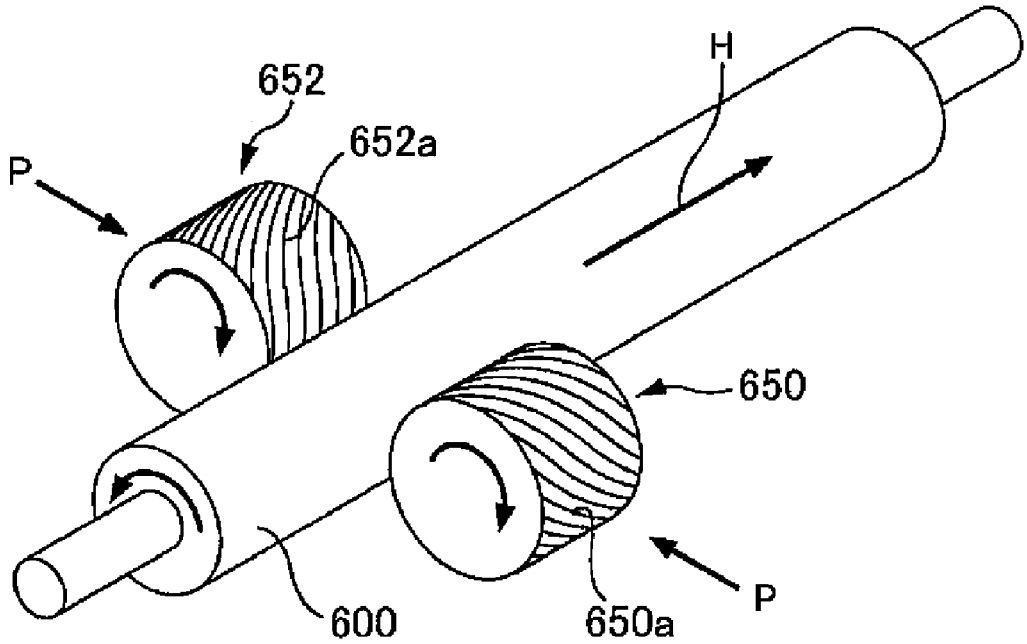
FIG. 17 is an explanatory diagram illustrating a rolling process on the developing roller 510.

A method of manufacturing the developing roller 510 is described now with reference to FIGS. 16A to 16E and FIG. 17. FIGS. 16A to 16E are schematic diagrams the change of the developing roller 510 in a process of manufacturing the developing roller 510. FIG. 17 is an explanatory diagram illustrating a rolling process of the developing roller 510.

First as shown in FIG. 16A, a pipe member 600 is prepared as a base member of the developing roller 510. The thickness of the pipe member 600 is 0.5 to 3 mm. Next, as shown in FIG. 16B, a flange pressing-insertion portion 602 is formed at both ends in the longitudinal direction of the pipe member 600. The flange pressing-insertion portion 602 is formed by a cutting process. Next, as shown in FIG. 16C, a flange 604 is inserted into the flange pressing-insertion portion 602. In order to reliably fix the flange 604 to the pipe member 60*p*, the flange 604 may be bonded or welded to the pipe member 600 after the flange 604 is inserted. Next, as shown in FIG. 16D, a centerless grinding process is performed on the surface of the pipe member 600 into which the flange 604 is inserted. The centerless grinding process is performed on the entire surface and the 10-point average roughness Rz of the surface having been subjected to the centerless grinding process is 1.0 μm or less. Next, as shown in FIG. 16E, a rolling process is performed on the pipe member 600 into which the flange 604 is inserted. In this embodiment, a so-called throughfeed rolling process using two round dices 650 and 652 is performed.

That is, as shown in FIG. 17, in a state where two round dices 650 and 652 disposed to interpose the pipe member 600 as a workpiece therebetween are pressed against the pipe member 600 with a predetermined pressure (of which the direction is indicated by reference sign P in FIG. 17), two round dices 650 and 652 are made to rotate in the same direction (see FIG. 17). In the throughfeed rolling process, with the rotation of the round dices 650 and 652, the pipe member 600 moves in the direction indicated by reference sign H in FIG. 17 while rotating in the opposite direction of the rotation direction of the round dices 650 and 652. Convex portions 650*a* and 652*a* for forming grooves 680 are formed on the surface of the round dices 650 and 652. The convex portions 650*a* and 652*a* deform the pipe member 600 to form the grooves 680 (corresponding to the grooves 512 in FIG. 5) in the pipe member 600.

After the rolling process is finished, the surface of the center portion 510*a* is plated. In this embodiment, electroless Ni—P plating is used, but the invention is not limited to it. For example, hard chrome plating or electrical plating may be used.

Other Embodiments

Although the image forming apparatus, etc. according to the invention have been described with reference to the above-mentioned embodiments, the embodiments are intended to easily understand the invention, but not to define the invention. The invention may be modified in various forms without departing from the gist thereof and the invention includes equivalents thereof.

Although an intermediate transfer type full color laser beam printer has been described as the image forming apparatus in the embodiments, the invention may be applied to various image forming apparatuses such as a full color laser beam printer other than the intermediate transfer type, a monochrome laser beam printer, a copier, and a facsimile.

As the photosensitive member, a so-called photosensitive belt in which a photosensitive layer is formed on the surface of a belt-like conductive base member may be employed as well as a so-called photosensitive roller in which a photosensitive layer is formed on the peripheral surface of a cylindrical conductive base member.

In the above-mentioned embodiments, as shown in FIG. 4, the rubber portion 562 being in contact with the surface of the developing roller 510 so as to regulate the layer thickness of the toner held on the developing roller 510 has been employed as the contact member, but the invention is not limited to the rubber portion. For example, the upper seal 520 or the toner supply roller 550 may be used as the contact member as long as it is made of an elastic rubber material.

However, when the rubber portion 562 is used as the contact member, it is possible to prevent the layer thickness of the toner from being improperly regulated due to the use of the rubber portion 562 with the glass-like characteristic by satisfying the relation of V/L1<f. As a result, the above-mentioned embodiments are more preferable, in that the developing can be more properly performed by the developing roller 510.

In the above-mentioned embodiment, the rubber portion 562 is in contact with the surface so that the longitudinal direction thereof is parallel to the axial direction of the developing roller 510 and one end in the width direction thereof (that is, the end 560*a* of the regulating blade 560) faces the upstream side in the rotation direction of the developing roller 510. The contact portion 562*a* of the rubber portion 562 coming in contact with the surface of the developing roller 510 is apart from the end in the width direction (that is, the rubber portion 562 is in contact with the developing roller 510 at the center portion). However, the invention is not limited to the embodiment. For example, the contact portion 562*a*, that is, the rubber portion 562, may be in contact with the developing roller 510 at the edge.

In the above-mentioned embodiments, the rubber portion 562 has been made of thermoplastic elastomer as a kind of elastic rubber material, but the invention is not limited to the thermoplastic elastomer. For example, the rubber portion 562 may be made of rubber (more specifically, urethane rubber).

In the above-mentioned embodiments, as shown in FIG. 4, the rubber portion 562 (layer thickness regulating member) being in contact with the surface of the developing roller 510 so as to regulate the layer thickness of the toner held on the developing roller 510 has been employed as the contact member, but the invention is not limited to the rubber portion. For example, the upper seal 520 or the toner supply roller 550 may be used as the contact member as long as it is made of an elastic rubber material.

However, when the rubber portion 562 is used as the contact member, the above-mentioned embodiments are more preferable in that the rubber portion 562 can be used with the rubber-like characteristic to properly regulate the layer thickness of the toner by satisfying the relation of V/L1<f.

In the above-mentioned embodiment, as shown in FIG. 4, the rubber portion is in contact with the surface of the developing roller 510 so that the longitudinal direction thereof is parallel to the axial direction of the developing roller 510 and one end in the width direction thereof (that is, an end 560*a* of the regulating blade 560) faces the upstream side in the rotation direction of the developing roller 510. The contact portion 562*a* of the rubber portion 562 coming in contact with the surface of the developing roller 510 is apart from the end in the width direction (that is, the rubber portion 562 is in contact with the developing roller 510 at the center portion). However, the invention is not limited to the embodiment. For example, the contact portion of the rubber portion 562 is the end (that is, the rubber portion 562 is in contact with the developing roller 510 at the edge thereof).

However, as described below, the above-mentioned embodiments are more preferable in that the generation of the filming can be suppressed between the contact portion 562*a* of the rubber portion 562 and the end (end 560*a*). That is, when the rubber portion 562 is in contact with the developing roller 510 at the center portion, the filming may be generated between the contact portion 562*a* and the end due to the increase in temperature of the rubber portion 562. Therefore, by setting the value V/L1 to the same magnitude as the number of vibrations at which the loss elastic modulus G" is smaller than the storage elastic modulus G', the increase in temperature of the rubber portion 562 can be suppressed. As a result, the filming is suppressed from being generated between the contact portion 562*a* and the end.

In the above-mentioned embodiments, as shown in FIG. 6, two types of spiral grooves 512 of which the tilt angles about the peripheral direction of the developing roller 510 are different from each other have been employed as the concave portions and two types of spiral grooves 512 intersect each other to form a lattice shape, but the invention is not limited to the grooves. For example, the concave portions may not have a groove shape. When the concave portions have a groove shape, the grooves may not have a spiral shape. One type of grooves may be employed as the concave portions.

Figure 18A:
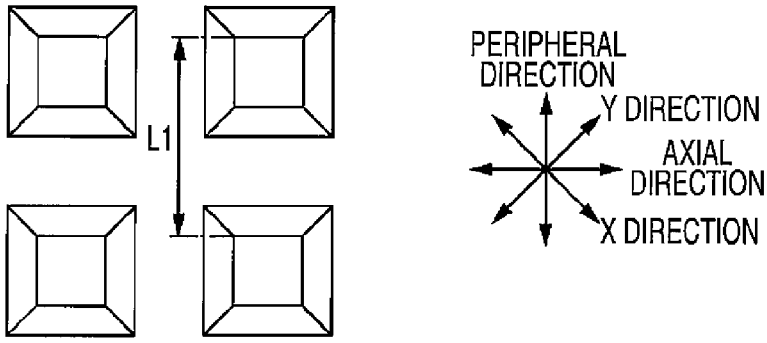
FIGS. 18A to 18C are diagrams illustrating variations of a surface shape of the developing roller 510.
Figure 18B:
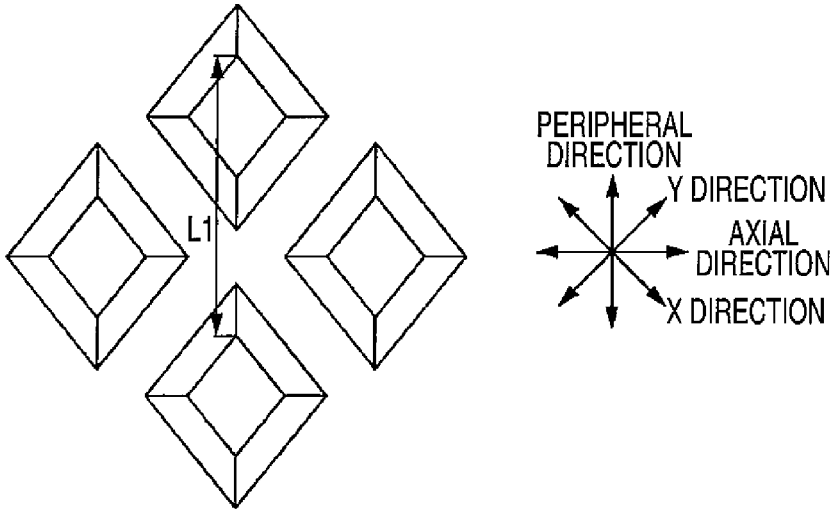
Figure 18C:
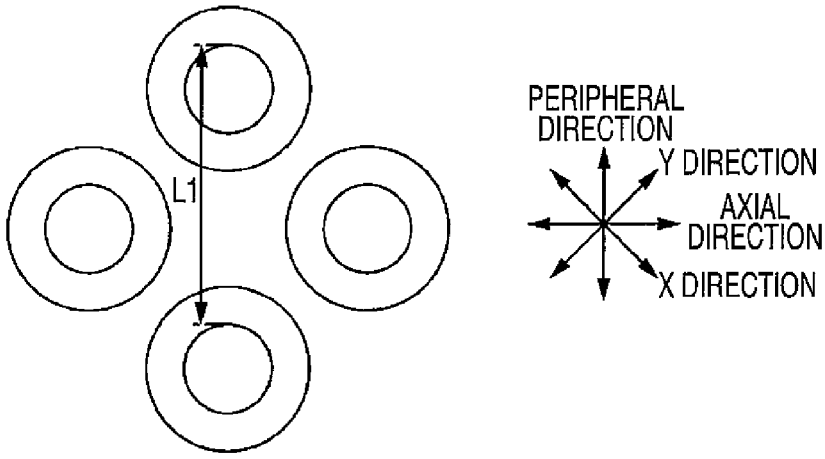

In the above-mentioned embodiments, as shown in FIG. 6, the developing roller 510 has the square-like top faces 515 surrounded with two types of spiral grooves 512 and one of two diagonals of each square-like top face 515 is parallel to the peripheral direction of the developing roller 510, but the invention is not limited to such a developing roller. For example, as shown in FIG. 18B, the top face may have a diamond shape instead of the square shape. The top face may have a circular shape as shown in FIG. 18C, instead of the diamond shape. As shown in FIG. 18A, both of two diagonals of the square-like top face may not be parallel to the peripheral direction. FIGS. 18A to 18C are diagrams illustrating variations of the surface shape of the developing roller 510.

In the above-mentioned embodiments, the grooves 512 have the bottom surface 514 and the side surface 513 and the slope angle of the side surface 513 is about 45 degree (see FIG. 7), but the invention is not limited to it. For example, the slope angle of the side surfaces 513 may be about 90 degree.

In the above-mentioned embodiments, the developing apparatuses 51, 52, 53, and 54 can be mounted on and demounted from the printer body 10*a* of the printer 10 (see FIG. 1), the operating temperature range is set in the printer 10, and the number of vibrations of the rubber portion 562 when the loss tangent (tan δ) is the greatest varies depending on the magnitude of the temperature (see FIG. 11). The value V/L1 obtained by dividing the movement speed V of the surface at the time of the rotation of the developing roller 510 by the pitch L1 of the grooves 512 in the peripheral direction of the developing roller 510 is set to be smaller than the peak frequency f of the rubber portion 562 when the loss tangent (tan δ) is the greatest at all the temperatures in the operating temperature range (specifically, 10° C. to 35° C., but the invention is not limited to the setting. For example, the relation of V/L1<f may not be satisfied at some temperatures in the operating temperature range.

However, when the relation of V/L1<f is satisfied at all the temperatures in the operating temperature range, the above-mentioned embodiments are more preferable in that the rubber portion 562 can be used with the rubber-like characteristic when the printer 10 forms an image.

In the above-mentioned embodiments, the rubber portion 562 is made of thermoplastic elastomer, but the invention is not limited to the material. For example, the rubber portion 562 may be made of urethane rubber.

In the above-mentioned embodiments, the value V/L1 obtained by dividing the movement speed V of the surface at the time of the rotation of the developing roller 510 by the pitch L1 of the grooves 512 in the peripheral direction of the developing roller 510 is set to be smaller than the peak frequency (number of vibrations) f of the rubber portion 562 when the loss tangent (tan δ) is the greatest, and to be smaller than the number of vibrations f2 (see FIGS. 13 to 15) at which the loss tangent (tan δ) is a half of the greatest value at the frequency, but the invention is not to the setting. For example, the value V/L1 may be set to have a magnitude between the peak frequency f1 and the frequency B2.

However, when the value V/L1 is smaller than the frequency f2 and the movement speed V of the developing roller 510 varies to change the number of vibrations (frequency) of the rubber portion 562, the number of vibrations (frequency) is hardly greater than the peak frequency f (in other words, the rubber portion 562 hardly exhibits the glass-like characteristic. Accordingly, the above-mentioned embodiments are more preferable in that the rubber portion 562 can be properly used with the rubber-like characteristic at the time of the rotation of the developing roller 510.

In the printer 10, the operating temperature range (for example, the range of temperature in which no problem is guaranteed to occur at the time of using the printer 10) is set. However, even when the printer 10 is used at any temperature in the operating temperature range, it is preferable that the rotation speed of the developing roller 510 is raised up to the first rotation speed V1 or the fourth rotation speed V4 at which the movement speed is greater than the product of the pitch and the boundary number of vibrations.

It is known that the value of the number of vibrations minutely varies with the variation in temperature of the rubber portion 562. Accordingly, the value of the boundary number of vibrations slightly varies depending on what temperature in the operating temperature range the printer 10 is used at. Therefore, when the rotation speed of the developing roller 510 is set to a predetermined rotation speed, the predetermined rotation speed may become a rotation speed at which the movement speed is greater than the product of the pitch and the boundary number of vibrations at some temperatures in the operating temperature range, and the predetermined rotation speed may become a rotation speed at which the movement speed is smaller than the product of the pitch and the boundary number of vibrations at other temperatures in the operating temperature range.

Even when the rotation speed of the developing roller 510 is raised to the first rotation speed V1 or the fourth rotation speed V4 at which the movement speed is greater than the product of the pitch and the boundary number of vibrations at some temperatures in the operating temperature range, the above-mentioned advantage (that is, the advantage of properly preventing the deterioration in image quality) is sufficiently obtained, but it is preferable that the rotation speed of the developing roller 510 is raised to the first rotation speed V1 or the fourth rotation speed V4 at which the movement speed is greater than the product of the pitch and the boundary number of vibrations in the entire operating temperature range.

Configuration of Image Forming System

An image forming system according to an embodiment of the invention is described now with reference to the drawings.

Figure 19:
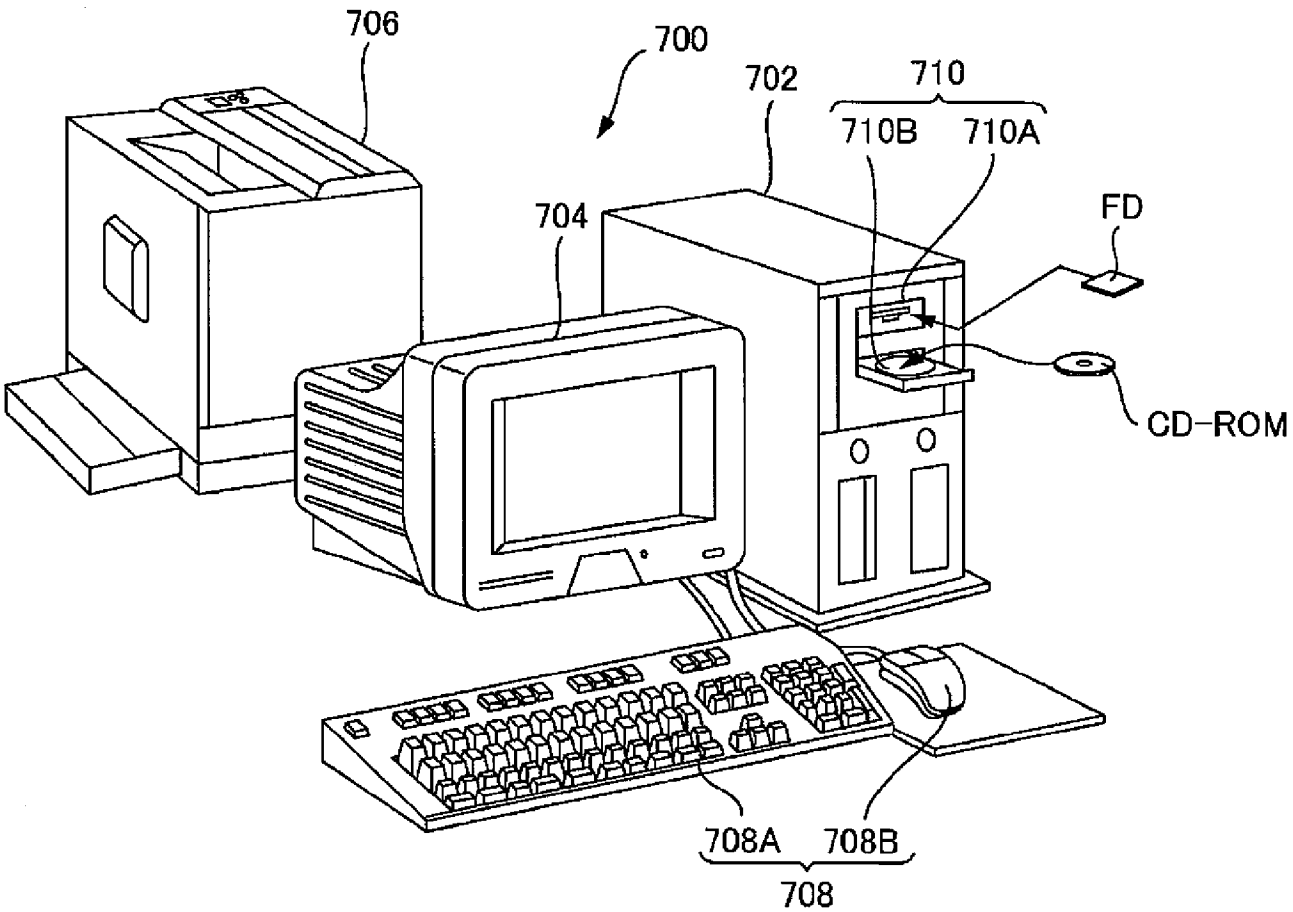
FIG. 19 is an explanatory diagram illustrating an appearance of an image forming system.

FIG. 19 is a diagram illustrating an appearance of an image forming system. The image forming system 700 includes a computer 702, a display device 704, a printer 706, an input device 708, and a reading device 710. The computer 702 is received in a mini tower type chassis in this embodiment, but is not limited to such a type. The display device 704 usually employs a cathode ray tube (CRT), or a plasma display, or a liquid crystal display, but is not limited to the devices. The printer 706 employs the above-mentioned printer. The input device 708 employs a keyboard 708A and a mouse 708B in this embodiment, but is not limited to such devices. The reading device 710 employs a flexible disk drive 710A and a CD-ROM drive 710B in this embodiment, but is not limited to such device. For example, other devices may be employed, such as an MO (Magneto Optical) disk drive or a DVD (Digital Versatile Disk).

Figure 20:
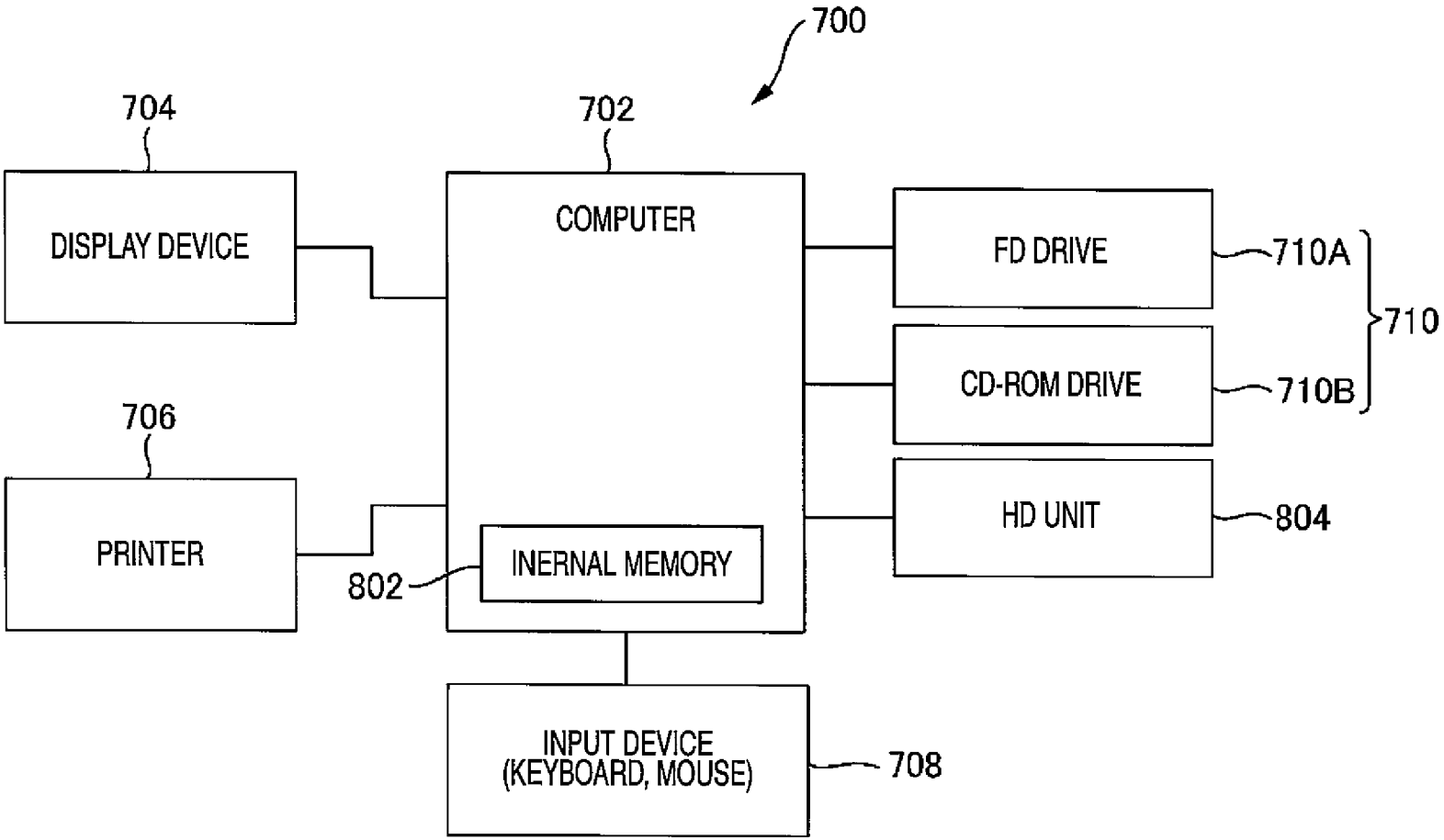
FIG. 20 is a block diagram illustrating a configuration of the image forming system shown in FIG. 19.

FIG. 20 is a block diagram illustrating a configuration of the image forming system shown in FIG. 19. An internal memory 802 such as RAM and an external memory such as a hard disk drive unit 804 are additionally disposed in the chassis in which the computer 702 is received.

It has been described above that the image forming system is constructed by connecting the printer 706 to the computer 702, the display device 704, the input device 708, and the reading device 710, but the invention is not limited to such a construction. For example, the image forming system may includes the computer 702 and the printer 706 and the image forming system may not include any one of the display device 704, the input device 708, and the reading device 710. For example, the printer 706 may have a part of the functions or mechanisms of the computer 702, the display device 704, the input device 708, and the reading device 710. For example, the printer 706 may be constructed to have an image processing unit processing an image, a display unit performing various display operations, and a recording medium mounting unit to and from which a recording medium in which image data photographed with a digital camera are recorded is attached and detached.

The image forming system embodied in the above-mentioned way is more excellent than a conventional system as a whole.

What is claimed is:

1. A developing apparatus comprising:

a developer carrier having concave portions regularly arranged on the surface thereof and being rotatable with a developer thereon; and a contact member being made of an elastic rubber material, being in contact with the surface of the developer carrier, and vibrating with the rotation of the developer carrier, wherein the developing apparatus can be mounted on and demounted from an image forming apparatus body of an image forming apparatus;

wherein an operating temperature range is set in the image forming apparatus; and wherein a value obtained by dividing a movement speed of the surface at the time of rotation of the developer carrier at a constant speed by a pitch of the concave portions in a peripheral direction of the developer carrier is smaller than a peak vibrational frequency of the contact member when a loss tangent obtained by dividing a loss elastic modulus of the contact member by a storage elastic modulus is the greatest at all temperatures in the operating temperature range.

2. The developing apparatus as set forth in claim 1, wherein the contact member is a layer thickness regulating member coming in contact with the surface to regulate the layer thickness of the developer held in the developer carrier.

3. The developing apparatus as set forth in claim 1, wherein the contact member is in contact with the surface so that the longitudinal direction thereof is parallel to the axial direction of the developer carrier and an end in the width direction thereof faces the upstream in the rotation direction of the developer carrier; and wherein a contact portion of the contact member, which is in contact with the surface is apart from the end in the width direction.

4. The developing apparatus as set forth in claim 1, wherein the concave portions are two types of spiral grooves having different tilt angles about the peripheral direction, wherein the two types of spiral grooves intersect each other to form a lattice shape, wherein the developer carrier has square-like top faces surrounded with the two types of spiral grooves, and wherein one of two diagonals of each square-like top face is parallel to the peripheral direction.

5. The developing apparatus as set forth in claim 1, wherein the contact member is made of thermoplastic elastomer.

6. The developing apparatus as set forth in claim 1, wherein the value obtained by dividing the movement speed of the surface at the time of rotation of the developer carrier by the pitch of the concave portions in the peripheral direction of the developer carrier is smaller than the peak vibrational frequency of the contact member when the loss tangent is the greatest and is smaller than a second peak vibrational frequency at which the loss tangent is a half of the greatest value.

7. An image forming apparatus comprising:

an image carrier holding a latent image; and a developing apparatus developing the latent image held by the image carrier with a developer, wherein the developing apparatus includes:

a developer carrier having concave portions regularly arranged on the surface thereof and being rotatable with the developer thereon; and a contact member being made of an elastic rubber material, being in contact with the surface of the developer carrier, and vibrating with the rotation of the developer carrier;

wherein an operating temperature range is set in the image forming apparatus; and wherein a value obtained by dividing a movement speed of the surface at the time of rotation of the developer carrier at a constant speed by a pitch of the concave portions in a peripheral direction of the developer carrier is smaller than a peak vibrational frequency of the contact member when a loss tangent obtained by dividing a loss elastic modulus of the contact member by a storage elastic modulus is the greatest at all temperatures in the operating temperature range.

8. An image forming system comprising:

a computer; and an image forming apparatus connectable to the computer, wherein the image forming apparatus includes:

an image carrier holding a latent image; and a developing apparatus developing the latent image held by the image carrier with a developer;

wherein the developing apparatus includes:

a developer carrier having concave portions regularly arranged on the surface thereof and being rotatable with the developer thereon; and a contact member being made of an elastic rubber material, being in contact with the surface of the developer carrier, and vibrating with the rotation of the developer carrier;

wherein an operating temperature range is set in the image forming apparatus; and wherein a value obtained by dividing a movement speed of the surface at the time of rotation of the developer carrier at a constant speed by a pitch of the concave portions in a peripheral direction of the developer carrier is smaller than a peak vibrational frequency of the contact member when a loss tangent obtained by dividing a loss elastic modulus of the contact member by a storage elastic modulus is the greatest at all temperatures in the operating temperature range.

9. A developing apparatus comprising:

a developer carrier having concave portions regularly arranged on the surface thereof and being rotatable with a developer thereon; and a contact member being made of an elastic rubber material, being in contact with the surface of the developer carrier, and vibrating with the rotation of the developer carrier, wherein the developing apparatus can be mounted on and demounted from an image forming apparatus body of an image forming apparatus;

wherein an operating temperature range is set in the image forming apparatus; and wherein a value obtained by dividing a movement speed of the surface at the time of rotation of the developer carrier at a constant speed by a pitch of the concave portions in a peripheral direction of the developer carrier has the same magnitude of a vibrational frequency at which the storage elastic modulus is smaller than the loss elastic modulus among vibrational frequencies smaller than a peak vibrational frequency of the contact member when a loss tangent obtained by dividing a loss elastic modulus of the contact member by a storage elastic modulus is the greatest at all temperatures in the operating temperature range.

10. The developing apparatus as set forth in claim 9, wherein the contact member is a layer thickness regulating member coming in contact with the surface to regulate the layer thickness of the developer held in the developer carrier.

11. The developing apparatus as set forth in claim 9, wherein the concave portions are two types of spiral grooves having different tilt angles about the peripheral direction, wherein the two types of spiral grooves intersect each other to form a lattice shape;

wherein the developer carrier has square-like top faces surrounded with the two types of spiral grooves; and wherein one of two diagonals of each square-like top face is parallel to the peripheral direction.

12. An image forming apparatus comprising:

an image carrier holding a latent image; and a developing apparatus developing the latent image held by the image carrier with a developer, wherein the developing apparatus includes:

a developer carrier having concave portions regularly arranged on the surface thereof and being rotatable with a developer thereon; and a contact member being made of an elastic rubber material, being in contact with the surface of the developer carrier, and vibrating with the rotation of the developer carrier;

wherein an operating temperature range is set in the image forming apparatus; and wherein a value obtained by dividing a movement speed of the surface at the time of rotation of the developer carrier at a constant speed by a pitch of the concave portions in a peripheral direction of the developer carrier has the same magnitude of a vibrational frequency at which the storage elastic modulus is smaller than the loss elastic modulus among vibrational frequencies smaller than a peak vibrational frequency of the contact member when a loss tangent obtained by dividing a loss elastic modulus of the contact member by a storage elastic modulus is the greatest at all temperatures in the operating temperature range.

13. An image forming system comprising:

a computer; and an image forming apparatus connectable to the computer, wherein the image forming apparatus includes:

an image carrier holding a latent image; and a developing apparatus developing the latent image held by the image carrier with a developer;

wherein the developing apparatus includes:

a developer carrier having concave portions regularly arranged on the surface thereof and being rotatable with a developer thereon; and a contact member being made of an elastic rubber material, being in contact with the surface of the developer carrier, and vibrating with the rotation of the developer carrier;

wherein an operating temperature range is set in the image forming apparatus; and wherein a value obtained by dividing a movement speed of the surface at the time of rotation of the developer carrier at a constant speed by a pitch of the concave portions in a peripheral direction of the developer carrier has the same magnitude of a vibrational frequency at which the storage elastic modulus is smaller than the loss elastic modulus among vibrational frequencies smaller than a peak vibrational frequency of the contact member when a loss tangent obtained by dividing a loss elastic modulus of the contact member by a storage elastic modulus is the greatest at all temperatures in the operating temperature range.

14. A developing apparatus comprising:

a developer carrier having concave portions regularly arranged on the surface thereof and being rotatable with a developer thereon; and a contact member being made of an elastic rubber material, being in contact with the surface of the developer carrier, and vibrating with the rotation of the developer carrier, wherein the developing apparatus can be mounted on and demounted from an image forming apparatus body of an image forming apparatus;

wherein an operating temperature range is set in the image forming apparatus; and wherein a value obtained by dividing a movement speed of the surface at the time of rotation of the developer carrier at a constant speed by a pitch of the concave portions in a peripheral direction of the developer carrier has the same magnitude of a vibrational frequency at which the loss elastic modulus is smaller than the storage elastic modulus among vibrational frequencies smaller than a peak vibrational frequency of the contact member when a loss tangent obtained by dividing a loss elastic modulus of the contact member by a storage elastic modulus is the greatest at all temperatures in the operating temperature range.

15. The developing apparatus as set forth in claim 14, wherein the contact member is a layer thickness regulating member coming in contact with the surface to regulate the layer thickness of the developer held in the developer carrier.

16. The developing apparatus as set forth in claim 15, wherein the layer thickness regulating member is in contact with the surface so that the longitudinal direction thereof is parallel to the axial direction of the developer carrier and an end in the width direction faces the upstream in the rotation direction of the developer carrier, and wherein a contact portion of the layer thickness regulating member is apart from the end in the width direction.

17. The developing apparatus as set forth in claim 14, wherein the concave portions are two types of spiral grooves having different tilt angles about the peripheral direction;

wherein the two types of spiral grooves intersect each other to form a lattice shape;

wherein the developer carrier has square-like top faces surrounded with the two types of spiral grooves; and wherein one of two diagonals of each square-like top face is parallel to the peripheral direction.

18. An image forming apparatus comprising:

an image carrier holding a latent image; and a developing apparatus developing the latent image held by the image carrier with a developer;

wherein the developing apparatus includes:

a developer carrier having concave portions regularly arranged on the surface thereof and being rotatable with a developer thereon; and a contact member being made of an elastic rubber material, being in contact with the surface of the developer carrier, and vibrating with the rotation of the developer carrier;

wherein an operating temperature range is set in the image forming apparatus; and wherein a value obtained by dividing a movement speed of the surface at the time of rotation of the developer carrier at a constant speed by a pitch of the concave portions in a peripheral direction of the developer carrier has the same magnitude of a vibrational frequency at which the loss elastic modulus is smaller than the storage elastic modulus among vibrational frequencies smaller than a peak vibrational frequency of the contact member when a loss tangent obtained by dividing a loss elastic modulus of the contact member by a storage elastic modulus is the greatest at all temperatures in the operating temperature range.

19. An image forming system comprising:

a computer; and an image forming apparatus connectable to the computer, wherein the image forming apparatus includes:

an image carrier holding a latent image; and a developing apparatus developing the latent image held by the image earner with a developer;

wherein the developing apparatus includes:

a developer carrier having concave portions regularly arranged on the surface thereof and being rotatable with a developer thereon; and a contact member being made of an elastic rubber material, being is contact with the surface of the developer carrier, and vibrating with the rotation of the developer carrier; and wherein an operating temperature range is set in the image forming apparatus; and wherein a value obtained by dividing a movement speed of the surface at the time of rotation of the developer carrier at a constant speed by a pitch of the concave portions in a peripheral direction of the developer carrier has the same magnitude of a vibrational frequency at which the loss elastic modulus is smaller than the storage elastic modulus among vibrational frequencies smaller than a peak vibrational frequency of the contact member when a loss tangent obtained by dividing a loss elastic modulus of the contact member by a storage elastic modulus is the greatest at all temperatures in the operating temperature range.

20. An image forming apparatus in which an operating temperature range is set, comprising:

an image carrier holding a latent image;

a developer carrier having concave portions regularly arranged on a surface thereof, being rotatable with a developer held thereon, and developing the latent image with the developer held thereon;

a contact member made of an elastic rubber material being in contact with the surface of the developer carrier and vibrating with the rotation of the developer carrier; and a controller starting the rotation of the developer carrier, then raising a rotation speed of the developer carrier to a first rotation speed at which a movement speed of the surface at the time of rotation of the developer carrier is greater than a product of a pitch of the concave portions in a peripheral direction of the developer carrier and a peak vibrational frequency of the contact member when a loss tangent obtained by dividing a loss elastic modulus of the contact member by a storage elastic modulus is the greatest at all temperatures in the operating temperature range, lowering the rotation speed of the developer carrier to a second rotation speed at which the movement speed is smaller than the product after the rotation speed of the developer carrier becomes the first rotation speed, and allowing the developer carrier rotating at the second rotation speed to develop the latent image.

21. The image forming apparatus as set forth in claim 20, further comprising a developing bias application section applying a developing bias for developing the latent image to the developer carrier, wherein the controller lowers the rotation speed of the developer carrier from the first rotation speed to the second rotation speed via a third rotation speed at which the movement speed is equal to the product after the rotation speed of the developer carrier becomes the first rotation speed and starts the application of the developing bias from the developing bias application section after the rotation speed of the developer carrier becomes the third rotation speed.

22. The image forming apparatus as set forth in claim 21, wherein the controller starts the application of the developing bias from the developing bias application section after a time point in a time period, when a portion, on the surface of the developer carrier, in contact with the contact member when the rotation speed of the developer carrier becomes the third rotation speed moves to a position opposed to the image carrier with an additional rotation of the developer carrier, after the rotation speed of the developer carrier becomes the third rotation speed.

23. An image forming apparatus in which an operating temperature range is set, comprising:

an image carrier holding a latent image;

a developer carrier having concave portions regularly arranged on a surface thereof, being rotatable with a developer held thereon, and developing the latent image with the developer held thereon;

a contact member made of an elastic rubber material being in contact with the surface of the developer carrier and vibrating with the rotation of the developer carrier; and a controller allowing the developer carrier which rotates at a fifth rotation speed at which a movement speed of the surface at the time of rotation of the developer carrier is smaller than a product of a pitch of the concave portions in a peripheral direction of the developer carrier and a peak vibrational frequency of the contact member when a loss tangent obtained by dividing a loss elastic modulus of the contact member by a storage elastic modulus is the greatest at all temperatures in the operating temperature range, to develop the latent image, raising the rotation speed of the developer carrier to a fourth rotation speed at which the movement speed is greater than the product after the developing of the latent image is ended, and stopping the rotation of the developer carrier after the rotation speed of the developer carrier becomes the fourth rotation speed.

24. The image forming apparatus as set forth in claim 23, further comprising a developing bias application section applying a developing bias for developing the latent image to the developer carrier, wherein the controller raises the rotation speed of the developer carrier from the fifth rotation speed to the fourth rotation speed via a third rotation speed at which the movement speed is equal to the product after ending the developing of the latent image, and stops the application of the developing bias from the developing bias application section before a time point in a time period, when a portion, on the surface of the developer carrier, in contact with the contact member when the rotation speed of the developer carrier becomes the third rotation speed moves to a position opposed to the image carrier with an additional rotation of the developer carrier, after the rotation speed of the developer carrier becomes the third rotation speed.

25. The image forming apparatus as set forth in claim 24, wherein the controller stops the application of the developing bias from the developing bias application section before the rotation speed of the developer carrier becomes the third rotation speed.

26. The image forming apparatus as set forth in claim 23, further comprising a rake-out member coming in contact with the surface of the developer carrier to rake out the developer from the developer carrier, wherein the controller stops the rotation after a time point in a time period, when a portion, on the surface of the developer carrier, in contact with the contact member when the rotation speed of the developer carrier becomes the third rotation speed moves to a position opposed to the image carrier with an additional rotation of the developer carrier, after the rotation speed of the developer carrier becomes the third rotation speed, at the time of stopping the rotation of the developer carrier after the rotation speed of the developer carrier becomes the fourth rotation speed.

27. An image forming system comprising:

a computer; and an image forming apparatus being connectable to the computer, wherein an operating temperature range is set in the image forming apparatus;

wherein the image forming apparatus includes:

an image carrier holding a latent image;

a developer carrier having concave portions regularly arranged on a surface thereof, being rotatable with a developer held thereon, and developing the latent image with the developer held thereon;

a contact member made of an elastic rubber material being in contact with the surface of the developer carrier and vibrating with the rotation of the developer carrier; and a controller starting the rotation of the developer carrier, then raising a rotation speed of the developer carrier to a first rotation speed at which a movement speed of the surface at the time of rotation of the developer carrier is greater than a product of a pitch of the concave portions in a peripheral direction of the developer carrier and a peak vibrational frequency of the contact member when a loss tangent obtained by dividing a loss elastic modulus of the contact member by a storage elastic modulus is the greatest at all temperatures in the operating temperature range, lowering the rotation speed of the developer carrier to a second rotation speed at which the movement speed is smaller than the product after the rotation speed of the developer carrier becomes the first rotation speed, and allowing the developer carrier rotating at the second rotation speed to develop the latent image.

28. An image forming system comprising:

a computer; and an image forming apparatus being connectable to the computer, wherein an operating temperature range is set in the image forming apparatus;

wherein the image forming apparatus includes:

an image carrier holding a latent image;

a developer carrier having concave portions regularly arranged on a surface thereof, being rotatable with a developer held thereon, and developing the latent image with the developer held thereon;

a contact member made of an elastic rubber material being in contact with the surface of the developer carrier and vibrating with the rotation of the developer carrier; and a controller allowing the developer carrier which rotates at a fifth rotation speed at which a movement speed of the surface at the time of rotation of the developer carrier is smaller than a product of a pitch of the concave portions in a peripheral direction of the developer carrier and a peak vibrational frequency of the contact member when a loss tangent obtained by dividing a loss elastic modulus of the contact member by a storage elastic modulus is the greatest at all temperatures in the operating temperature range, to develop the latent image, raising the rotation speed of the developer carrier to a fourth rotation speed at which the movement speed is greater than the product after the developing of the latent image is ended, and stopping the rotation of the developer carrier after the rotation speed of the developer carrier becomes the fourth rotation speed.

29. An image forming method in an image forming apparatus, comprising:

a step of raising a rotation speed of a developer carrier to a first rotation speed at which a movement speed of a surface of the developer carrier at the time of rotation of the developer carrier is greater than a product of a pitch of concave portions in a peripheral direction of the developer carrier and a peak vibrational frequency of a contact member when a loss tangent obtained by dividing a loss elastic modulus of the contact member by a storage elastic modulus thereof is the greatest at all temperatures in an operating temperature range of the image forming apparatus after starting the rotation of the developer carrier, the developer carrier having the concave portions regularly arranged on the surface, being rotatable with a developer held thereon, and developing the latent image with the developer held thereon, the contact member being made of an elastic rubber material being in contact with the surface of the developer carrier and vibrating with the rotation of the developer carrier;

a step of lowering the rotation speed of the developer carrier to a second rotation speed at which the movement speed is smaller than the product after the rotation speed of the developer carrier becomes the first rotation speed; and a step of allowing the developer carrier rotating at the second rotation speed to develop the latent image.

30. An image forming method in an image forming apparatus, comprising:

a step of allowing a developer carrier to develop a latent image, the developer carrier rotating at a fifth rotation speed at which a movement speed of a surface of the developer carrier at the time of rotation of the developer carrier is smaller than a product of a pitch of concave portions in a peripheral direction of the developer carrier and a peak vibrational frequency of a contact member when a loss tangent obtained by dividing a loss elastic modulus of the contact member by a storage elastic modulus thereof is the greatest at all temperatures in an operating temperature range of the image forming apparatus, the developer carrier having the concave portions regularly arranged on the surface, being rotatable with a developer held thereon, and developing the latent image with the developer held thereon, the contact member being made of an elastic rubber material being in contact with the surface of the developer carrier and vibrating with the rotation of the developer carrier;

a step of raising the rotation speed of the developer carrier to a fourth rotation speed at which the movement speed is greater than the product after the rotation speed of the developer carrier becomes the first rotation speed after ending the developing of the latent image; and a step of stopping the rotation of the developer carrier after the rotation speed of the developer carrier becomes the fourth rotation speed.

* * * * *